US010519666B2

(12) United States Patent
Huber

(10) Patent No.: US 10,519,666 B2
(45) **Date of Patent: *Dec. 31, 2019**

(54) ROOF DRAIN COVER

(71) Applicant: Roofguard Manufacturing, LLC, Tacoma, WA (US)

(72) Inventor: Donald G Huber, Tacoma, WA (US)

(73) Assignee: Roofguard Manufacturing, LLC, Tacoma, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/914,452

(22) Filed: Mar. 7, 2018

(65) Prior Publication Data

US 2018/0195287 A1 Jul. 12, 2018

Related U.S. Application Data

(63) Continuation of application No. 15/016,880, filed on Feb. 5, 2016, now Pat. No. 9,945,125.

(60) Provisional application No. 62/113,255, filed on Feb. 6, 2015, provisional application No. 62/113,701, filed on Feb. 9, 2015, provisional application No. 62/268,945, filed on Dec. 17, 2015.

(51) Int. Cl.
*E04D 13/04* (2006.01)
*E03F 5/06* (2006.01)

(52) U.S. Cl.
CPC ..... *E04D 13/0409* (2013.01); *E03F 5/06* (2013.01); *E04D 2013/0413* (2013.01)

(58) Field of Classification Search
CPC ..... E04D 13/0404; E04D 13/0409; E04D 2013/0409; E04D 2013/0413; E03F 5/04; E03F 5/0407; E03F 5/06; E03C 1/26; E03C 1/264; E04H 4/1236
USPC ..... 210/163, 166, 170.03, 747.3; 4/292; 52/302.1
See application file for complete search history.

(56) References Cited

U.S. PATENT DOCUMENTS

| | | | |
|---|---|---|---|
| 1,538,924 | A | 5/1925 | Boosey |
| 1,991,772 | A | 1/1933 | Rieger et al. |
| 1,903,366 | A | 4/1933 | Clifford et al. |
| 1,918,509 | A | 7/1933 | Wilcox |

(Continued)

FOREIGN PATENT DOCUMENTS

| | | | |
|---|---|---|---|
| DE | 202014001411 | U1 | 2/2014 |
| GB | 936687 | A | 9/1963 |

OTHER PUBLICATIONS

"Roof Drain Technical Data Section," Jay R. Smith Mfg. Co. (Aug. 2008).

(Continued)

*Primary Examiner* — Christopher Upton
(74) *Attorney, Agent, or Firm* — Knobbe Martens Olson & Bear LLP

(57) ABSTRACT

A cover for a drain. The cover may be used with roof drains or other drains and allow for fluid collection into the drain even with buildup of debris around or on the cover. The cover may have a lower portion with a large area extending outwardly at a small enough angle with respect to the horizontal to allow debris buildup thereon. An upper portion may be connected to the lower end and may be more vertically-oriented than the lower portion. Openings in the upper and lower portions allow for fluid drainage therethrough. Drainage occurs even with debris buildup around or on the cover.

20 Claims, 40 Drawing Sheets

(56) References Cited

U.S. PATENT DOCUMENTS

| | | | | |
|---|---|---|---|---|
| 2,142,343 | A | 10/1935 | Boosey | |
| 2,079,269 | A | 3/1936 | Williams | |
| D101,978 | S | 11/1936 | Williams | |
| 2,121,220 | A | 12/1936 | Filkins | |
| 2,284,416 | A | 5/1942 | Gordon | |
| 2,599,205 | A | 2/1949 | Schmid | |
| 2,701,644 | A | 2/1955 | Griffiths | |
| 2,740,490 | A | 4/1956 | Matheis | |
| 3,517,813 | A | 6/1970 | Thaler | |
| 3,529,723 | A | 9/1970 | Hagedorn | |
| D244,170 | S | 5/1977 | Pearce | |
| D244,854 | S | 6/1977 | Salamone | |
| D249,955 | S | 10/1978 | Vogelsang | |
| 4,505,814 | A | 3/1985 | Marshall | |
| 4,525,273 | A * | 6/1985 | Logsdon | E04D 13/0409 210/164 |
| 4,652,365 | A | 3/1987 | Ebeling | |
| 4,799,713 | A | 1/1989 | Uglow | |
| 4,961,848 | A | 10/1990 | Logsdon | |
| D319,295 | S | 8/1991 | Ohaus | |
| 5,469,670 | A | 11/1995 | Thaler | |
| 5,526,613 | A | 6/1996 | Simeone | |
| 5,535,554 | A | 7/1996 | Harris et al. | |
| 5,618,416 | A | 4/1997 | Haefner | |
| 5,735,091 | A | 4/1998 | Hawkins et al. | |
| 6,165,357 | A | 12/2000 | Cormier | |
| 6,397,408 | B1 | 6/2002 | Veloskey et al. | |
| 6,631,588 | B1 | 10/2003 | Distler | |
| 7,005,061 | B1 | 2/2006 | Downs et al. | |
| D528,193 | S | 9/2006 | Lee | |
| 7,178,179 | B2 | 2/2007 | Barnes | |
| D562,995 | S | 2/2008 | Diamond et al. | |
| D578,619 | S | 10/2008 | Rattenbury | |
| 7,524,414 | B1 | 4/2009 | Barragan | |
| D591,823 | S | 5/2009 | Stolarik et al. | |
| D621,009 | S | 8/2010 | Mjelde et al. | |
| 7,820,041 | B2 | 10/2010 | Hilton et al. | |
| D629,875 | S | 12/2010 | Sears | |
| D670,363 | S | 11/2012 | Yousufzai | |
| D685,065 | S | 6/2013 | Snelling | |
| D687,132 | S | 7/2013 | Snelling | |
| 8,595,992 | B2 | 12/2013 | May et al. | |
| 8,834,714 | B2 | 9/2014 | Chien | |
| D726,885 | S | 4/2015 | Brodey et al. | |
| D743,005 | S | 11/2015 | Donald et al. | |
| D743,509 | S | 11/2015 | Traub et al. | |
| D746,955 | S | 1/2016 | Corder | |
| D754,829 | S | 4/2016 | Krombein | |
| D781,401 | S | 3/2017 | Yan | |
| 9,643,113 | B2 | 5/2017 | Farmer et al. | |
| 9,644,383 | B2 | 5/2017 | Snelling | |
| 9,945,125 | B2 * | 4/2018 | Huber | E04D 13/0409 |
| 2001/0023842 | A1 | 9/2001 | Singleton | |
| 2004/0093666 | A1 | 5/2004 | Zars | |
| 2007/0205144 | A1 | 9/2007 | Robinson | |
| 2008/0307573 | A1 | 12/2008 | Ho | |
| 2009/0049594 | A1 | 2/2009 | Landsberger et al. | |
| 2010/0025312 | A1 | 2/2010 | Martin | |
| 2010/0050335 | A1 | 3/2010 | Baker | |
| 2010/0257791 | A1 | 10/2010 | May et al. | |
| 2012/0047643 | A1 | 3/2012 | Meyers | |
| 2015/0233628 | A1 | 8/2015 | Farmer et al. | |
| 2015/0361646 | A1 | 12/2015 | Meyers | |
| 2016/0230393 | A1 | 8/2016 | Huber | |
| 2018/0195288 | A1 * | 7/2018 | Huber | E04D 13/0409 |

OTHER PUBLICATIONS

International Search Report and Written Opinion in International PCT Application No. PCT/US2016/016773, dated Jun. 10, 2016.

* cited by examiner

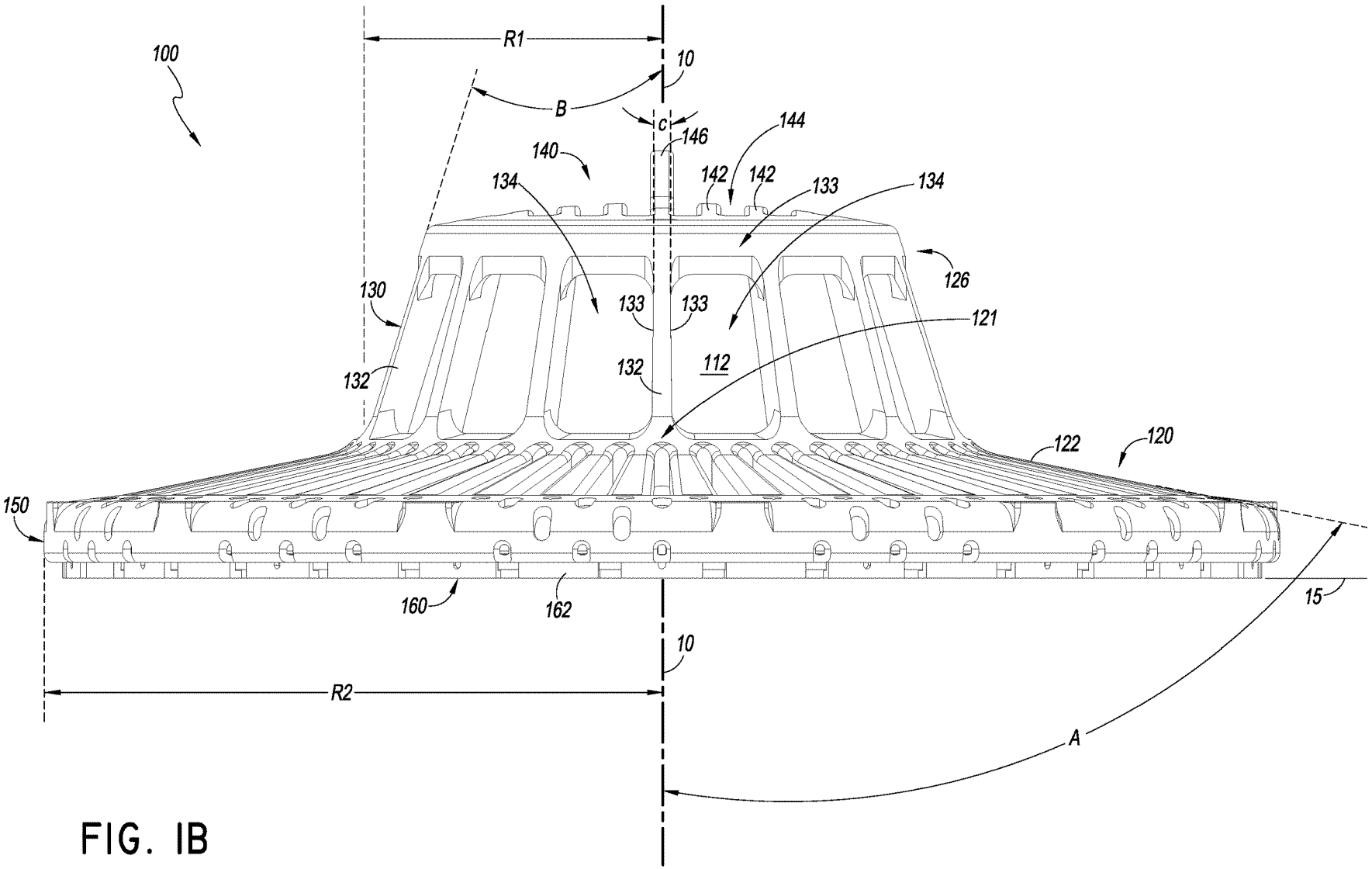
FIG. IB

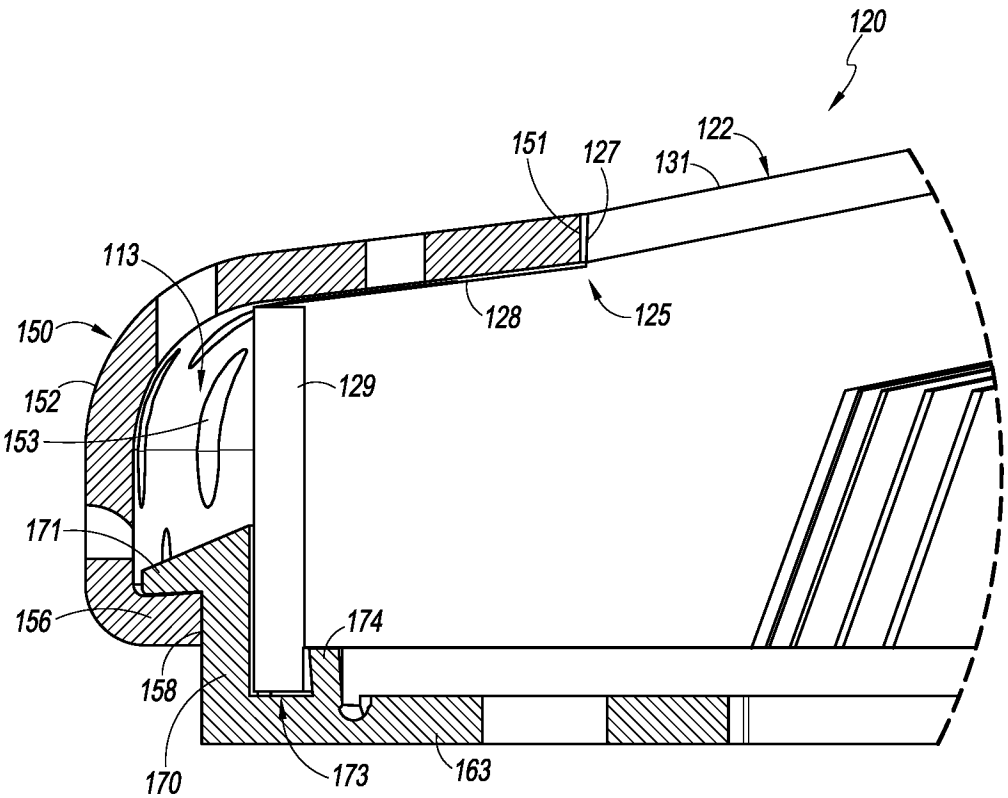
FIG. IE

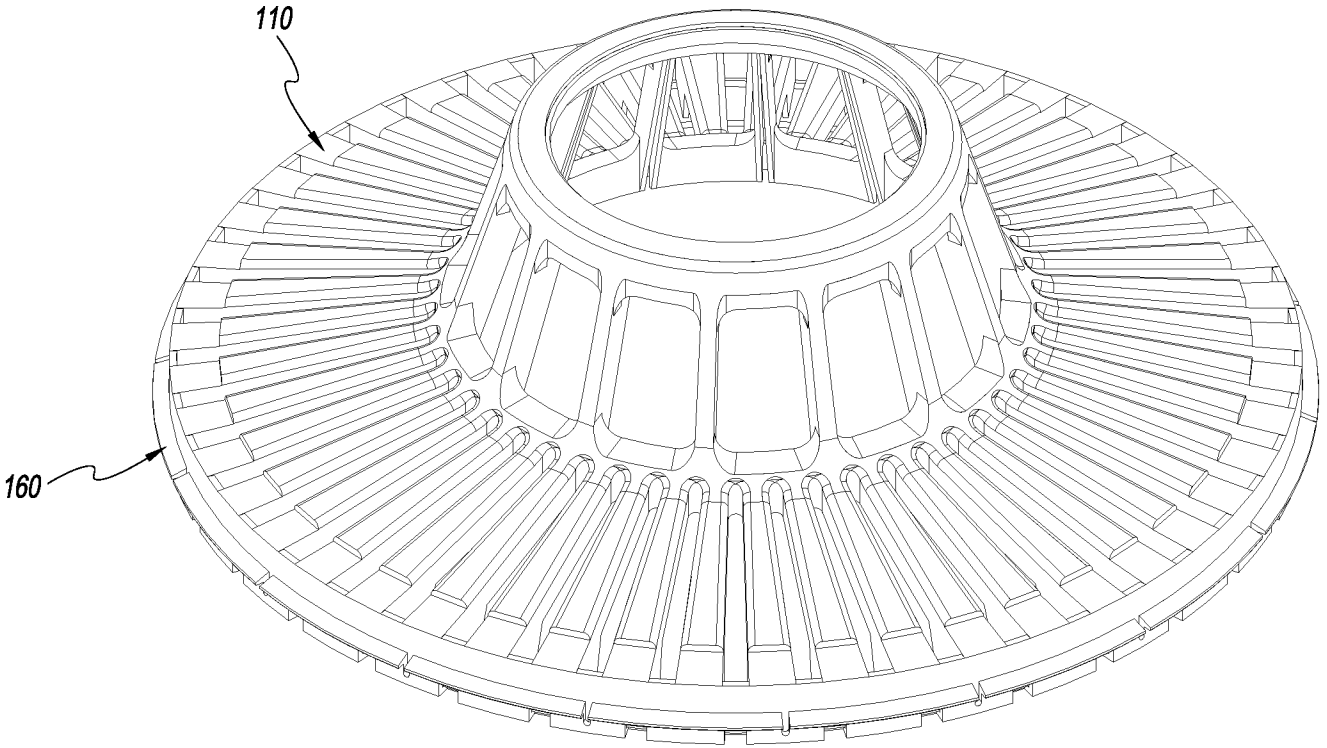
FIG. IF

700

ROOF DRAIN COVER

This application is a continuation of U.S. patent application Ser. No. 15/016,880, titled ROOF DRAIN COVER and filed on Feb. 5, 2016, which claims the benefit of priority under 35 U.S.C. § 119(e) to U.S. provisional patent application No. 62/113,255, titled ROOF DRAIN COVER and filed Feb. 6, 2015, to U.S. provisional patent application No. 62/113,701, titled ROOF DRAIN COVER and filed Feb. 9, 2015, and to U.S. provisional patent application No. 62/268,945, titled ROOF DRAIN COVER and filed Dec. 17, 2015, the entire disclosure of each of which is incorporated by reference herein for all purposes and forms a part of this specification.

INCORPORATION BY REFERENCE TO ANY PRIORITY APPLICATIONS

Any and all applications, for which a foreign or domestic priority claim is identified in the Application Data Sheet as filed with the present application, are hereby incorporated by reference.

BACKGROUND

Field

This disclosure relates generally to covers for drains. In particular, a cover for a roof drain is disclosed that includes features to prevent and/or reduce the blockage of roof drains by solid debris.

Description of the Related Art

A variety of drains exist for removing unwanted fluids, such as rainwater or melted snow. Some drains are intended for the roof in order to drain such fluids from the tops of buildings or other structures. Because roof drains are typically exposed to the elements, they are susceptible to damage or clogging from a variety of sources. Also, due to their isolation, any damage or tampering with such drains may go unnoticed until a problem occurs with the functioning of the drain. Further, harmful elements may damage or clog the drains, such as hail or strong winds and solid debris carried by such elements. Other drains besides those intended for the roof may also be susceptible to similar problems. For example, street drains may be susceptible to clogging from collected street debris or to damage by passersby. Therefore, drains in many contexts may be exposed to danger.

Because of these and other concerns, some drains may be fitted with a cover. The cover may protect the drain from such harmful influences. However, typical drain covers have many drawbacks. They typically must be fastened to the drains and thus must be compatible with the geometry or corresponding structure of the particular drain type being covered. This limits the number of types of drains that may be fitted with the covers. In addition, conventional drain covers easily clog and prevent the passage of fluid, due to leaves or other debris building up along the outside of the covers. Typical drain covers receive fluids through spaces defined by vertically-oriented members and have gravel guards near the base of the covers to prevent gravel and other small solid debris from flowing into the cover. If leaves or other debris block these members and the spaces in between, then water is prevented from flowing through the cover and entering the drain. Further, the gravel guard on typical covers severely impede the flow of fluids into the cover as well.

There is therefore a need for improved drain covers that overcome the aforementioned drawbacks.

SUMMARY

Features are disclosed for a drain cover. The cover may be used with roof drains, but it is not limited to use with only roof drains. The cover may be used with floor drains, indoor or outdoor drains, street grating, and other drains. The cover may be installed and removed over these and other drains easily and quickly. The drain allows for fluid flow while preventing and/or reducing blockage. The cover may prevent and/or reduce buildup of flow-impeding debris on and along the outside of the drain and the cover, and the cover may allow passage of fluid through the cover and into the drain even when there is a buildup of debris on or around the cover. The cover may have an advantageously-designed body including an extended outer flow ring, or "skirt," that contributes to the improved fluid collection capability.

In a first aspect, a cover for a drain is disclosed. The cover may comprise a dome having an arcuate sidewall with a lower portion, wherein the sidewall defines a central axis and forms a plurality of first openings extending through the sidewall, and wherein the lower portion is located a perpendicular distance R1 from the central axis. The cover may further comprise an arcuate skirt coupled with the lower portion of the sidewall and having an outer edge, wherein the skirt flares outward and downward from the lower portion to the outer edge in a first direction that is generally away from the central axis and generally away from the dome. The first direction may form an acute angle A with a portion of the axis that extends below the skirt, wherein the skirt forms a plurality of second openings extending through the skirt, and wherein the outer edge of the skirt is located a perpendicular distance R2 from the axis, and wherein R2 is at least twice R1.

In some embodiments, $R2 \geq 2.25 \times R1$. In some embodiments, $R2 \geq 2.5 \times R1$. In some embodiments, $R2 \geq 2.75 \times R1$. In some embodiments, $R2 \geq 3 \times R1$.

In some embodiments, the acute angle A is greater than or equal to eighty-five degrees. In some embodiments, the acute angle A is greater than or equal to eighty degrees. In some embodiments, the acute angle A is greater than or equal to seventy-five degrees. In some embodiments, the acute angle A is greater than or equal to seventy degrees. In some embodiments, the acute angle A is greater than or equal to sixty-five degrees. In some embodiments, the acute angle A is greater than or equal to sixty degrees.

In some embodiments, the dome and skirt may be swept out arcuately 360 degrees about the central axis. In some embodiments, R1 and R2 may be radii of the lower portion of the dome and of the outer edge of the skirt, respectively, and the dome and skirt may be swept out circularly 360 degrees about the central axis. In some embodiments, the dome and skirt may be swept out arcuately less than 360 degrees about the central axis. In some embodiments, R1 and R2 may be radii of the lower portion of the dome and of the outer edge of the skirt, respectively, and the dome and skirt may be swept out circularly less than 360 degrees about the central axis. In some embodiments, the dome and skirt may be swept out arcuately less than or equal to 180 degrees about the central axis. In some embodiments, R1 and R2 may be radii of the lower portion of the dome and of the outer edge of the skirt, respectively, and the dome and skirt may be swept out circularly less than or equal to 180 degrees about the central axis.

In some embodiments, the skirt may further comprise a plurality of elongated lower ribs, wherein the plurality of elongated lower ribs define the plurality of second openings extending through the skirt. In some embodiments, each of the plurality of elongated lower ribs has a first end and a second end that is opposite the first end, wherein the first end is coupled with the lower portion of the dome and the second end is coupled with the outer edge of the skirt. In some embodiments, the plurality of elongated lower ribs extend generally along the first direction. In some embodiments, the plurality of elongated lower ribs are oriented generally radially with respect to the axis.

In some embodiments, the dome extends upward from the lower portion to a top portion of the dome in a second direction that is generally away from the skirt. In some embodiments, the second direction is parallel with the central axis. In some embodiments, the dome extends inward from the lower portion to the top portion of the dome in the second direction, wherein the second direction is also generally toward the central axis. In some embodiments, the second direction forms an acute angle B with a portion of the central axis that extends above the dome. In some embodiments, the acute angle B is less than or equal to five degrees. In some embodiments, the acute angle B is less than or equal to ten degrees. In some embodiments, the acute angle B is less than or equal to fifteen degrees. In some embodiments, the acute angle B is less than or equal to twenty degrees. In some embodiments, the acute angle B is less than or equal to twenty-five degrees. In some embodiments, the acute angle B is less than or equal to thirty degrees.

In some embodiments, the dome further comprises a plurality of elongated upper ribs, wherein the plurality of elongated upper ribs define the plurality of first openings extending through the sidewall. In some embodiments, each of the plurality of elongated upper ribs has a first end and a second end that is opposite the first end, wherein the first end is coupled with the lower portion of the dome and the second end is coupled with a top portion of the dome. In some embodiments, the plurality of elongated upper ribs extend generally along the second direction. In some embodiments, the second direction is parallel with the central axis. In some embodiments, the dome extends inward from the lower portion to the top portion of the dome in the second direction, wherein the second direction is also generally toward the central axis.

In some embodiments, the dome and skirt are swept out arcuately 360 degrees about the central axis and the cover is configured to couple with a mounting surface adjacent a drain of the mounting surface. In some embodiments, the mounting surface comprises a roof. In some embodiments, the dome and skirt are swept out arcuately less than 360 degrees about the central axis in respective sections defining first and second mating surfaces on first and second ends respectively of the swept out sections, the first and second mating surfaces shaped to complement an external structure adjacent the mounting surface. In some embodiments, the external mounting structure is a wall intersecting the mounting surface and having a drain therein configured to be covered by the cover. In some embodiments, the first mating surface forms a first contour that is substantially planar, and wherein the second mating surface forms a second contour that is substantially planar. In some embodiments, the first and second contours are substantially coplanar. In some embodiments, the first and second contours are substantially non coplanar. In some embodiments, the first mating surface forms a first contour that is substantially non planar. In some embodiments, the second mating surface forms a second contour that is substantially non planar.

In some embodiments, the cover further comprises an arcuate outer ring configured to couple with the outer edge of the skirt, and to at least partially cover the outer edge when coupled thereto. In some embodiments, the arcuate outer ring further comprises a plurality of openings extending through the arcuate outer ring and configured to allow fluid passage through the openings. In some embodiments, at least one of the plurality of openings of the arcuate outer ring is further configured to be in fluid communication with at least one of the plurality of lower spaces of the skirt when the arcuate outer ring is coupled with the skirt. In some embodiments, the arcuate outer ring is coupled with the outer edge of the skirt.

In some embodiments, the cover further comprises an arcuate mount configured to couple with the cover and with a mounting surface adjacent a drain. In some embodiments, the arcuate mount comprises an arcuate foundation having a top side and a bottom side opposite the top side, the top side configured to face the cover and having a catch configured to couple with at least one projecting insert of the cover, the bottom side configured to face the mounting surface. In some embodiments, the at least one projecting insert is on the outer ring such that the mount couples with the outer ring. In some embodiments, the at least one projecting insert is on the skirt such that the mount couples with the skirt. In some embodiments, the at least one projecting insert is on the outer edge of the skirt. In some embodiments, the catch of the arcuate mount is a nub and includes an opening therein, the opening configured to receive and releasably snap therein the projecting insert. In some embodiments, the catch is an arcuate outer lip extending along an outer perimeter of the arcuate foundation and configured to couple with the outer edge of the skirt. In some embodiments, the arcuate outer lip is further configured to couple with the outer edge of the skirt by expanding to receive the outer edge therein and then contracting to secure the outer edge therein. In some embodiments, the arcuate mount further comprises a plurality of arcuate tabs coupled with the arcuate foundation and extending inward toward the axis when coupled with the cover. In some embodiments, the plurality of arcuate tabs are interspersed in between adjacent segments of the foundation. In some embodiments, the plurality of arcuate tabs are interspersed in between adjacent segments of the foundation and having a gap therebetween to form a plurality of flex joints. In some embodiments, the plurality of arcuate tabs having openings therethrough configured to receive a fastener therein to secure the arcuate mount to the mounting surface.

In some embodiments, the skirt, the dome, the outer ring and the mount are swept out arcuately 360 degrees about the central axis. In some embodiments, R1 and R2 are radii of the lower portion of the dome and of the outer edge of the skirt, respectively, and wherein skirt, the dome, the outer ring and the mount are swept out circularly 360 degrees about the central axis.

In some embodiments, the skirt, the dome, the outer ring and the mount are swept out arcuately less than 360 degrees about the central axis. In some embodiments, R1 and R2 are radii of the lower portion of the dome and of the outer edge of the skirt, respectively, and wherein the skirt, the dome, the outer ring and the mount are swept out circularly less than 360 degrees about the central axis.

In some embodiments, the dome and skirt are swept out arcuately less than or equal to 180 degrees about the central axis. In some embodiments, R1 and R2 are radii of the lower portion of the dome and of the outer edge of the skirt, respectively, and wherein the skirt, the dome, the outer ring and the mount are swept out circularly less than or equal to 180 degrees about the central axis.

In some embodiments, the dome has a top portion defining a plurality of top spaces extending therethrough and configured to allow fluid to pass therethrough. In some embodiments, the dome further comprises a plurality of elongated upper ribs, and wherein each of the plurality of elongated upper ribs is coupled directly with one of the plurality of elongated lower ribs forming a continuous rib from the outer edge of the skirt to a top portion of the dome. In some embodiments, each of the plurality of lower spaces is in direct fluid communication with one of the plurality of upper spaces forming a continuous space. In some embodiments, the plurality of first openings of the dome are wider than the plurality of second openings of the skirt.

In some embodiments, each of the plurality of elongated lower ribs further comprises a first end having a first width, and a second end that is opposite the first end and having a second width, wherein the first end is connected to the lower portion of the dome and the second end is connected to the outer edge of the skirt. In some embodiments, the first width is approximately equal to the second width. In some embodiments, the first width is less than the second width. In some embodiments, each of the plurality of elongated lower ribs further comprises a first side extending from the first end to the second end and defining a first plane, and a second side that is opposite the first side, the second side extending from the first end to the second end and defining a second plane, wherein the first and second planes are not parallel to each other. In some embodiments, an acute angle between the first and second planes is less than or equal to fifteen degrees. In some embodiments, the acute angle between the planes is less than or equal to ten degrees. In some embodiments, the first width is greater than the second width.

In some embodiments, the dome further comprises a removable lid at a top portion of the dome. In some embodiments, the lid comprises a handle projecting therefrom and configured to be grasped by a user to remove the lid from the top.

In another aspect, a cover for a drain is disclosed comprising an arcuate lower portion defining a central vertical axis and comprising: an arcuate outer perimeter defining a horizontal plane substantially orthogonal to the central axis and having at least one insert coupled with and projecting away from the arcuate outer perimeter; a plurality of elongated lower ribs connected to the arcuate outer perimeter and extending toward the central vertical axis at an acute angle A with respect to the horizontal plane, wherein A is less than or equal to thirty degrees; and a plurality of lower spaces extending through the arcuate lower portion and configured to allow fluid flow therethrough; an arcuate outer ring coupled to the arcuate outer perimeter of the arcuate lower portion and to at least partially cover the arcuate outer perimeter when coupled thereto; an arcuate mount comprising: an arcuate foundation having a top side and a bottom side opposite the top side, the top side configured to face the arcuate lower portion and having a catch configured to couple with the at least one projecting insert of the arcuate outer perimeter of the arcuate lower portion, the bottom side configured to couple with an external mounting structure; an arcuate upper portion comprising: a plurality of elongated upper ribs each having a first end and a second end opposite the first end, the first end coupled with the plurality of elongated lower ribs of the arcuate lower portion, and extending away from the arcuate lower portion at an angle B with respect to a portion of the central vertical axis that extends above the dome; and a plurality of upper spaces in between and defined at least partially by the plurality of elongated upper ribs; and a top coupled with the second ends of the plurality of elongated upper ribs of the arcuate upper portion.

In another aspect, a method of coupling a cover for a drain to a mounting surface is disclosed. In some embodiments, the method comprises coupling the cover to the mounting surface such that the cover at least partially surrounds the drain, wherein the drain has a half-width of R1, wherein the cover includes an arcuate dome defining a central axis and an arcuate skirt coupled with the dome and having an outer edge, wherein the skirt flares outward and downward from the dome to the outer edge in a first direction that is generally away from the central axis and generally away from the dome, wherein the first direction forms an acute angle A with a portion of the central axis that extends below the skirt, wherein the skirt forms a plurality of openings extending through the skirt, and wherein the outer edge of the skirt is located a perpendicular distance R2 from the axis, and wherein R2 is at least twice R1.

In another aspect, a cover for a drain is disclosed that comprises a dome having a sidewall with a lower portion, wherein the sidewall defines a central axis and forms a plurality of first openings extending through the sidewall, and wherein at least part of the lower portion is located a perpendicular distance R1 from the axis; and a skirt coupled with the lower portion of the sidewall and having an outer edge, wherein the skirt flares outward and downward from the lower portion to the outer edge in a first direction that is generally away from the central axis and generally away from the dome, wherein the first direction forms an acute angle A with a portion of the central axis that extends below the skirt, wherein the skirt forms a plurality of second openings extending through the skirt, and wherein at least part of the outer edge of the skirt is located a perpendicular distance R2 from the central axis, and wherein R2 is at least twice R1.

In some embodiments, the lower portion is located a minimum perpendicular distance R1 from the central axis, and wherein the outer edge of the skirt is located a minimum perpendicular distance R2 from the central axis. In some embodiments, the skirt has a generally square planform.

In another aspect, a cover for a drain is disclosed, where the drain has a drain body opening having a maximum width W, and the cover comprises a skirt having an outer edge, wherein the skirt forms a plurality of openings extending through the skirt, and wherein at least part of the outer edge of the skirt is located a perpendicular distance R2 from a geometric center axis defined by the outer edge, and wherein R2 is greater than or equal to W. In some embodiments, $R2 \geq 1.5 \times W$. In some embodiments, $R2 \geq 2 \times W$. In some embodiments, $R2 \geq 3 \times W$. In some embodiments, $R2 \geq 4 \times W$. In some embodiments, $R2 \geq 5 \times W$.

In some embodiments, the cover may further comprise a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1. In some embodiments, W is less than or equal to 1 inch.

In some embodiments, W is less than or equal to 1.5 inches. In some embodiments, W is less than or equal to 2 inches. In some embodiments, W is less than or equal to 3 inches. In some embodiments, W is less than or equal to 4 inches. In some embodiments, W is less than or equal to 5 inches. In some embodiments, W is less than or equal to 6 inches. In some embodiments, R2 is greater than or equal to W. In some embodiments, R2≥1.5×W In some embodiments, R2≥2×W. In some embodiments, R2≥3×W. In some embodiments, R2≥4×W. In some embodiments, R2≥5×W. In some embodiments, the cover may further comprise a mount configured to couple with the cover and with a mounting surface adjacent the drain.

In another aspect, a mount for coupling a drain cover with a mounting surface adjacent a drain is disclosed. The mount is configured to couple with the cover and with the mounting surface adjacent the drain. In some embodiments, the drain has a drain body opening having a maximum width W, wherein the mount has a width R3, and wherein R3 is at least twice W.

In some embodiments of the mount, R3≥3×W. In some embodiments, R3≥4×W. In some embodiments, R3≥5×W. In some embodiments, the mount further comprises a foundation having a top side and a bottom side opposite the top side, the top side configured to face the cover and having a protrusion configured to be received through a flexible opening of the cover, the bottom side configured to face the mounting surface. In some embodiments, the protrusion at least partially extends through the flexible opening when the mount is coupled with the cover. In some embodiments, the protrusion comprises an extended section coupled with a ball catch on the end of the extended section. In some embodiments, the extended section at least partially extends through the flexible opening when the mount is coupled with the cover, and wherein the ball catch is adjacent the top side of the foundation when the mount is coupled with the cover. In some embodiments, the foundation is arcuate. In some embodiments, the drain has a drain body opening having a maximum width W, the mount has a width R3, and R3 is at least twice W. In some embodiments, R3≥3×W. In some embodiments, R3≥4×W. In some embodiments, R3≥5×W. In some embodiments, mount further comprises a plurality of inwardly extending tabs coupled with the foundation. In some embodiments, the plurality of tabs are interspersed in between adjacent segments of the foundation. In some embodiments, the plurality of tabs are interspersed in between adjacent segments of the foundation and having a gap therebetween to form a plurality of flex joints. In some embodiments, the plurality of tabs having openings therethrough configured to receive a fastener therein to secure the mount to the mounting surface. In some embodiments, the plurality of tabs are arcuate. In some embodiments, the mount is configured to adhere to the mounting surface. In some embodiments, the mount is configured to fasten to the mounting surface.

In another aspect, a pipe stem for connecting a drain cover with a drain body is disclosed. The pipe stem comprises a sidewall defining a channel therethrough and having a first end and a bottom end; a plurality of openings formed in the sidewall configured to allow fluid to pass therethrough and into the channel, wherein the first end is configured to couple with the drain cover, and wherein the second end is configured to couple with the drain body.

In some embodiments of the pipe stem, the second end is configured to snap fit to the drain body. In some embodiments, the second end is configured to snap fit to the drain body. In some embodiments, the second end comprises threads and is configured to screw onto the drain body. In some embodiments, the pipe stem further comprises a clip configured to couple the second end of the pipe stem to the drain body. In some embodiments, the plurality of openings extend longitudinally between the first and second ends. In some embodiments, the sidewall is arcuate. In some embodiments, the sidewall is circular. In some embodiments, the sidewall is metallic. In some embodiments, the sidewall is plastic. In some embodiments, the sidewall is a polymer. In some embodiments, the sidewall is circular.

In some embodiments the cover includes a skirt comprising a plurality of levels including at least a top level and a bottom level located generally lower than the top level, and wherein adjacent levels are coupled to each other by a connecting sidewall having a plurality of openings therethough.

In some embodiments of the cover having a plurality of levels, the bottom level comprises the outer edge. In some embodiments, the cover further comprises at least one intermediate level located in between the top and bottom levels, wherein a first connecting sidewall couples the bottom level with the intermediate level, and wherein a second connecting sidewall couples the intermediate level with the top level. In some embodiments, the cover further comprises at least a first and second intermediate level located in between the top and bottom levels, wherein a first connecting sidewall couples the bottom level with the first intermediate level, wherein a second connecting sidewall couples the first intermediate level with the second intermediate level, and wherein a third connecting sidewall couples the second intermediate level with the top level. In some embodiments, R2≥3×W. In some embodiments, R2≥4×W. In some embodiments, R2≥5×W. In some embodiments, the cover further comprises a dome having a sidewall with a lower portion, wherein the lower portion is coupled with the top level of the skirt, wherein the sidewall forms a plurality of openings extending through the sidewall, and wherein at least part of the lower portion is located a perpendicular distance R1 from the axis, In some embodiments of the cover having a plurality of levels, each level of the skirt flares outward and downward in generally parallel directions, each direction being generally away from the axis and generally away from the dome, wherein each direction forms an acute angle A with a portion of the axis that extends below the skirt, and wherein R2 is at least twice R1. In some embodiments W is less than or equal to 1 inch. In some embodiments W is less than or equal to 1.5 inches. In some embodiments W is less than or equal to 2 inches. In some embodiments W is less than or equal to 3 inches. In some embodiments W is less than or equal to 4 inches. In some embodiments W is less than or equal to 5 inches. In some embodiments W is less than or equal to 6 inches. In some embodiments is less than or equal to 1 inches.

In another aspect, a cover for a drain is disclosed. The cover comprises a skirt and a dome configured to couple with the skirt. The skirt having a flat portion including a plurality of openings extending therethorugh, the flat portion forming a plurality of grooves extending in a first direction and having an outer slot surrounding the flat portion on one or more sides of an outer region of the flat portion; and an angled portion including a plurality of openings extending therethorugh, the angled portion coupled with the outer region of the flat portion and having an outer edge, wherein the angled portion flares outward and downward from the flat portion to the outer edge. The dome comprises a first dome portion and a second dome portion, wherein each dome portion comprises a sidewall with a lower portion, wherein each sidewall forms a plurality of openings extending through the sidewall, and wherein the first dome portion is configured to move relative to the second dome portion to position the dome on the skirt, and wherein the grooves and outer slot of the skirt are each configured to receive at least part of the lower portions of the first and second dome portions, such that the first and second dome portions can slide in the first direction.

In some embodiments, the grooves and outer slot of the skirt are each configured to receive at least part of the lower portions of the first and second dome portions, such that the first and second dome portions can slide in a second direction that is perpendicular to the first direction. In some embodiments, each sidewall of the first and second dome portions includes complementary fingers extending towards each other and configured to slide past each other when the first and second dome portions are positioned on the skirt. In some embodiments, the skirt has a generally rectangular planform. In some embodiments, the outer edge of the skirt is generally rectangular. In some embodiments, the flat portion of the skirt is generally rectangular. In some embodiments, the skirt defines a geometric center axis that is perpendicular to the flat portion of the skirt, wherein at least part of the angled portion of the skirt flares outward and downward from the outer region of the flat portion to the outer edge in a first direction that is generally away from the axis and generally away from the flat portion, and wherein the first direction forms an acute angle A with a portion of the axis that extends below the flat portion. In some embodiments, the angled portion includes a first, second and third angled sub-portion, wherein the first angled sub-portion is oriented angularly 90 degrees with respect to the second angled sub-portion, and wherein the second angled sub-portion is oriented angularly 90 degrees with respect to the third angled sub-portion. In some embodiments, the drain is a scupper having an opening with a maximum width W, wherein the grooves and outer slot of the skirt are each configured to receive at least part of the lower portions of the first and second dome portions, wherein the first and second dome portions can slide in a second direction that is perpendicular to the first direction. In some embodiments, the first and second dome portions can slide in a second direction that is perpendicular to the first direction so that a maximum distance between outermost parts of the first and second dome portions is less than or equal to W. In some embodiments, the first and second dome portions can slide in a second direction that is perpendicular to the first direction so that a maximum distance between outermost parts of the first and second dome portions is greater than W.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow. All of these embodiments are intended to be within the scope of the present disclosure. These and other embodiments will become readily apparent to those skilled in the art from the following detailed description of the preferred embodiments having reference to the attached figures, the invention not being limited to any particular preferred embodiment(s) disclosed or summary provided herein.

BRIEF DESCRIPTION OF THE DRAWINGS

Elements in the figures have not necessarily been drawn to scale in order to enhance their clarity and improve understanding of these various elements and embodiments described herein. Furthermore, elements that are known to be common and well understood to those in the industry are not depicted in order to provide a clear view of the various embodiments described herein, thus the drawings are generalized in form in the interest of clarity and conciseness.

FIG. 1B is a side view of the cover of FIG. 1A.

FIG. 1E is a detail view of the region 1E as indicated in FIG. 1D showing a cross-section of the interface of the cover including the skirt, the outer ring and the mount.

FIGS. 1F-1G are various views of an embodiment of the body of the cover of FIG. 1A coupled with the mount where the outer ring has been removed.

FIG. 1I is a side view of the body of the cover of FIG. 1A.

DETAILED DESCRIPTION

Figure 1A:
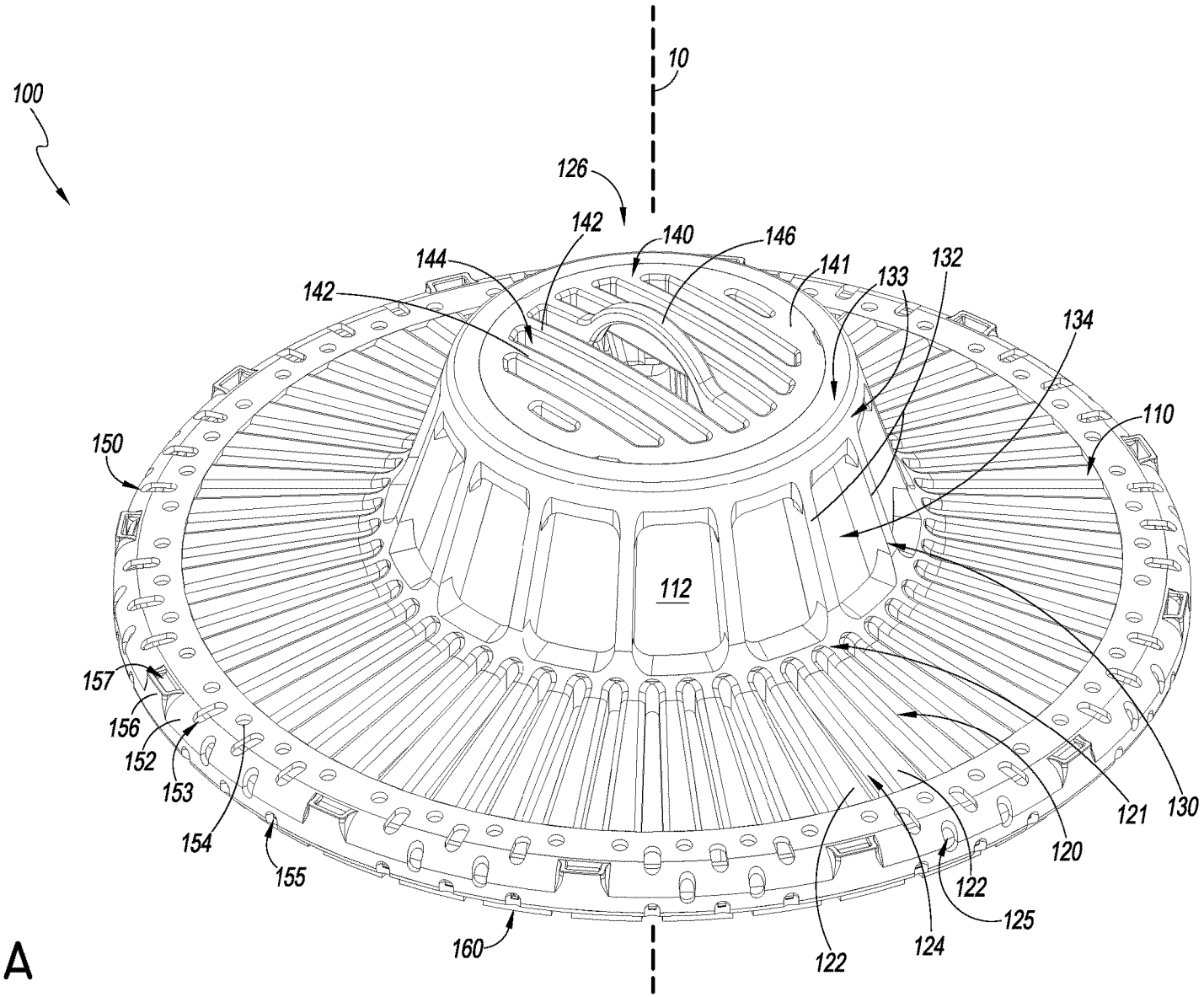
FIG. 1A is a perspective view of an embodiment of a cover for a drain including embodiments of a dome, a skirt, an outer ring and a mount.

In the following discussion that addresses a number of embodiments and applications, reference is made to the accompanying drawings that form a part hereof, and in which is shown by way of illustration specific embodiments in which the embodiments described herein may be practiced. It is to be understood that other embodiments may be utilized and changes may be made without departing from the scope of the disclosure.

Various inventive features are described below that can each be used independently of one another or in combination with another feature or features. However, any single inventive feature may not address all of the problems discussed above or only address one of the problems discussed above. Further, one or more of the problems discussed above may not be fully addressed by the features of each embodiment described below.

In certain embodiments, the cover disclosed herein prevents or reduces the blockage of fluid from entering a drain caused by the buildup of leaves and other debris. Therefore, even with buildup of debris along or on the outside of the cover, the cover still allows for the passage of fluid through the cover and into the drain. For instance, debris may collect on top of the cover and the cover may still allow for the drainage of fluid even with such debris on the cover. Further, the features of the cover mitigate the chances of such buildup in the first place. The cover can be used with new drains or retro-fitted for existing drains.

The cover can have a top portion configured to be positioned generally over the drain, a middle portion that may be slightly angled off the vertical and extending outward from the top portion, and a lower flange or portion that is generally horizontal but slightly sloped downward and extending outward from the middle portion. This lower portion may have a large area over which fluid and debris can flow, in order to reduce the chances of debris buildup and to optimize the flow of fluid through spaces or openings in the lower portion. The middle and lower portions may have radially-elongated spaces defined by ribs. Theses spaces may extend through the middle and lower portions and thereby allow fluids to flow through these two portions. The top portion may have spaces as well. The cover can also have an outer ring that attaches to the outer perimeter of the lower portion.

Further, the cover may have a mount configured to attach to a surface or surfaces other than the drain itself. The mount may be installed around the drain, and the cover may be easily attached to the mount. The mount may have flex joints that allow for the mount to conform to elevations or other protuberances on the mounting structure or surface to which the mount attaches. The cover may attach to the mount by friction fit, for instance by snapping projections of the cover into corresponding receiving structures of the mount. This configuration of the various portions of the drain cover, along with other features of the drain cover disclosed herein, produces a cover with improved performance characteristics, including allowing fluids to flow through the cover and into the drain even in the presence of buildup of solids or other foreign debris along and/or on the outside of the cover while also reducing the amount of debris buildup around the drain and cover. In certain embodiments, the cover can be coupled to a mount that is coupled to the drain. The cover may attach to the mount by friction fit, for instance by snapping projections of the cover into corresponding receiving structures of the mount.

FIG. 1A is a perspective view of an embodiment of a cover 100 for a drain, such as a roof drain. The cover 100 may be used with many other types of drains as well. For example, the cover 100 may be used with other outdoor drains, indoor drains, street drains, street grating, etc. Thus, the cover 100 is not limited to use with any one type of drain. The cover 100 has features that allow for the flow of fluid through the cover and into the drain even with buildup of debris on or around the cover 100, as described in detail herein.

As shown in FIG. 1A, the cover 100 may have a body 110. The body 110 may be formed from a variety of suitable materials. In some embodiments, the body 110 may be formed from plastic, polymers, metals, other materials, and/or combinations thereof. The various features or parts of the body 110 may be formed from the same, monolithic piece of material. For example, the entire body 110 may be formed by molding a material into the various shapes of the cover 100. In some embodiments, the body 110 may be formed by injection molding various features of the cover 100. However, the various features or parts of the body 110 may be formed as separate parts that are attached or otherwise connected together. For example, portions of the body 110 may be formed separately from other portions which are then joined together in a variety of suitable means, for example by adhering, bonding, mechanically connecting such as with fasteners or brackets, welding, or other suitable mechanism or method.

The body 110 may include one or more sections coupled together, such as an upper dome section or dome 126 coupled with a lower skirt section or a skirt 120. As shown, the body 110 may include the skirt 120. The skirt 120 may be a relatively lower part or parts of the cover 100. By "lower" it is understood that this description is relative to the orientation shown in FIG. 1A of the cover 100. The cover 100 may be installed in the orientation as shown with a drain located underneath the cover 100 as oriented in the figure. Therefore, the designations "lower," "upper," and the like may refer to locations that are relative to a particular orientation and are merely used for convenience to describe the various features.

The skirt 120 may comprise a part or parts that are oriented generally in the manner of a flange or other arcuate configuration. By "arcuate" it is meant that a feature may be rounded in a variety of ways, roughly similar to an arc. Therefore, the term "arcuate" may refer to a circular shape.

However, arcuate may also refer to other rounded shapes, such as elliptical, circumferential, annular, other forms of rounded, or combinations thereof. Arcuate does not impose any requirements on the shape of the edges of the arcuate part. Thus, arcuate may also refer to a rounded shape having straight ends or edges, such as a 2D cross-section extruded about an axis to forma 3D part, but where the resulting 3D part has straight outer edges such that the planform (i.e. view from top of bottom of the part) of the 3D part appears to be square- or rectangular-shaped. Therefore, the term arcuate is not meant to be limiting the configuration of the various parts to any one particular shape.

Various features of the cover 100 may be described with reference to the central axis 10, as shown. The axis 10 may be a geometric reference line that is not a physical feature of the cover 100. In some embodiments, the axis 10 may be defined by one or more parts of the cover 100. In some embodiments, various features of the cover 100 may be circular with the axis 10 intersecting the center or near the center of the various circular portions. However, the various features of the cover 100 need not be circular but may still be referred with reference to the axis 10. The axis 10 may be vertically-oriented as shown.

The skirt 120 may be coupled with a lower portion 121 of the upper dome 126. The lower portion 121 may be a generally arcuate section of the cover 100 that extends in a swept out path about the axis 10. The lower portion 121 may provide an interface or juncture with which various portions of the cover 100 may connect. In some embodiments, the lower portion 121 may merely be the end of various intersecting or interconnecting portions of the cover 100. The lower portion 121 may have a variety of different shapes of cross-sections that are extruded in a generally arcuate manner about the axis 10. Theses shapes may be square, rectangular, circular, rounded, polygonal, other shapes, or combinations thereof.

The lower portion 121 may be located approximately a perpendicular distance R1 from the axis 10. R1 may be a dimension equal to roughly half of the total width of the lower portion 121. The distance R1 may be a radius of a circular lower portion 121. However, the lower portion 121 may not be circular, and thus in some embodiments the distance R1 may not be a radius. R1 may be measured perpendicularly from the axis 10 to any region of the lower portion 121, including to regions of the lower portion 121 that are relatively closer are farther from the axis 10 than other regions of the lower portion 121. Further, R1 need not be constant as measured at different angular locations of the cover 100. For example, the lower portion 121 may be arcuate but with straight outer edges such that the dome 126 appears square or rectangular as viewed from the top. For such a shape, R1 would vary depending on which angular location the dimension is measured (i.e. which cross-section or side view is used). Thus, R1 may vary with such a configuration as measured at different angular locations. In some embodiments, R1 refers to a maximum or minimum width of the dome 126. For a non-circular dome 126, R1 may be a maximum or minimum width, for example the maximum or minimum perpendicular distance from the axis 10 to respectively a closest portion or farthest-most portion of the dome 126.

Figure 1C:
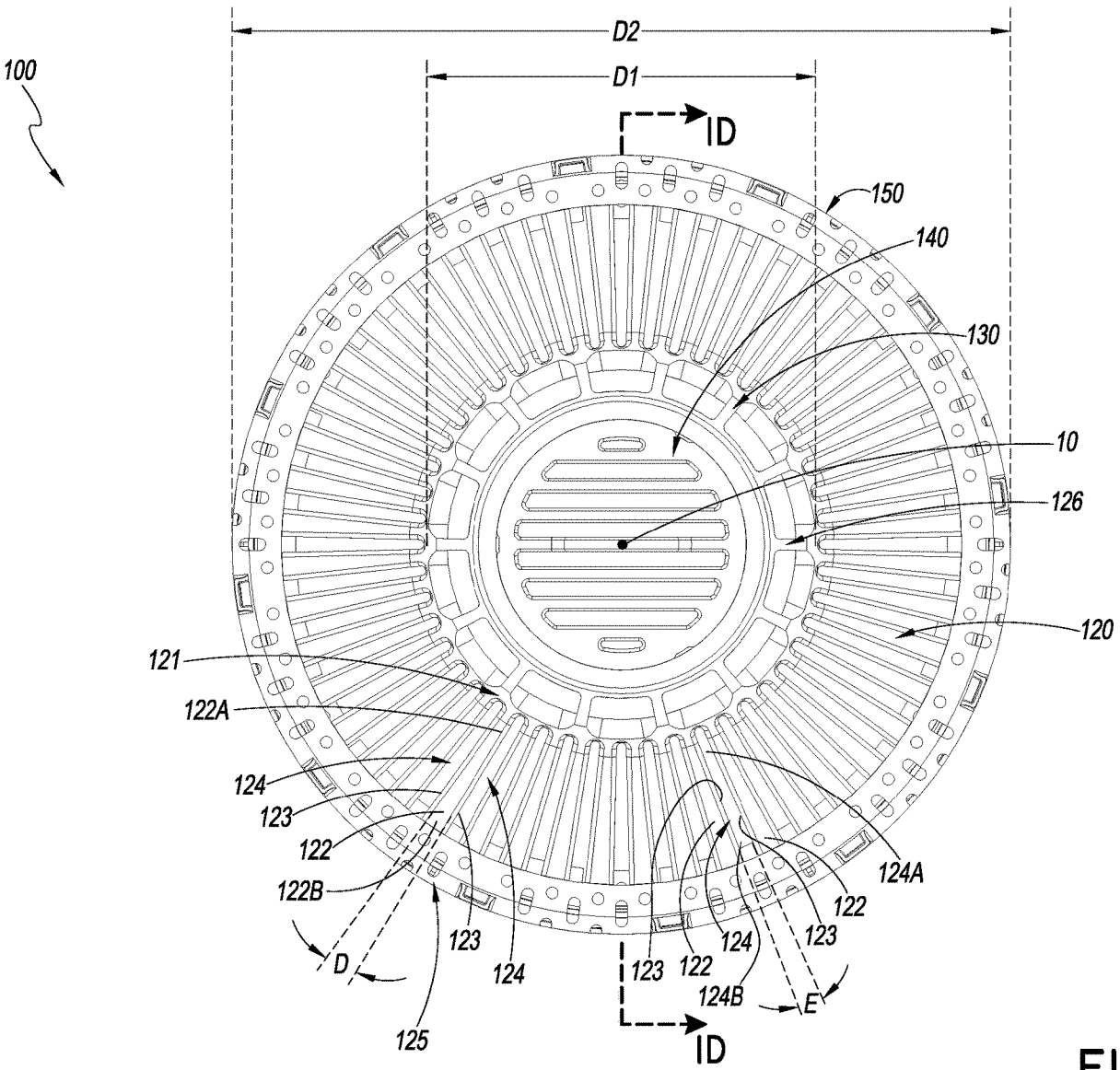
FIG. 1C is a top view of the cover of FIG. 1A.
Figure 1D:
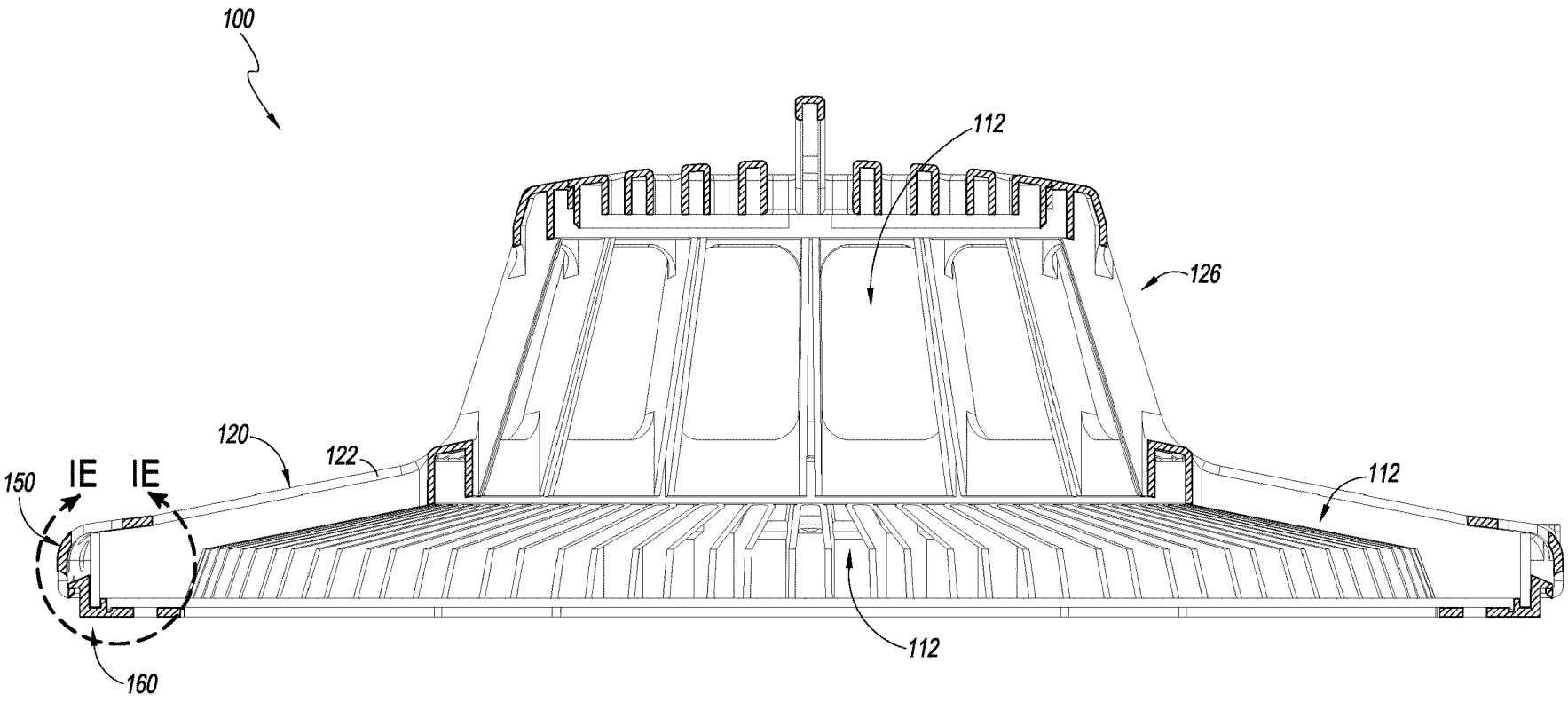
FIG. 1D is a section view of the cover of FIG. 1C as taken along the line 1D-1D as indicated in FIG. 1C.

The skirt 120 may flare outward and downward from the lower portion 121 to an outer edge 129 (see FIG. 1E) and/or outer perimeter 125 in a first direction that is generally away from the central axis 10 and generally away from the dome 126 (see FIGS. 1B, 1D and 1I, for example).

The skirt 120 may include one or more lower ribs 122. The lower ribs 122 may be connected to our otherwise coupled with the lower portion 121. The lower ribs 122 may be elongated members coupled with the lower portion 121 and extending outward therefrom. The lower ribs 122 may couple with the lower portion 121 and extend radially outward therefrom. There may be multiple lower ribs 122. There may be 48 lower ribs 122 (only some are visible in FIG. 1A; see FIG. 1C). In some embodiments, there may be fewer or more lower ribs 122. For example, there may be ten, twenty, thirty, forty, fifty, sixty, seventy, eighty, ninety, one hundred, one hundred fifty, two hundred, five hundred, or other intermediate, lower or greater amounts of lower ribs 122. These are merely some examples and are not meant to be self-limiting. The lower ribs 122 may have a generally U-shaped cross-section. In some embodiments, the lower ribs 122 may have other shaped cross-sections, such as C-section, shallow U- or C-section, rectangular, square, rounded shapes such as circular, elliptical, arcuate, or other shapes, polygonal shapes, segmented shapes, hollow cross-section, solid cross-section, partially hollow and partially solid cross-section, and/or combinations thereof.

The lower ribs 122 may extend from the lower portion 121 to an outer perimeter 125. The outer perimeter 125 may be a portion or portions of the cover body 110, such as the skirt 120, extending along the outside of the cover body 110. The outer perimeter 125 is visible in FIG. 1A through openings in an outer flow ring 150, though it may also include regions of the skirt 120 on the inside of the outer ring 150 as oriented. The outer perimeter 125 may include the outer edge 129 (see FIG. 1H, for example). The outer perimeter 125 may also include portions of the lower ribs 122. The outer perimeter 125 may have a variety of cross-sectional shapes, including any of those described with respect to the lower portion 121. The outer perimeter 125 may be integral with the various lower ribs 122 to which it is connected. In some embodiments, the lower portion 121, the one or more lower ribs 122, and the outer perimeter 125 may all be made from the same monolithic piece of material. In some embodiments, the lower portion 122 includes the one or more lower ribs 122 connected to or otherwise coupled with the lower portion 121 and the outer perimeter 125. The outer perimeter 125 may provide an edge or other end boundary of the skirt 120. Various other features or parts of the cover 100 may be connected to or otherwise coupled with the outer perimeter 125 or other portions of the skirt 120. In some embodiments, an outer flow ring 150 and/or a mount 160 may be coupled with the outer perimeter 125, as described in further detail herein.

The cover 100 may include one or more openings or lower spaces 124. The body 110 may include the one or more lower spaces 124. As shown, the skirt 120 may at least partially define or form the one or more lower spaces 124. The lower spaces 124 may be openings extending through various portions of the cover 100 to allow fluid flow therethrough. As shown, the lower spaces 124 may be openings extending through the skirt 120 to allow fluid flow through the skirt 120. The lower spaces 124 may be defined by various portions of the cover 100. As shown, the lower spaces 124 may be defined by features of the skirt 120, such as the lower ribs 122, the lower portion 121, and/or the outer perimeter 125. For example, the lower spaces 124 may be defined on two sides by two adjacent lower ribs 122, on one end buy a portion of the lower portion 121, and on the opposite end by a portion of the outer perimeter 125. In this manner, the lower spaces 124 may be openings defined or otherwise formed by various physical features of the skirt 120. The lower spaces 124 may be completely open as shown. In some embodiments, the lower spaces 124 may have other features therein, such as screens, filters, or other features that may affect the flow of fluid therethrough. For instance, screens in the lower spaces 124 may facilitate allowing the passage of fluid flow while blocking the passage of larger or solid debris, such as leaves and sticks.

The dome 129 may include an arcuate sidewall 130. The sidewall 130 may be located generally above the skirt 120 as oriented in FIG. 1A. The sidewall 130 may provide features or functionalities that assist with allowing the flow of fluid through the cover 100 while blocking or preventing the passage of solids or other debris therethrough. The sidewall 130 may extend along an arcuate path and thereby define a central vertical axis 10. The sidewall 130 may extend along a circular path. In some embodiments, the sidewall 130 may extend along other arcuate paths that are non-circular and still define the axis 10. The axis 10 may be a geometric center of the arcuate path swept out by the sidewall 130 or by portions thereof, such as by the lower portion 121. Thus, the axis 10 may still be defined by the sidewall 130 even with an arcuate sidewall 130 that is non-circular. The sidewall 130 may define a plurality of openings or upper spaces 134 extending through the sidewall 130 configured to allow fluid flow therethrough. The upper spaces 134 may be generally rectangular in shape, or other shapes, such as square, polygonal, rounded shapes, segmented, or combinations thereof.

The sidewall 130 may include one or more upper ribs 132. As shown, the upper ribs 132 may be elongated members extending along the sidewall 130. The upper ribs 132 may be elongated with a generally rectangular or square cross-section. However, the upper ribs 132 may have a variety of other shaped cross-sections, such as those described with respect to the lower ribs 122, or other shapes. The upper ribs 132 may be oriented in an arcuate manner generally about the central vertical axis 10. In some embodiments, the upper ribs 132 are arranged in a circular shape about the axis 10. However, other arrangements of the upper ribs 132, such as elliptical, oval, or other shapes, may be implemented.

The sidewall 130 may be include a lower portion 121. In some embodiments, the sidewall 130 may be formed from the same monolithic piece of material as the lower portion 121. In some embodiments, the sidewall 130 and the skirt 120 are formed from the same monolithic piece of material. However, the sidewall 130 may also be coupled with the lower portion 121 and/or the skirt 120 in a variety of ways, such as with mechanical attachments, adhering, fastening, bonding, or other suitable means.

The sidewall 130 may include any number of the upper ribs 132. There may be fourteen of the upper ribs 132 (only some are visible in FIG. 1A; see FIG. 1C). In some embodiments, there may be more or fewer upper ribs 132. For example, there may be 4, 5, 6, 7, 8, 9, 10, 15, 20, 30, 50, or any other number of intermediate or greater number of upper ribs 132.

The upper ribs 132 may be connected on one end to the lower portion 121 and on the opposite end to various other features of the cover 100. As shown, one end of the upper ribs 132 may be connected or otherwise coupled with an upper perimeter 133. The upper perimeter 133 may be a portion or segment of the sidewall 130 that extends in an arcuate manner about the central axis 10. The upper ribs 132 may be coupled with the upper perimeter 133 in a variety of manners. As shown, the upper perimeter 133 and the upper ribs 132 may be formed from the same monolithic piece of material. In some embodiments, the upper perimeter 133 may be a separate part that is subsequently attached to or otherwise coupled with the upper ribs 132 in a variety of suitable means, such as bonding, fastening, adhering, other mechanical means, other suitable means, or combinations thereof.

As mentioned, the cover 100 may include one or more upper spaces 134. that provide openings through the cover 100 through which fluid may flow. As shown, the upper spaces 134 may be formed by various features of the body 110. The upper spaces 134 may be formed by various features of the sidewall 130. For instance, as shown the upper ribs 132 may partially form the upper spaces 134 on two or more sides of the upper spaces 134. The upper spaces 134 may also be defined on one or more sides by the upper perimeter 133. As shown, the upper perimeter 133 or a portion thereof may form an upper side of the upper spaces 134 as oriented, and/or the opposite side of the upper spaces 134 may be defined by a portion of the lower portion 121. Therefore, the upper spaces 134 may be defined by various surfaces of adjacent upper ribs 132, adjacent portions of the upper perimeter 133, and adjacent portions of the lower portion 121. As shown, the upper spaces 134 may have a generally rectangular shape. The upper spaces 134 may therefore have the appearance of a window. However, the upper spaces 134 may have a variety of shapes, such as square, rounded, segmented, other shapes, and/or combinations thereof. In some embodiments, the upper space is 134 may have the same or similar shapes as the lower spaces 124. Further, the upper spaces 134 may be entirely open with no physical objects therein. However, the upper spaces 134 may also be partially or entirely filled with a screen, filter, or the like to allow the flow of fluid therethrough while blocking the passage of debris such as solids. The upper spaces 134 may contribute to the effectiveness of the cover 100 by receiving fluid that might flow over the skirt 120 and/or over any debris or other blockages built up on the skirt 120. The upper spaces 134 may also be sized to receive some of the debris such the debris will either catch on the upper space 134 and not fall onto the drain or block the skirt 120, or the debris may fall through the upper space 134 and be received into the cavity 112 of the cover 100.

The cover 100 may include a cavity 112. The cavity 112 may be a space or spaces formed by various features of the cover 100. As shown, the body 110 may form the cavity 112 therein. For instance, the sidewall 130 may surround and define or form the cavity 112 therein. The cavity 112 may also be formed and or defined by other features of the cover 100. For example, the skirt 120 may also define a portion or portions of the cavity 112. In some embodiments, the cavity 112 may be a space with a volumetric shape that complements the underside of the body 110 of the cover 100. The cavity 112 may be a space defined or formed by the body 110 or other features of the cover 100 that facilitates the flow of fluid therethrough. For example, the cavity 112 may be a space in between various features of the cover 100 and the drain over which the cover 100 is positioned. The cavity 112 may be in fluid communication with the various spaces of the cover, such as the lower spaces 124 of the skirt 120 and/or the upper spaces 134 of the sidewall 130. Fluid may flow through these or other spaces and into the cavity 112 and then into the drain.

The dome 126 may include a top 140. The top 140 may be an uppermost portion or portions of the dome 126 as oriented in FIG. 1A. The top 140 may provide an uppermost structure to the cover 100. As shown, the top 140 may be a portion or portions of the body 110. The top 140 and the various features thereof may be formed from the same or similar materials as the other portions of the cover 100. For example, the top 140 may be formed from the same materials as the sidewall 130 and/or the skirt 120. In some embodiments, the top 140 is formed from the same monolithic piece of material as the sidewall 130 and/or as the skirt 120. As shown, the top 140 may include portions that are formed from the same monolithic piece of material as the sidewall 130 and the skirt 120, and the top 140 may include other portions that are separate therefrom. Therefore, a variety of configurations of the top 140 may be implemented.

The top 140 may also include the upper perimeter 133 or portions thereof. Therefore, the upper perimeter 133 may form a portion of the sidewall 130 as well as a portion of the top 140. Thus, the top 140 may have a generally arcuate shape such as those described above with respect to the sidewall 130 and the upper perimeter 133. In some embodiments, the upper perimeter 133 may extend entirely across the top 140 such that the top 140 forms a surface, which may be curved, flat or other shapes. As shown and described below, the top 140 may have other features and or separable components.

As shown, the top 140 may include a lid 141. The lid 141 may be a portion or portions of the top 140. The lid 141 may be generally centrally-located or it may be in other locations of the top 140. As shown, the lid 141 may have a generally arcuate shape, such as circular or other shape, that is complementary to the arcuate shape of the upper perimeter 133. The lid 141 may be removable. Removal of the lid 141 or other features from the cover 100 may facilitate with observing and/or accessing the cavity 112 and/or the drain thereunder. For instance, a user may remove the lid 141 in order to observe the drain and/or internal features of the cover 100. Also the ability to remove the lid 141 allows an anti-vortex plate or other devices to be installed. In some embodiments, the lid 141 may be a generally circular part of the upper portion of the top 140 which is removable therefrom. For example, the lid 141 may interface with the upper perimeter 133 at a generally circular boundary. The lid 141 may also interface with the upper perimeter 133 or other portions of the cover 100 in a variety of other manners, including with other suitable shapes and configurations of this and/or other interfaces.

The cover 100 may include one or more top ribs 142. The top ribs 142 may be generally elongated members located at or near the top 140. The top ribs 142 may have a variety of cross-sectional shapes, such as rectangular, or any of those described herein, for example with respect to the upper ribs 132 and/or the lower ribs 122. As shown, the top ribs 142 may be oriented generally parallel to each other. However, a variety of other arrangements may be implemented with the top ribs 142. As further shown, the top ribs 142 may have a variety of lengths. Some of the top ribs 142 may be longer or shorter than other top ribs 142. As shown, the top ribs 142 generally near the center of the top 140 may be longer than those top ribs 142 located generally farther from the center. As shown, there may be six top ribs 142. In some embodiments, there may be more or fewer top ribs, for example, none, one, two, three, four, five, seven, eight, nine, ten, fifteen, twenty, twenty-five, fifty, one hundred, or intermediate or greater numbers of top ribs 142. The top ribs 142 may be connected on one end to a first portion of the upper perimeter 133 and on the opposite end to an opposing portion of the upper perimeter 133. As shown, the top ribs 142 may be connected on one end to one portion of the lid 141 and on the opposite end to an opposing portion of the lid 141.

The cover 100 may include one or more top spaces 144. The top spaces 144 may be openings through the top 140 of the cover 100 that allow the passage of fluid therethrough. The top spaces 144 may prevent the passage of large solids therethrough such as large pieces of debris, large sticks, and the like. The top spaces 144 may be large enough to allow some debris to pass therethrough in order to prevent a large buildup on the skirt 120. As shown, the top spaces 144 may be formed by various features of the body 110, such as the top 140. For example, the top spaces 144 may be formed by one or more top ribs 142 and/or by one or more surfaces of the lid 141. In some embodiments, the top spaces 144 may be formed by one or more top ribs 142 and various surfaces of the upper perimeter 133. These are just some examples and the top spaces 144 may be defined in other ways, such as by combinations of the top ribs 142, the lid 141, and/or the upper perimeter 133. In some embodiments, some or all of the top spaces 144 may be defined on two opposing sides by two adjacent top ribs 142. In some embodiments, the ends of the top spaces 144 may be defined by two opposing sides or portions of the lid 141 or of the upper perimeter 133. Some of the top spaces 144 may be defined on one side by the top rib 142 and on the opposite side by a portion of the lid 141. In some embodiments, some of the top spaces 144 may be defined in part by a top rib 142 on one side and on the opposite side by a portion of the upper perimeter 133. The top spaces 144 may be entirely open therethrough, as shown. In some embodiments, the top spaces 144 may include screens or filters therein to facilitate with allowing the passage of fluid therethrough while preventing or blocking the passage of solids and the like, similar to the upper spaces 134 and/or the lower spaces 124 described herein.

The cover 100 may include a handle 146. As shown, the handle 146 may be a feature of the body 110. For example, the handle 146 may be a feature of the top 140. The handle 146 may provide a structure by which a user can pick up or otherwise handle the cover 100. In some embodiments, the handle 146 may allow a user to remove the lid 141 from the cover 100. For example, a user may grab the handle 146 to remove the lid 141 from the top 140. The handle 146 may also be used to put the lid 141 or other portions of the cover 100 back onto the cover 100.

The handle 146 may have a variety of shapes and sizes. As shown, the handle 146 may be an arc that extends away from the top 140. The handle 146 may be an arcuate shape extending upward as oriented from one or more of the top ribs 142. In some embodiments, the handle 146 may be a top rib 142 with a different contour than the other top ribs 142. As shown, the handle 146 may be partially flat on the ends with a middle portion that extends upward and in a generally arcuate shape. However, the handle 146 may extend upward in a variety of shapes and contours, such as square, rectangular, segmented, other polygons, other shapes, or combinations thereof. Therefore, the configuration shown and described is merely one possible implementation and other suitable configurations may be implemented.

The cover 100 may include an outer ring 150. The outer ring 150 may be a structure or structures configured to couple with the cover body 110 generally along the outer perimeter 125. The outer ring 150 may be arcuate in shape. The outer ring 150 may be a separable part of the cover 100 which may be removed therefrom and reattached thereto. The outer ring 150 may be arcuate when attached to the cover and either arcuate or other shapes, such as straight, when removed from the cover 100. When coupled with the cover 100, the outer ring 150 may be located a perpendicular distance R2 from the axis 10. When coupled with the cover 100, the outer ring 150 may have an outer surface that is located a perpendicular distance R2 from the axis 10. R2 may be a dimension equal to roughly half of the overall width of the outer ring 150. The distance R2 may be a radius of a circular outer ring 150. However, the outer ring 150 may not be circular, and thus in some embodiments the distance R2 may not be a radius. Further, R2 need not be constant as measured at different angular locations of the cover 100. For example, the outer ring 150 or other parts such as the skirt 120 may be arcuate but with straight outer edges such that the ring 150 or skirt 120 appears square or rectangular as viewed from the top. For such a shape, R2 would vary depending at which angular location the dimension is measured (i.e. which cross-section or side view is used to make the measurement). Thus, R2 may vary with such a configuration as measured at different angular locations. In some embodiments, R2 refers to a maximum or minimum width of the outer ring 126, or other outer portion of the skirt 1220. For a non-circular dome 126, R1 may be a maximum or minimum width, for example the maximum or minimum perpendicular distance from the axis 10 to respectively a farthest-most or closest portion of the outer ring 126, or other outer portion of the skirt 1220.

The outer ring 150 may be an elastic or otherwise flexible material. The outer ring 150 may expand to attach to various features of the cover 100 such as the outer perimeter 125 or other features. The outer ring may couple the ring body 110 with a mount 160, as described herein. The outer ring 150 may provide structural stability to various features of the cover 100 such as the outer perimeter 125. The outer ring 150 may include features that facilitate the flow of fluid through the cover 100 while preventing the flow of solids therethrough. In some embodiments, the outer ring 150 may include features that facilitate installation and securement of the cover 100.

The outer ring 150 may include a ring body 152. The ring body 152 may be a generally arcuate structure configured to couple with the cover 100, such as with the outer perimeter 125 of the skirt 120. In some embodiments, the ring body 152 may couple with the outer edge 129 of the skirt 120. The ring body 152 may at least partially cover the outer edge 129 and/or the outer perimeter 125 when coupled with the skirt 120. The ring body 152 may have a generally U- or C-shaped cross-section that extends in an arcuate manner and is swept out angularly about the central axis 110 (see FIG. 1E, for example). The ring body 152 may expand to couple around the skirt 120 of the cover 100. The ring body 152 may contract to compress around and thereby secure to the skirt 120 or other features of the cover 100. The outer ring 150 may also couple with a mount 160. In some embodiments, the outer ring 150 may couple the ring body 110 with the mount 160.

The outer ring 150 may include a variety of slots 153, holes 154, and/or openings 155. The ring body 150 may form or define these and other features. For example, various surfaces of the ring body may define inner surfaces of the slots 153, the holes 154, and/or the openings 155. As shown, the slots 153 may be elongated spaces within the ring body 152 and extending therethrough. The holes 154 may be generally circular spaces extending through the ring body 152. The openings 155 may be partially circular and partially linear spaces extending through the ring body 152. As shown, the slots 153 may be located along top and outer portions of the ring body 152 as oriented in the figure and in a generally arcuate configuration about the central axis 10. The holes 154 may be located more inwardly on the ring body 152 as oriented in the figure and in a generally arcuate configuration about the axis 10. The openings 155 may be located more outwardly on the ring body 152 as oriented in the figure and in a generally arcuate configuration about the axis 10. These arrangements and configurations of the slot slots 153, the holes 154 and the openings 155 are merely some examples, and a variety of configurations and arrangements of the various spaces may be incremented.

The slots 153, the holes 154, and/or the openings 155 may provide spaces through the ring body 152 that allow the passage of fluid therethrough while preventing the flow of solids therethrough. These spaces of the outer ring 150 may therefore improve the performance of the cover 100 through advantageous sizing and/or locating of the various spaces of the outer ring 150. The slots 153, the holes 154, and the openings 155 may be in fluid communication with the cavity 112. For instance, these spaces may be in fluid communication with the lower spaces 124 which may in turn be in fluid communication with the cavity 112. Thus, the cover 100 may allow for fluid flow through the outer ring 150 while preventing or reducing the flow of gravel or other debris through the outer ring 150.

The outer ring 150 may include one or more pockets 157. The pockets 157 may be located generally along the outer surface or services of the ring body 152 and an arcuate configuration about the axis 10. The pockets 157 may extend generally upward and form a recess therein. The pockets 157 may assist with handling the outer ring 150. In some embodiments, the pockets 157 may assist with assembling and/or disassembling the outer ring 150 with the ring body 110 and/or the mount 160. The pocket 157 may provide a surface for a user or tool to grasp or to pry the outer ring 150 into or out of place on the cover 100.

The outer ring 150 may not have any sharp edges. The edges of the various features of the outer ring 150 may therefore be rounded or otherwise smoothed. This may mitigate the chances of debris getting caught on the outer ring 150. The outer ring 150 may further by relatively shallow or short to mitigate the chances of debris getting caught thereon.

The cover 100 may include a mount 160. The mount 160 is partially visible in FIG. 1A. The mount 160 may secure the cover 100 to a mounting structure, such as a roof or floor. The mount 160 may have a generally arcuate shape. The mount 160 may have an arcuate or other shape before being assembled with other components of the cover 100. The mount 160 may provide a structure to and from which the ring body 110 may be easily coupled and removed. For instance, the mount 160 may provide a feature or features to which the body 110 or other features of the cover 100 may be snapped. Therefore, the body 110 may be snapped into place with the mount 160 to easily secure the cover 100 in place. Similarly, the body 110 may be snapped off of the mount 160 to remove the body 110 therefrom. The mount 160 may have a lower side that attaches to a mounting structure, such as a roof, sidewalk, or other features surrounding a drain intended to be covered with by the cover 100. The opposite side of the mount 160 may include these various features to which the body 110 may be coupled. Further detail of the mount 160 is described herein. In some arrangements, the mount 160 can be secured to the mounting structure by screws, nails, adhesives and/or other fastening devices or methods. Thus, in some embodiments of use, the mount 160 can be coupled to a mounting structure surrounding a drain. The cover 100 can be coupled to the mount 160 so that the cover 100 can cover the drain. The cover 100 may attach to the mount by friction fit, for instance by snapping projections of the cover into corresponding receiving structures of the mount as described herein. As described herein, this arrangement can allow fluids to flow through the cover 100 and into the drain even in the presence of buildup of solids or other foreign debris along and/or on the outside of the cover while also reducing the amount of debris buildup around the drain and cover 100.

FIG. 1B is a side view of the cover 100. As shown, the central vertical axis 10 may extend through the center of the cover 100 as oriented. Other geometric features may assist with describing the cover 100. As shown, there may be a horizontal plane 15. The horizontal plane 15 may be a geometric reference plane that is generally perpendicular to the axis 10. The horizontal plane 15 may be generally defined by one or more features of the cover 100. As shown, the horizontal plane may be generally formed by a lower surface or surfaces of the mount 160. In some embodiments, the horizontal plane 115 may be formed or otherwise defined by various lower services of the outer ring 150 as oriented. In some embodiments, the horizontal plane 15 may be defined by various features of the skirt 120, such as the outer perimeter 125. It is understood that the precise vertical location of the horizontal plane 15 along the axis 10 may be located in a variety of locations of the cover 100. Further, the various feature or features of the cover 100 that may define the horizontal plane 15 need not all be in a precise exact plane, rather the various features may be generally within the plane 15. Further, it is understood that the various features defining the horizontal plane 15 may do so when the cover 100 is in an unrestrained state. The various features defining the plane 15 may be contorted or otherwise manipulated or bent when the cover 100 is attached to a mounting structure. When the cover 100 is attached to a mounting structure the various features defining the plane 15 may no longer be planar. For instance, the cover 100 may be attached to a curved mounting structure in which the mount 160 or other features of the cover 100 may not reside in an exact plane in the attached configuration. Thus, it is understood that the plane 15 is defined with respect to the cover 100 in an unrestrained state before the cover 100 is secured to a mounting structure.

As shown in FIG. 1B, the skirt 120 may be angled with respect to the axis 10 and/or the horizontal plane 15. As shown, portions of the skirt 120, such as the lower ribs 122, when viewed from the side may be oriented at an acute angle A with respect to the axis 10. "Acute" is used in its usual and customary sense as indicating an angle that is less than 90°. The skirt 120 may extend about the axis 10 in a generally arcuate configuration, as mentioned. Therefore, the skit 120 may provide a number of surfaces which are oriented at the angle A with respect to the axis 10 that also extend about the axis 10 in a generally arcuate configuration. The skirt 120 may skirt flare outward and downward from the lower portion 121 to the outer edge 129 of the skirt in a first direction that is generally away from the central axis 10 and generally away from the dome 26, wherein the first direction forms the acute angle A with the axis 10. As further shown, the angle A may be acute when measured from a portion of the axis 10 that is under or below the cover 100, as oriented in FIG. 1B. The angle A may be acute when measured from a portion of the axis 10 that is under or below the horizontal plane 15, as oriented in FIG. 1B.

The angle A may be sized in order to optimize or otherwise facilitate the flow of fluid through the cover 100 while preventing the buildup of solids or other debris from blocking the flow of fluid through the cover 100. For example, the angle A may be relatively large such that a buildup of solids or other debris on or near the skirt 120 will still allow for the flow of fluid through the skirt 120. For instance, leaves and sticks or other debris may build up onto the skirt 120. By having a relatively large angle A, the buildup of debris on the skirt 120 will still allow the flow of fluid through the cover 100 due to gravity causing the fluid to drip through the buildup of debris and through the lower spaces 124 of the skirt 120. Therefore, the angle A may be sized such that such a buildup may be produced on top of or otherwise near the skirt 120 in order to allow the downward flow and/or dripping of fluid through the buildup and subsequently through the skirt 120, into the cavity 112 therein, and ultimately into the drain.

In some embodiments, the angle A is greater than or equal to 60°. However, the angle A may have a variety of sizes. In some embodiments, the angle A may be greater than or equal to 65°, greater than or equal to 70°, greater than or equal to 75°, greater than or equal to 80°, greater than or equal to 85°, or other smaller, intermediate or larger angular amounts. These are just some examples and are not limiting of the scope of this disclosure. For instance, in some contexts a larger angle A may be implemented that still produces the advantageous effects. For example, depending on the contour of the mounting structure to which the cover 100 is mounted or otherwise secured, the angle A may need to be less than 60°. In some embodiments, the angle A may therefore be less than 60°, such as 55°, 50°, 45° or other angular amounts.

While the angle A may be generally constant for the entirety of the skirt 120 about the axis 10, the angle A need not be constant. For example, the angle A may have one value at one angular location of the skirt 120 about the axis 10, and a different value at a different angular location of the skirt 120 about the axis 10. Therefore, a variety of configurations and arrangements of the skirt 120 related to the angle A may be implemented.

It is understood that the orientation of the skirt 120, such as the orientation of the lower ribs 122, may be described with respect to other geometric references or features of the cover 100. For instance, the orientation of the skirt 120 may be described with respect to the axis 10 or plane 15, or with respect to the mount 160, the sidewall 130, the top 140, and/or other features or references. The particular references and features used to describe the orientation of the skirt 120 or parts thereof are merely for convenience and are not meant to limit the scope of the disclosure.

Further shown in FIG. 1B is the sidewall 130. As shown, the upper ribs 132 of the sidewall 130 may extend in a generally vertical direction when viewed from the side. The upper ribs 132 are shown oriented at an acute angle B with respect to the axis 10. The angle B may be acute when measured from a portion of the axis 10 that is over or above the cover 100, as oriented in FIG. 1B. The angle B may be acute when measured from a portion of the axis 10 that is over or above the horizontal plane 15, as oriented in FIG. 1B. Other features of the sidewall 130 may also be oriented at the angle B. The angle B may be chosen so as to optimize or otherwise facilitate the flow of fluid through the cover 100 while preventing the flow of solids or other debris therethrough. In some embodiments, the angle B may be 0° such that the upper ribs 132 or other features of the sidewall 130 are vertical, or parallel to the axis 10, or perpendicular to the horizontal plane 15. In some embodiments, the angle be may be 5°, 10°, 15°, 20°, 25°, 30°, or other intermediate, lower or greater angular amounts. In some embodiments, the angle B may be equal to the angle A. In some embodiments, the angle B may not be equal to the angle A. The angle B may be greater or less than the angle A.

The sidewall 130 may include the upper ribs 132 having sides 133. The sides 133 may be opposing sides or surfaces of the upper ribs 132. The sides 133 may partially define upper spaces 134 on either side of an upper rib 132. The distance between the sides 133 of the upper ribs 132 may define a width of the upper ribs 132. Further, the two sides 133 of the upper ribs 132 may be oriented in a variety of manners with respect to each other. In some embodiments, the sides 133 may be parallel to each other such that the upper rib 132 has a uniform width along the length of the upper rib 132.

In some embodiments, the two sides 133 of the upper rib 132 may not be parallel to each other such that the upper rib 132 does not have a uniform width along the length of the upper rib 132. As shown, the two sides 133 of a single upper rib 133 may be oriented at an acute angle C with respect to each other. The angle C may be sized so as to optimize or otherwise facilitate the flow of fluid through the cover 100. For example, the size of the angle C may be sized to optimize or otherwise facilitate the flow of fluid through the upper spaces 134 or other features of the sidewall 130. In some embodiments, the angle C may be 1°, 2°, 3°, 4°, 5°, 10°, 15°, 20°, or other intermediate, smaller or greater angular amounts.

Because the upper ribs 132 may define one or more surfaces of the upper spaces 134, the angle at which the sides 133 are oriented may affect the shape of the upper spaces 134. Therefore, the various surfaces defining the upper spaces 134 may have a variety of configurations and/or orientations. In some embodiments, the upper spaces 134 may be generally rectangular, as mentioned. In some embodiments, the upper spaces 134 may be trapezoidal, or other shapes. Further, the upper ribs 132 as mentioned may be coupled on one end with the lower portion 121 and on the opposite end with the upper perimeter 133. The upper ribs 132 may be wider on the end coupled with the lower portion 121 as compared with the end of the upper rib 132 coupled with the upper perimeter 133, or vice versa. Therefore, it is understood that the angle C may refer to either a thinning or widening upper rib 132 in the direction from the lower portion 121 to the upper perimeter 133

Further visible in FIG. 1B is a portion of the top 140. As shown, the top ribs 142 may project slightly upward as oriented. The top ribs 142 may therefore have a slightly arcuate contour along the length of the top ribs 142. Therefore, the top spaces 144 that may be defined by the top ribs 142 may have a complementary or corresponding shape.

Further shown in FIG. 1B is the mount 160. As shown, the mount 160 may have a mount body 162. The mount body 162 may be a generally arcuate structure configured to couple with a mounting structure on one side and on the opposite side to various features of the body 110 of the cover 100. The mount body 162 may have a lower side that defines the horizontal plane 15. Further detail of the mount 160 is described herein, for example with respect to FIG. 2.

The overall height of the cover 300 as oriented in the figure may be about 4-5". The cover 300 may have other heights as well, such as 1", 2", 3", 6", 7", 8", 9", 10", 15" or other smaller, intermediate or greater heights. The overall width of the cover 300 as oriented in the figure may be from about 5" to about 13". The cover 300 may have other overall widths as well, such as 1", 2", 3", 4", 6", 7", 8", 9", 10", 11", 12", 14", 15", 20", 25", 30" 50", or other smaller, intermediate or greater widths. These values for the overall width dimensions may apply to the dimension D2 shown in FIG. 1C and discussed in further detail herein. Further, the dimension R2 may have values that are half or about half of these values for the overall width values.

FIG. 1C is a top view of the cover 100. As shown, the cover 100 may have a generally arcuate shape, which may be circular. As shown, the cover 100 may have a generally circular shape when viewed from the top that is generally symmetric with respect to the axis 10. The axis 10 appears as a point in the figure because it is being viewed in a plane that is perpendicular to the axis 10. The cover 100 may have other arcuate shapes with respect to the axis 10, such as elliptical, oval, circumferential, other rounded shapes, or combinations thereof.

The skirt 120 may similarly have a generally arcuate shape about the axis 10. The skirt 120 may provide an extended area that is greater than the area of just the drain, over which the cover 100 may be positioned. By "extended area" in this context, it is meant the two dimensional surface area that the skirt 120 "sweeps" out. Thus, the "extended area" is not limited to only the surface area of the top surfaces of the skirt 120, such as the top surfaces of the ribs 122. It also includes the area of the skirt 120 over any openings in the skirt 120, such as the spaces defined or formed by the ribs 122 or by other features of the skirt 120. This extended area may be approximately equal to the area of the skirt 120 as viewed from the top view as shown in FIG. 1C, but the actual area will be higher because the skirt 120 may be angled.

In some embodiments, the skirt 120 may provide an extended area that is greater than the area of the drain. The "area of the drain" here may refer to the overall general area covered by the draining region of the drain, which includes but is not limited to any openings in the drain. For example, the area of the drain may be based on the width W of the drain, discussed herein with respect to FIG. 9A. In some embodiments, the skirt 120 may provide an extended area that is two, three, four, five, six, seven, eight, nine, or ten times as large as the area of the drain, or any smaller, intermediate or larger values. Tables 1 and 2 below show some examples of the relative size of the widths R1 and R2 as expressed by the ratio of R2/R1 that may be implemented and the approximate corresponding increase in area, or the Area Factor "AF." The designs shown are approximations as to the corresponding AF because the width of the drain is assumed to be similar to R1, i.e. that the drain is circular and has a diameter equal to twice the value of R1. Table 1 shows the resulting AF for a particular ratio of R2/R1. Table 2 shows the resulting ratio R2/R1 for a particular AF. Either quantity R2/R1 or AF may be chosen as a design goal and then the corresponding quantity calculated. Further, these are just some examples and are not meant to be self-limiting. Other values that may be used may be smaller, larger or in between the values shown in Tables 1 and 2.

TABLE 1

| Area Factor For a Given Ratio R2/R1 | | | | | | | | | | |
|---|---|---|---|---|---|---|---|---|---|---|
| | $R_2/R_1$ | | | | | | | | | |
| | 1.50 | 1.75 | 2.00 | 2.25 | 2.50 | 2.60 | 2.75 | 2.80 | 2.90 | 3.00 |
| AF | 1.3 | 2.1 | 3.0 | 4.1 | 5.3 | 5.8 | 6.6 | 6.8 | 7.4 | 8.0 |

TABLE 2

| Ratio R2/R1 for a Given Area Factor | | | | | | | | | | |
|---|---|---|---|---|---|---|---|---|---|---|
| | AF | | | | | | | | | |
| | 1.5 | 2.0 | 3.0 | 4.0 | 5.0 | 6.0 | 7.0 | 8.0 | 9.0 | 10.0 |
| $R_2/R_1$ | 1.58 | 1.73 | 2.00 | 2.24 | 2.45 | 2.65 | 2.83 | 3.00 | 3.16 | 3.32 |

R2 and R1 may also be expressed relative to each other. R2 may be expressed relative to a multiple of R1. Thus, for example, R2 may be at least twice R1, i.e. R2 may be greater than or equal to 2×R1. In some embodiments, R2 may be greater than or equal to 2.25×R1, R2 may be greater than or equal to 2.5×R1, R2 may be greater than or equal to 2.75×R1, R2 may be greater than or equal to 3×R1, R2 may be greater than or equal to 3.5×R1, R2 may be greater than or equal to 4×R1, etc. R2 may further be capped at a maximum amount. Thus R2 may be greater than or equal to 2×R1 but less than or equal to 3×R1. In some embodiments, R2 may be greater than or equal to 2×R1 but be less than or equal to 2.25×R1, less than or equal to 2.5×R1, less than or equal to 2.75×R1, less than or equal to 3.5×R1, less than or equal to 4×R1, less than or equal to 5×R1, etc. In some embodiments, R2 may be greater than or equal to 3×R1 but be less than or equal 3.5×R1, less than or equal to 4×R1, less than or equal to 5×R1, etc. These are merely some examples and the min or max value of R1 may be lower, intermediate, or greater multiples of R2 besides those explicitly given herein and some examples can also include the various ranges and sub-ranges between the various minimum and maximum values of R2 described above.

The increased area relative to the drain provided by the skirt 120 may increase the chances of draining surrounding fluids through the drain. This may be due in part because a shallow-sloped skirt 120 may allow debris to flow over and past the skirt 120, and further a larger area (as compared with the drain area) will now need to be covered or clogged. Therefore, not only may the orientation of the skirt 120 contribute to the effectiveness of the cover 100, but the overall area of the skirt 120 may contribute as well.

Some embodiments disclosed herein include a method of coupling a cover for a drain to a mounting surface, the method comprising: coupling the cover 100 to the mounting surface such that the cover at least partially surrounds the drain. In some embodiments, the cover 100 is coupled to the mounting surface via a mount 160 as described herein. In some arrangements, the drain has a half-width of R1 and wherein the cover 100 includes an arcuate dome defining a central axis and an arcuate skirt coupled with the dome and having an outer edge, wherein the skirt flares outward and downward from the dome to the outer edge in a first direction that is generally away from the central axis and generally away from the dome, wherein the first direction forms an acute angle A with a portion of the central axis that extends below the skirt, wherein the skirt forms a plurality of openings extending through the skirt, and wherein the outer edge of the skirt is located a perpendicular distance R2 from the axis, and wherein R2 is at least twice R1. In modified embodiments, R2 can be within the values and ranges described herein.

As shown, the lower ribs 122 may be oriented such that they extend radially with respect to the central axis 10. The lower ribs 122 and/or other features of the skirt 120 may be described as sweeping out an angle of 360° about the axis 10. Therefore, the skirt 120 may be described as sweeping out an angle of 360° about the axis 10. Similarly, the sidewall 130, the top 140, and or the outer ring 150 may be described as sweeping out an angle of 360° about the axis 10. By sweeping out an angle of 360° it is meant that the closed shape such as a circle or other rounded shape is formed about or generally about the axis 10. In some contexts, a cover 100 having a full 360° swept shape may be used over a drain on a mounting structure that has no interfering structures nearby, such as on an open part of the roof away from any walls of a building. However, in other contexts a drain may be located next to an interfering structure such as a wall, for example at the intersection of a roof and a wall on the roof. In these or other instances, less than 360° of swept out shape of the cover 100 may be implemented, as described in further detail herein for example with respect to FIGS. 4-6.

As shown in FIG. 1C, the lower ribs 122 may have one or more sides 123. The sides one 123 may be a surface or surfaces of the lower ribs 122. As shown, two sides 123 of a single lower rib 122 may be located on opposite sides of that single lower rib 122. The sides 123 of the lower ribs 122 may partially define the lower spaces 124 that are adjacent to the lower rib 122. As shown, the sides 123 may be generally straight. However, the sides 123 may be rounded, segmented, partially rounded and impartially straight, other shapes, or combinations thereof.

The lower ribs 122 may include a first end 122A. The first end 122A may couple the rib 122 with the lower portion 121. The lower ribs 122 may also include a second end 122B. The second end 122B may be located on an end of the lower rib 122 that is opposite from the first end 122A. The second end 122B of the lower ribs 122 may couple the lower ribs 122 with the outer perimeter 123 (only partially visible in FIG. 1C). The first end 122A and the second end 122B may each have a width defined in part by the distance between the sides 123 at the respective ends of the lower rib 122. The width of the lower rib 122 at the first end 122A may be less than the width of the lower rib 122 at the second end 122B. In some embodiments, these two widths may be the same or approximately the same. In some embodiments, the first end 122A may have a width that is greater than the width of the second end 122B of the lower rib 122.

As shown, the sides 123 of the rib 122 may be oriented with respect to each other at an acute angle D. The angle D may be sized so as to optimize or otherwise facilitate the flow of fluid through the skirt 120 and to prevent the flow of solids therethrough. The angle D may be chosen such that the lower spaces 124 defined by the skirt 120 are optimized in this manner. As shown, the first end 122A may be relatively thinner or less wide than the second end 122B of the lower rib 122, such that the angle D between the sides 123 is measured as shown in FIG. 1C. However, the first end 122A may be relatively wider than the second end 122B of the lower rib 122 such that the angle D may be oriented differently. In either configuration, the descriptions for the angle D may apply equally. In some embodiments, the angle D may be 1°, 2°, 3°, 4°, 5°, 10°, 15°, 20°, or any other intermediate, lower or higher angular amount. Further, the angle D may be the same for all of the lower ribs 122 of the cover 100, as shown. However, in some embodiments, the angle D may be different for different lower ribs 122 of the same cover 100.

Further shown in FIG. 1C are the lower spaces 124. The lower spaces 124 may have a variety of shapes and configurations. The lower space 124 may include a first end 124A and an opposite second end 124B. The first end 124A may be located adjacent to or otherwise near the lower portion 121. The second end 124B may be located adjacent to or otherwise near the outer perimeter 125. As mentioned, the lower spaces 124 may be defined in part by the sides 123 of adjacent lower ribs 122. The distance between two opposing sides 123 of two adjacent ribs 122 may define a width of the lower space 124 defined therein. The width of the lower space 124 at the first end 124A may be the same as the width of the lower space 124 at the second end 124B. In some embodiments, the width of the first end 124A of the lower space 124 may be greater than the width of the lower space 124 at the second end 124B. In some embodiments, the width of the first end 124A of the lower space 124 may be less than the width of the second end 124B of the lower space 124.

In embodiments where the widths of the first end 124A and of the second end 124B are not equal, the lower space 124 may be defined with respect to the angle E as indicated. The angle E may be an angle defined by two opposing sides 123 of two adjacent lower ribs 122 that partially define the lower space 124 therebetween. The angle E may apply equally to lower spaces 124 where the first end 124A is wider than the second end 124B, and vice versa. In some embodiments, the angle E may be 1°, 2°, 3°, 4°, 5°, 10°, 15°, 20°, or other intermediate, lower or higher angular amounts. Further, the angle E may be the same for each of the lower spaces 124. However, in some embodiments the angle E may be different for different lower spaces 124. Therefore, one of the lower spaces 124 may have a first value for the angle E, while another lower space 124 may have a different value for the angle E.

The cover 100 may have a diameter D1 and an overall diameter D2. The diameter D2 may be a distance perpendicular to the axis 10 from one end of the cover 100 to the opposite end. The diameter D1 may be a distance perpendicular to the axis 10 from one end or region of the lower portion 121 to the opposite end or region of the lower portion 121. By "diameter" in this context it is understood that this may refer to an ordinary diameter of a circle, but that it may also refer to the width of a non-circular cover 100, such as the major or minor axis of an elliptical cover 100. Therefore, the nomenclature of the diameter D2 is not meant to limit the cover 100 to any particular shape. Further, the diameters D1 and D2 may vary when measured at different angular locations, for instance with an elliptical cover 100.

The diameter D1 and/or the overall diameter D2 of the cover 100 as oriented in FIG. 1C may be various sizes to accommodate various sizes of drains. In some embodiments, the overall diameter D2 of the cover 100 may be about 13" which could fit, for example, over a drain that is 2-6" wide. The overall diameter D2 of the cover 100 may be other amounts as well, such as 8", 9", 10", 11", 12", 14", 15", 16", 17", 18", 19", 20", 25", 30" or other intermediate, lower or greater amounts. The cover 100 may also fit over drains of various widths, such as 1", 7" or greater.

FIG. 1D is a section view of the cover 100 as taken along the line 1D-1D as indicated in FIG. 1C. As shown, the dome 129 and/or the skirt 120 may define the cavity therein. The dome 129 may be a shell-like structure attached to the skirt 120. The ribs 122 as shown may include an elongated thin section extending toward the outer ring 150. The outer ring 150 may be coupled with the skirt 120 and the mount 150 as shown. A detail view of this interface is indicated by region 1E in FIGS. 1D and 1*s* shown in FIG. 1E.

FIG. 1E is a detail view taken from the region 1E as indicated in FIG. 1D showing a close up of the interface of the cover 100 including the skirt 120, the outer ring 150 and the mount 160. As shown, the skirt 120 may extend toward the outer perimeter 125. The skirt 120 may include a first surface 131 located generally on top of the rub 122 as oriented. The first surface 131 may be planar. In some embodiments, the first surface 131 may be non planar. The first surface 131 may be a feature of the rib 122 that extends along a first direction that is at the acute angle A with respect to the axis 10, as described herein. The first surface 131 may couple with a step 127. The step 127 may be a transition zone of the rib 122. The step 127 may be a substantially vertical transition from the first surface 131 as oriented. In some embodiments, the step 127 may be an angled or other non-vertical transition from the first surface 131 as oriented. The step 127 may be coupled with a second surface 128. The step 127 may be a transition between the first surface 131 and the second surface 128. The second surface 128 may be planar or non-planar, and it may be parallel with the first surface 131. The second surface 128 may continue in a first direction that is at the acute angle A with respect to the axis 10, as described herein.

Further shown in FIG. 1E is the outer ring 150. As shown, the outer ring 150 may have an inner edge 151. The inner edge 151 may be an edge of the ring body 152. The inner edge 151 may be an edge along an inner boundary of the ring body 152. The inner edge 151 may interface with the skirt 120. As shown, the inner edge 151 may abut features of the skirt 120. The inner edge 151 may interface with the step 127 and/or second surface 128 of the skirt 120. The inner edge 151 may abutt the step 127. The inner edge 151 may compress against the step 127. The inner edge 151 may rest on and/or be compressed against the second surface 128. The cross-section of the ring body 152 may extend from the inner edge 151 along the second surface 128 and over the outer edge 129 of the skirt 120. The ring body 152 may define an outer cavity. The outer cavity 113 may be a volume or space generally in between the inside surface of the ring body 152 and the outer edge 129 of the skirt 120. The outer cavity 113 may be in fluid communication with one or more of the slots 153 or other openings formed by the ring body 152. The outer cavity 113 may be in fluid communication with the cavity 112. Thus, the slots 153 and/or other openings of the ring body 152, as described herein, may be in fluid communication with the cavity 112 via the outer cavity 113. The ring body may further extend over and around the outer edge 129 and include a curl 156 having an outer edge 158. The curl 156 may be a portion of the ring body 152 that curls and then projects inward generally toward the axis 10. The curl 156 may provide a surface or surfaces on which corresponding features of the mount 160 may rest, compress or otherwise couple. The outer edge 158 of the ring body 152 may abut, compress against, or otherwise be adjacent to the mount 160 when installed with the mount 160 on the cover 100.

Further shown in FIG. 1E is the mount 160. The mount 160 may include the outer lip 170 projecting generally upward as oriented. The lip 170 may project generally perpendicularly from the mount surface 163. The lip 170 may be coupled on one end to the mount surface 163 and on an opposite end with a rim 171. The rim 171 may project generally perpendicularly from the end of the lip 170. The rim 171 may be tapered as shown. The rim 171 may provide a feature with which the ring body 152 may couple. The rim 171 may be a feature with which the curl 156 of the ring body 152 may couple. The ring body 152 may be flexed to fit over the rim 171 of the mount 160. The curl 156 may flex outward as oriented to fit over the rim 171 and then flex inward as oriented to securely couple with the rim 171. The rim 171 may also be flexible.

The mount 160 may include a cavity 173 configured to receive a portion of the skirt 120. As shown, the cavity 173 may be formed by a projection 174 and the lip 170. The projection 174 may project upward as oriented from the mount surface 163. The projection 174 may be shorter than the lip 170.

Figure 1G:
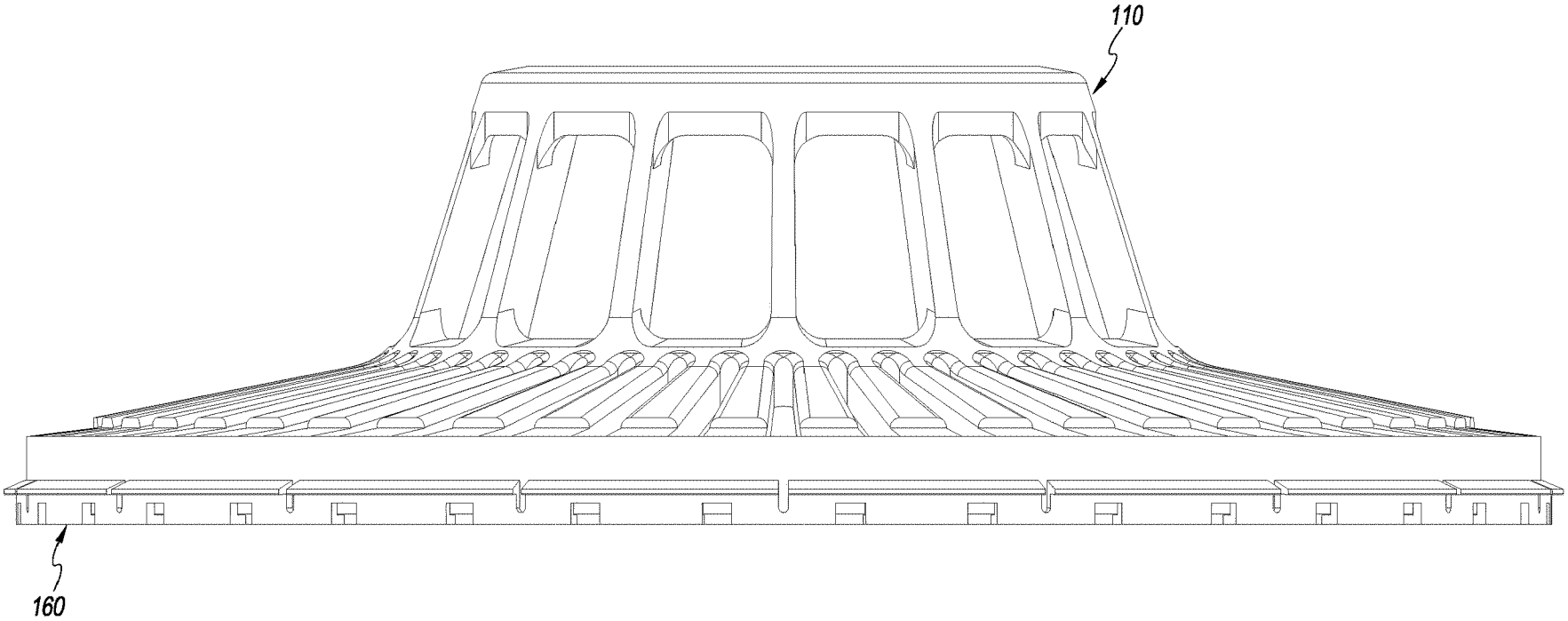

FIGS. 1F-1G are perspective and side views, respectively, of the ring body 110 coupled with the mount 160. The outer ring 150 has been removed to more clearly see how the mount 160 may couple along and around an underside of the ring body 110.

Figure 1H:
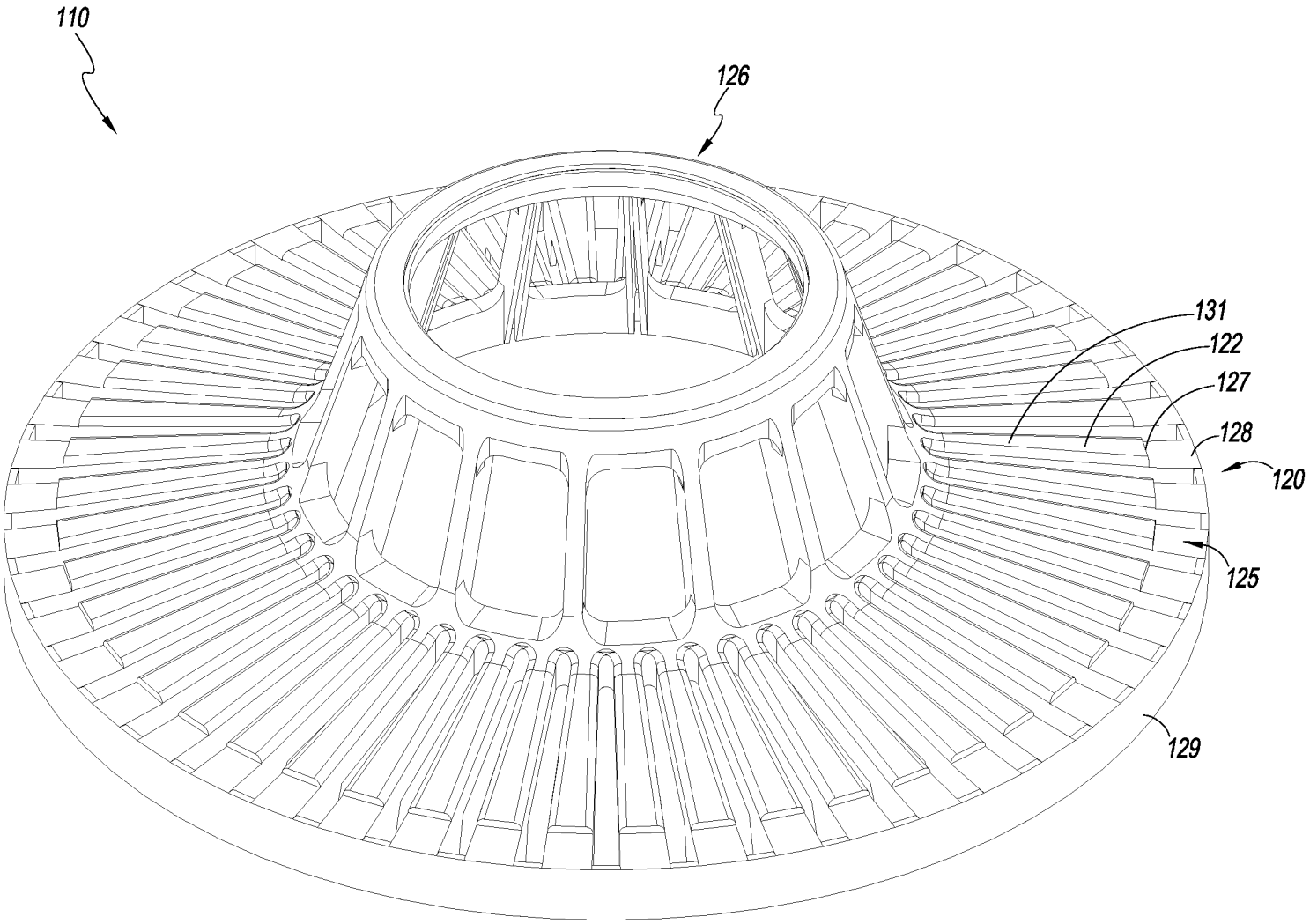
FIG. 1H is a perspective view of the body of the cover of FIG. 1A.
Figure 11:
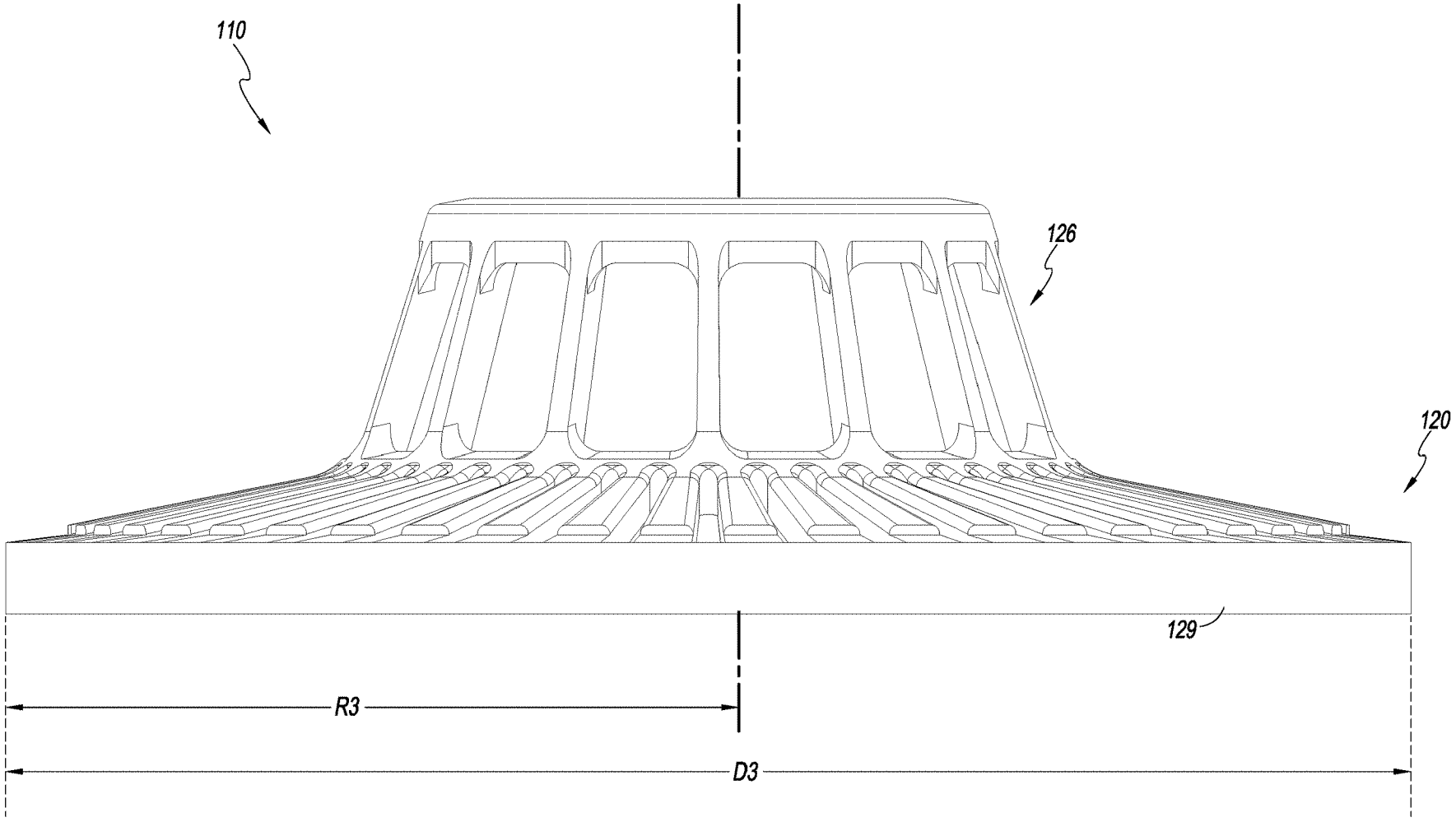
FIG. 11A is a partial side view of an embodiment of a cover with a flexible housing coupled with a mount with a ball catch protrusion.
FIG. 11B is a partial exploded view of the lower portion and the mount of FIG. 11A.

FIG. 1H is a perspective view of an embodiment of the ring body 152 of the cover 100. As shown, the dome 126 may be coupled with the ribs 122 of the skirt 120. The skirt 120 may also include the first surface or surfaces 131 of the ribs 122 extending generally outward and downward from dome 126 toward the outer edge 129. The first surfaces 131 may be located over a majority of the length of the ribs 122, with the remaining outer portions of the length of the ribs 122 including the step 127 and the second surface 128.

The outer edge 129 may extend around the outer perimeter 125 of the ring body 110. The outer edge 129 may a wall-like structure. The outer edge 129 may be slid or hollow. The outer edge 129 may have no openings extending therethrough. In some embodiments, the outer edge 129 may define one or more openings extending therethrough.

FIG. 1I is a side view of the ring body 110. As shown, the ring body 110 may include the dome 126 coupled on a top side of the skirt 120. Further, the ring body 110 may have a width R3 and/or an outer diameter D3 as indicated. The width R3 may be a perpendicular distance from the axis 10 to the outer edge 129 of the skirt 120. The width R3 may be a radius of the outer edge 129. However, the outer edge 129 need not be circular, and thus the width R3 may not be a radius. The overall diameter D3 may be a distance from one side of the outer edge 129 to an opposite side of the outer edge 129 in a direction that is generally perpendicular to the axis 10. The overall diameter D3 may measure the span of a circular outer edge 129 or of a non-circular outer edge 129. The distance of the width R3 may be substantially the same as the distance of the width R2 (see FIG. 1B, for example). The distance of the overall diameter D3 may be substantially the same as the distance of the overall diameter D2 (see FIG. 1C, for example). As mentioned, the outer edge 129 may not be circular, and thus in some embodiments the distance R3 may not be a radius. Further, R3 need not be constant as measured at different angular locations of the cover 100 or body 110. For example, the outer edge 129 or other parts may be arcuate but with straight outer edges such that the outer edge 129 appears square or rectangular as viewed from the top. For such a shape, R3 would vary depending at which angular location the dimension is measured (i.e. which cross-section or side view is used to make the measurement). Thus, R3 may vary with such a configuration as measured at different angular locations. In some embodiments, R3 refers to a maximum or minimum width of the outer edge 129, or other outer portion of the cover 100 or body 110. For a non-circular cover 100 or body 110, R3 may be a maximum or minimum width, for example the maximum or minimum perpendicular distance respectively from the axis 10 to a farthest-most or closest portion of the outer edge 129, or other outer portion of the cover 100 or body 110.

Figure 2:
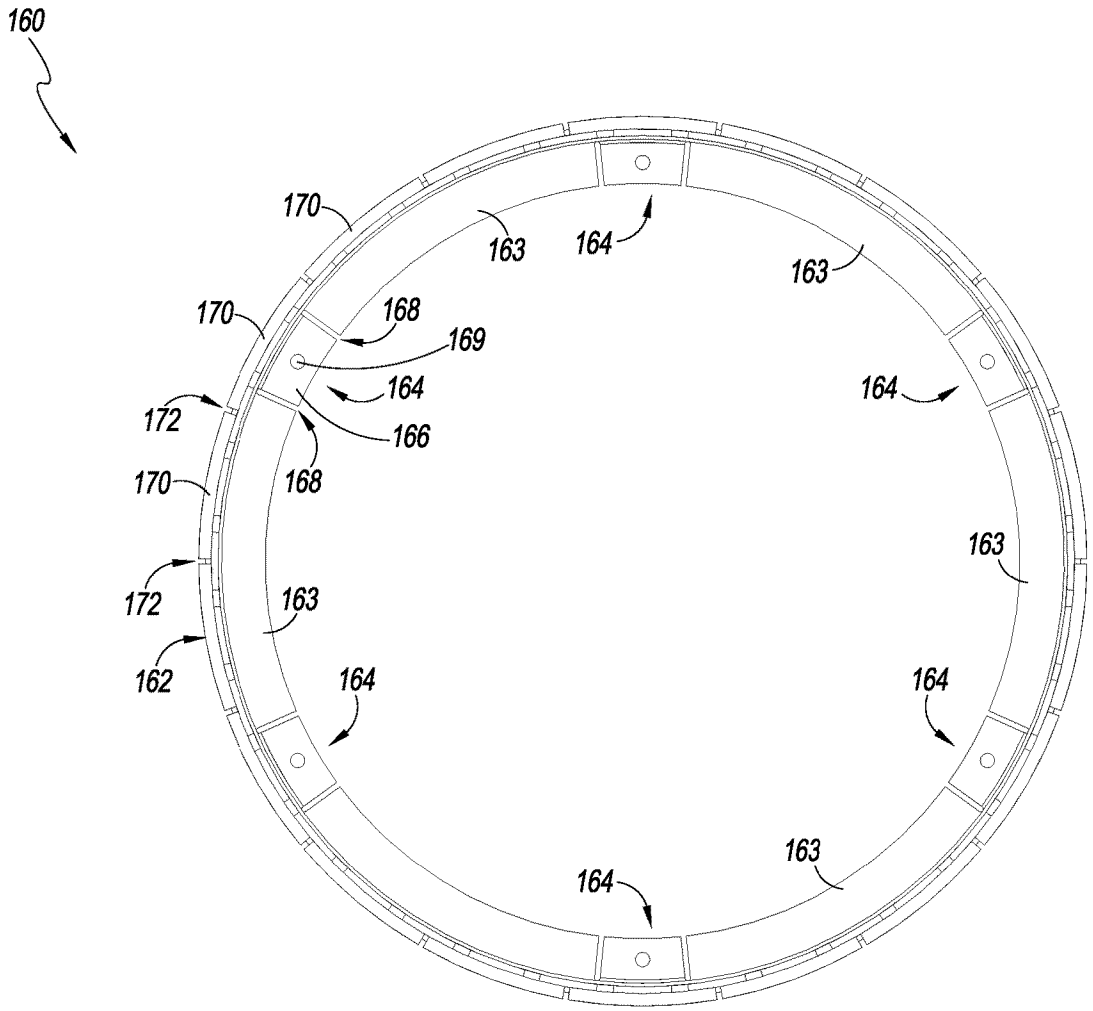
FIG. 2 is a top view of an embodiment of a mount that may be used with the cover of FIG. 1A.

FIG. 2 is a top view of an embodiment of the mount 160. As shown, the mount 160 may have a generally arcuate shape with respect to the axis 10. The mount 160 may be circular and generally symmetric with respect to the axis 10. However, a variety of other arcuate shapes of the mount 160 may be implemented.

The mount 160 may include a mount body 162 as shown. The body 162 may have a generally circular shape swept out for a full 360° about the axis 10. In some embodiments, the mount body 162 may be swept out for less than 360°.

The mount 160 may include one or more mount surfaces 163. The mount surfaces 163 may be arcuate and generally flat structures extending along the boundary of the mount 160. The mount surfaces 163 may provide structural stability to the mount 160. For example, the mount surfaces 163 may provide increased stiffness to the mount 160. As shown, there may be six mount surfaces 163. In some embodiments, there may be fewer or more mount surfaces 163. In some embodiments, the mount surfaces 163 may be adjacent to each other. As shown, the mount surfaces 163 may be interspersed with intervening structures therebetween.

The mount 160 may include one or more flex joints 164. The flex joints 164 may be located in between adjacent mount surfaces 163. The flex joints 164 may provide flexibility to the mount 160 such that it can be secured to curved or other non-flat mounting structures or protuberances. The flex joint 164 may include a tab 166 having a hole 169 extending therethrough. The tab 166 may be an arcuate and generally flat structure extending for a portion of the contour of the mount 160. In some embodiments, the tab 166 may be similar to the mount surfaces 163. For instance, the tab 166 may be a shortened version of the mount surfaces 163. The hole 169 extending through the tab 166 may be generally parallel with the axis 10. In some embodiments, the whole 169 may not be parallel with the axis 10. The hole 169 may be configured to receive a fastener such as a nail or rivets therethrough in order to secure the amount 160 to or otherwise with a mounting structure. The hole 169 may be circular as shown, or it may have other suitable shapes. The tab 166 may be separated from adjacent mount surfaces 163 on either side by a gap 168. The gap 168 may be a space in between the mount surfaces 163 and the tabs 166. The gaps 168 may partially provide flexibility to the flex joint 164 such that the mount 160 may be secured to a curved or other non-flat mounting structure. The size of the gaps 168 may be chosen so as to optimize this flexing capability. In some embodiments, the gap 168 may have a width of 0.1", 0.2", 0.125", 0.25", 0.5", or other intermediate, lower or greater amounts. As shown, the gaps 168 may extend along most of the length of an interface between the tab 166 and the adjacent mount surface 163.

The mount 160 may include a lip 170. The lip 170 may be an arcuate structure extending along an outer boundary of the mount 160. The lip 170 may provide structural stability to the mount 160. For instance, the lip 170 may provide increased stiffness to the mount 160. The lip 170 may couple with and project upwardly from the mount surfaces 163. The lip 170 may therefore form a wall structure around the boundary of the mount 160. The lip 170 may be flexible such that it can flex to couple with the body 110 of the cover 100. In some embodiments, the lip 170 may be expandable and contractible to fit around and/or cover and then compress onto the outer perimeter 125. The lip 170 may be formed from a variety of suitable materials, including plastics, polymers, composites, metals, other materials or combinations thereof. There may be multiple segments that form the lip 170. As shown, the lip 170 may be formed of eighteen segments. The segments together may form the lip 170. In between the segments of the lip 170 there may be openings 172. The openings 172 may be spaces in between the segments of the lip 170 that increase the flexibility of the lip 170. In some embodiments, the mount 160 may be secured to a curved or other non-flat mounting structure, and the openings 172 may allow for short segments of the lip 170 which may provide more flexibility to the mount 160 than longer segments. The openings 172 may be a variety of sizes and shapes. In some embodiments, the openings 172 may be rectangular spaces in between the segments of the lip 170. The openings 172 may have a width from one segment of the lip 170 to an adjacent segment of the lip 170. This width may be 0.01", 0.1", 0.2", 0.3", 0.4" 0.5", 0.75" or other intermediate, lower or greater values.

Figure 3A:
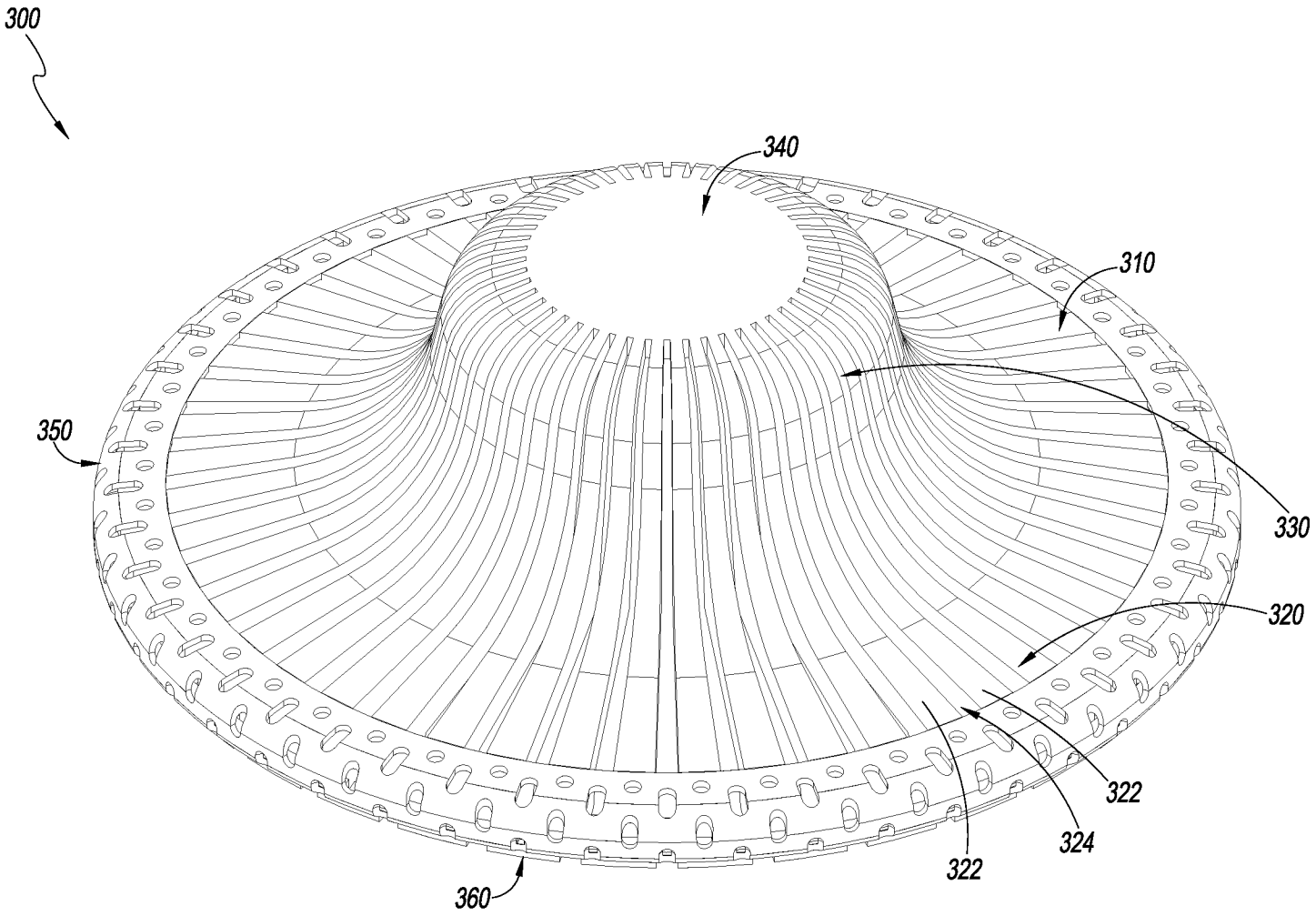
FIG. 3A is a perspective view of another embodiment of a cover for a roof drain.

FIG. 3A is a perspective view of another embodiment of a cover 300. The cover 300 may have any of the features and functionalities as the cover 100 described herein. As shown, the cover 300 may have a body 310 with various portions. As shown, the body 310 may include a skirt 320 coupled with an upper portion 330, which may be coupled with a top 340. These portions may have the same or similar features and functionalities as analogous features of the cover 100, such as, respectively, the body 110, the skirt 120, the sidewall 130, and the top 140. The skirt 320 may include one or more ribs 322 defining in part one or more spaces 324, which may have the same or similar functionalities as the lower ribs 122 and lower spaces 124, respectively. The cover 300 may have an outer ring 350 coupled with the skirt 320 in the same or similar way as the outer ring 150 and the skirt 120 of the cover 100. The cover 300 may include a mount 360 coupled with the skirt 320 and/or the outer ring 350. The mount 360 may have the same or similar functionalities as the mount 160 of the cover 100.

As shown, the cover 300 may include one or more ribs 322 that extend from the skirt 320 to the upper portion 330. Thus, the upper portion 330 and the skirt 320 may include different parts of the same rib 322. The ribs 322 may further extend to the top 340. Similarly, one or more spaces 324 defined in part by the ribs 322 may extend from the skirt 320 to the upper portion 330. The spaces 324 may further extend to the top 340. The top 340 of the cover 300 may be generally flat as shown. The top 340 may therefore not have any openings or ribs at a location generally near the center of the top 340.

Figure 3B:
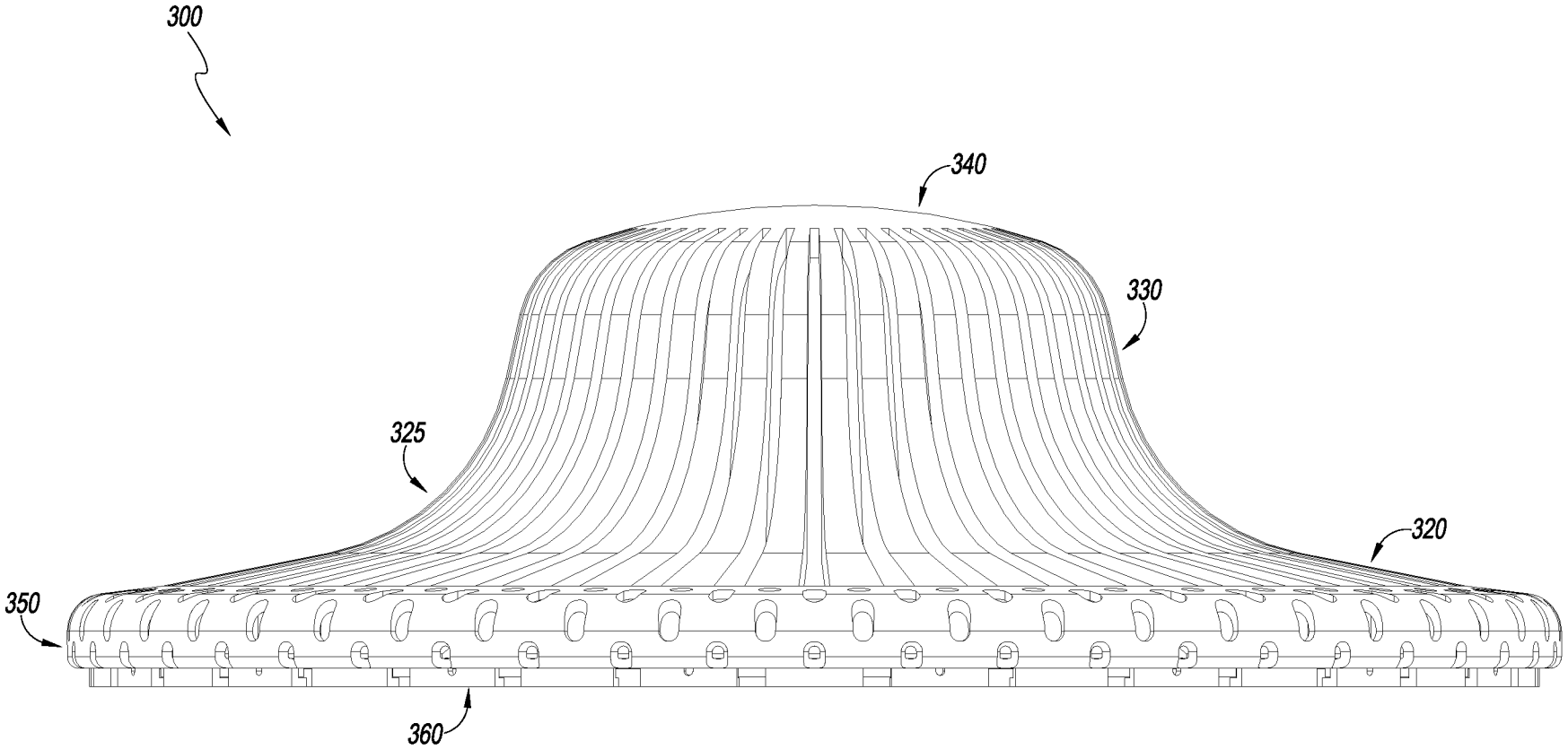
FIG. 3B is a side view of the cover of FIG. 3A.

FIG. 3B is a side view of the cover 300. As shown, the cover 300 may include one or more transition segments 325. The transition segment 325 may couple the skirt 320 with the upper portion 330. The transition segment 325 may have a generally curved contour as shown and as oriented in the figure. In some embodiments, the transition segment 325 may have a sharper contour, may be segmented, may be partially round and partially straight, may be other shapes, or may be combinations thereof. The top 340 may also have a curvature when viewed from the side and as oriented in the figure. The top 340 may be a dome or other similar structure.

Figure 4:
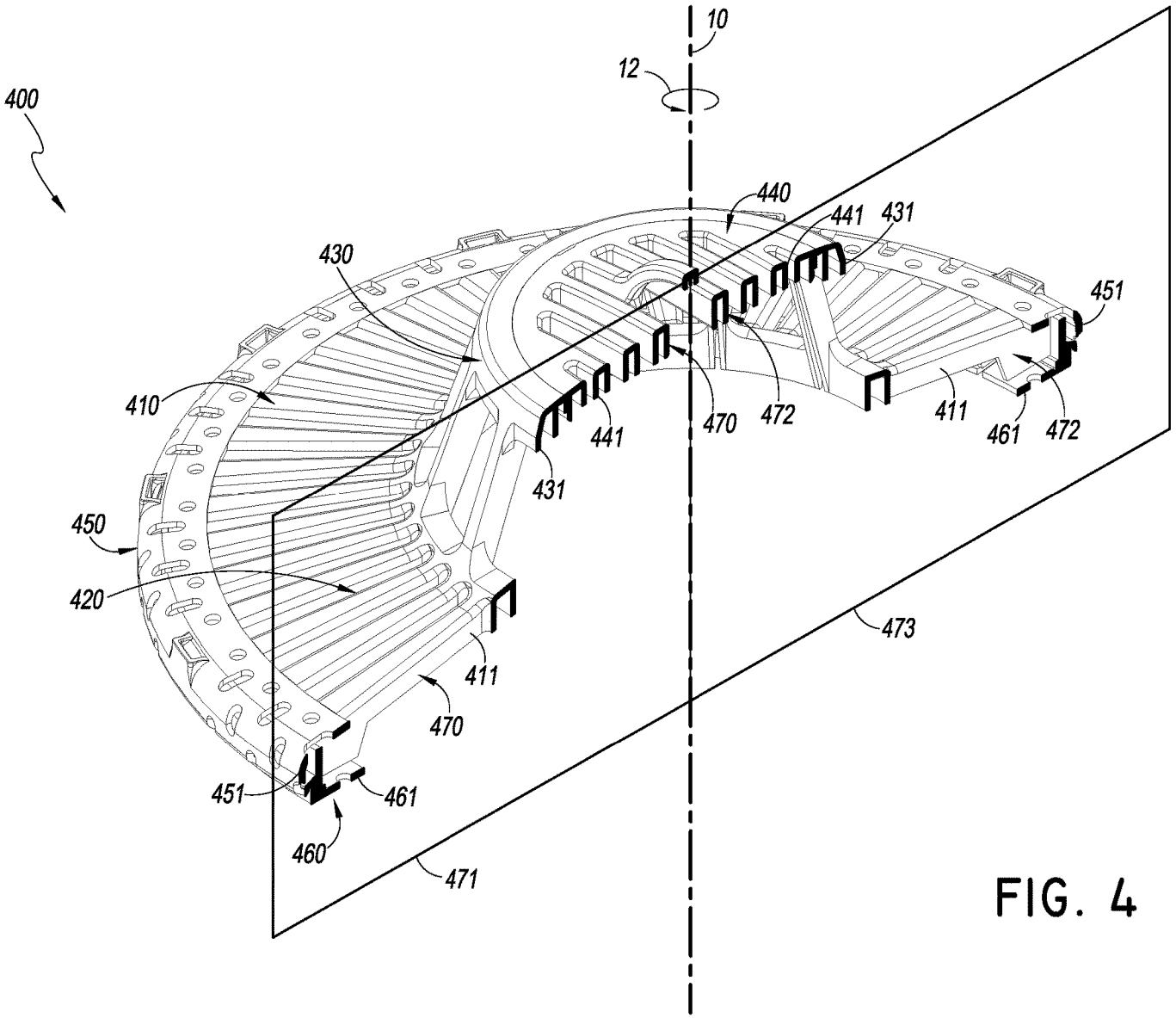
FIG. 4 is a perspective view of another embodiment of a cover for a roof drain that is contoured to fit with a protruding structure.

FIG. 4 is a perspective view of an embodiment of a cover 400. The cover 400 may have the same or similar functionalities as the cover 100 and/or the cover 300. Thus, the body 410, the top 440, the outer ring 450, and the mount 460 may be the same or similar as, respectively, the body 110 or 310, the top 140 or 340, the outer ring 350 or 150, and the mount 160 or 360. However, the cover 400 as shown may not be swept out angularly a full 360° about the axis 10.

The cover 400 and the various features thereof may be swept out about the axis 10 for an amount equal to a rotation angle 12. As shown, the cover 300 and the various features and parts thereof, may be swept out angularly about the axis 10 for a rotation angle 12 of 180°. As mentioned, by "swept" it is meant that the various parts of the cover 400 may extend in a generally arcuate contour about the axis 10. This contour may be circular as shown. In some embodiments, this contour may be elliptical, oval, circumferential, rounded, or other arcuate paths. Further, the rotation angle 12 may be greater or less than 180°. In some embodiments, the rotation angle 12 may be less than 360°, less than or equal to 270°, less than or equal to 180°, less than or equal to 90°, or any other intermediate, lower or higher angular amount.

In embodiments of the cover 400 that are swept out for a rotation angle 12 that is less than 360°, there may be exposed end surfaces of the various features of the cover 400. As shown, the cover 400 may have mating surfaces 451, 461, 411, 431, 441 on both ends of the swept out cover 400. The mating surface 451 may be an end surface or surfaces of the outer ring 450. The mating surface 461 may be an end surface or surfaces of the mount 460. The mating surface 411 may be an end surface or surfaces of the lower portion 420. The mating surface 431 may be an end surface or surfaces of the upper portion 430. The mating surface 441 may be an end surface or surfaces of the top 440. These mating surfaces 451, 461, 411, 431, 441 may mate with an adjacent structure. By "mate" it is meant that these surfaces may abut, contact, be fastened to, or be near such adjacent structures. For instance, these surfaces may abut a wall protruding upwardly from the mounting structure to which the cover 400 is secured.

The mating surfaces 451, 461, 411, 431, 441 may form contours 470, 472. The contours 470, 472 refer to the shape formed or defined by the various mating surfaces. The first contour 470 may be formed by the mating surfaces 451, 461, 411, 431, 441 on one end of the swept out cover 400, and the second contour 472 may be formed by the mating surfaces 451, 461, 411, 431, 441 on the other end of the swept out cover 400. As shown, the two contours 470, 472 may each be planar. The first contour 470 may define a first plane 471. The second contour 472 may define a second plane 473. As shown, the first and second planes 471, 473 may be coplanar. In some embodiments, the first and second planes 471, 473 may be non coplanar. Either or both of the first and second planes 471, 473 may intersect the axis 10. As shown, the axis 10 may reside within both of the first and second planes 471, 473. In some embodiments, the axis 10 may intersect one, both or neither of the planes 471, 473 at a single point. For instance, one or both of the planes 471, 473 may be angled with respect to the axis 10, such as when the cover 400 is configured to abut against an angled, protruding structure. In some embodiments, the contours 470, 472 may not be planar. One or both of the contours 470, 472 may be non planar. For example, the contour 470 may be curved or otherwise shaped in order to complement an adjacent structure to which it is mated. Some examples of structures to which the various covers herein may be mated are shown and described herein, for example with respect to FIGS. 5-6.

Figure 5:
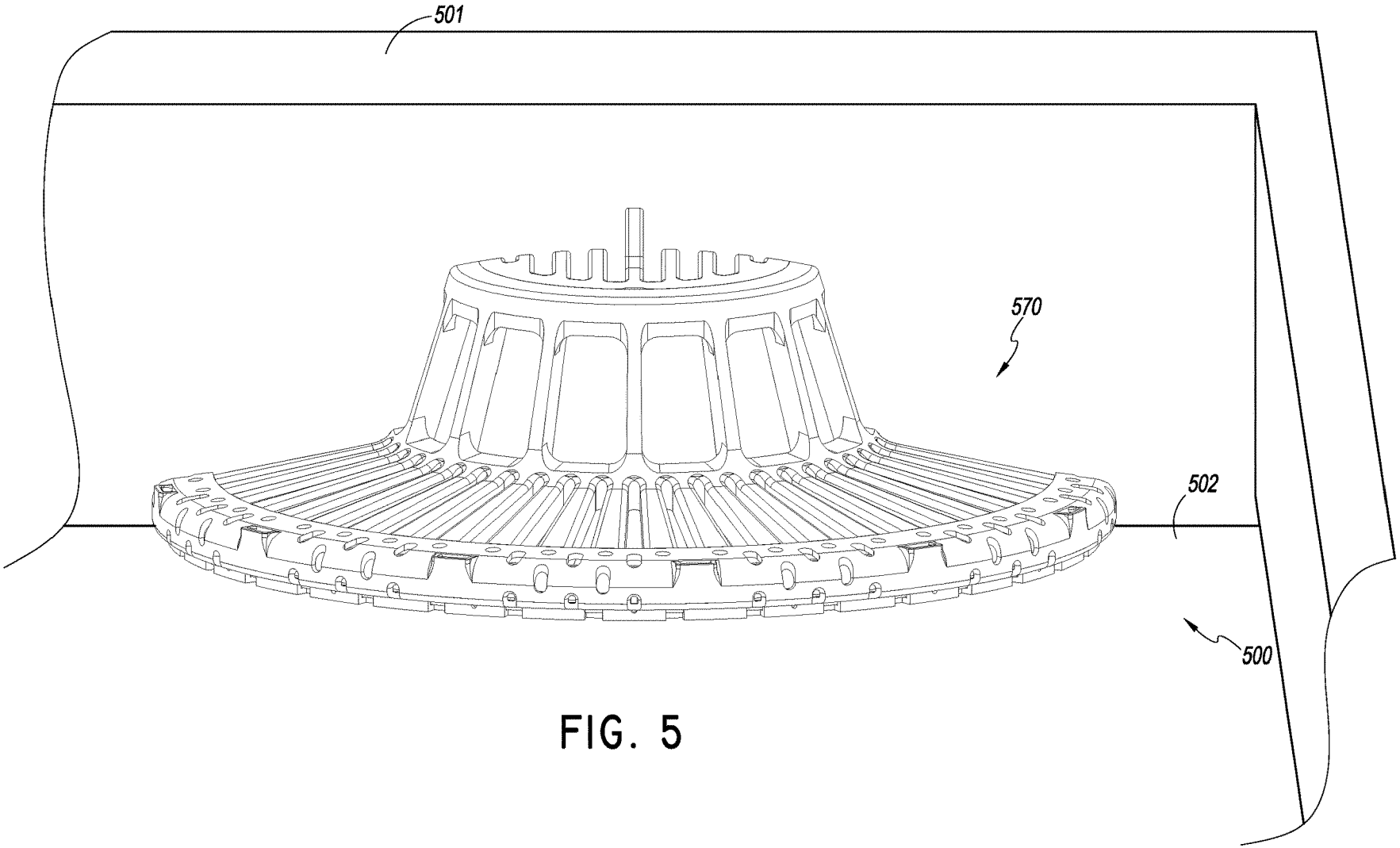
FIGS. 5-6 are perspective views of other embodiments of covers for a roof drain shown installed adjacent to a protruding structure.
Figure 6:
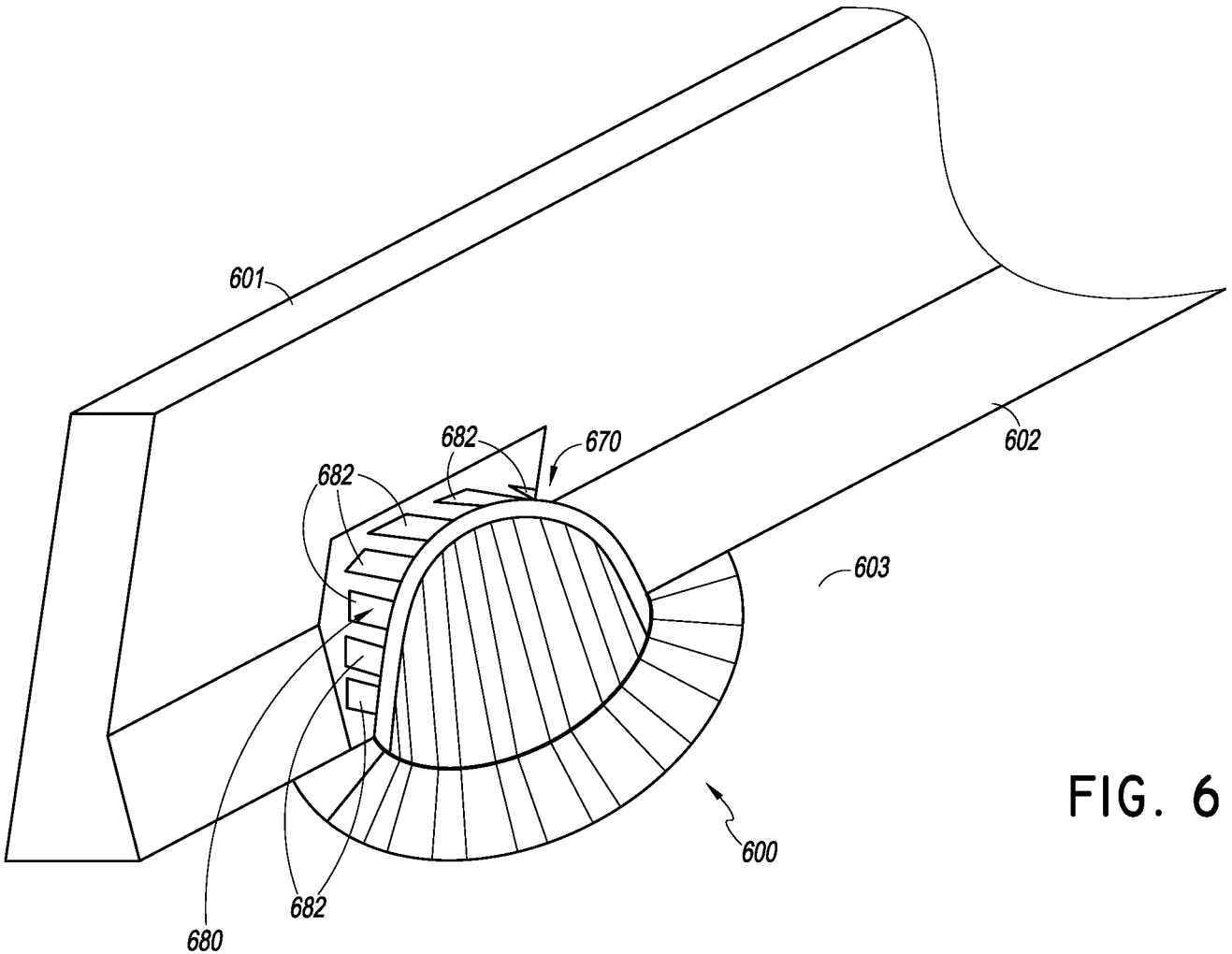

FIGS. 5-6 are perspective views of other embodiments of covers for a drain shown installed adjacent to a protruding structure. FIG. 5 depicts an embodiment of a cover 500 mounted generally on top of a mounting structure 502, and FIG. 6 depicts an embodiment of a cover 600 mounted generally on top of a mounting structure 603. The covers 500, 600 may have any of the features and functionalities as the covers described herein, such as the cover 100, the cover 300, and the cover 400. The mounting structures 502, 603 may be any surface near a drain and on which the covers may be installed or otherwise coupled with. In some embodiments, the mounting structure 502, 603 may be a roof top.

Referring to FIGS. 5 and 6 respectively, the covers 500 and 600 may be mated with an adjacent structure 501 and 601 and thereby form an interface 570 and 670. Mating surfaces of the cover 500 and 600 may abut or otherwise be adjacent to the adjacent structure 501 and 601. The interface 570 and 670 may be defined by the mating surfaces and the contours formed from those mating surfaces extending along the adjacent structure 501 and 601. The adjacent structure 501 and 601 may be a wall, a floorboard, a molding, or any other structure which would interfere with a full 360° swept out cover.

In some embodiments the covers disclosed herein may have adjustment mechanisms that allow the covers to conform or otherwise adjust to the surface or surfaces of an adjacent structure. As shown in FIG. 6, the cover 600 may have an adjustment mechanism 680. The mechanism 680 may allow the cover 600 to adjust to the contour or surface of an adjacent structure, such as the structure 601. The mechanism 680 may be attached to or integral with the cover 600. In some embodiments, the mechanism 680 may be added on to an existing cover 600. In some embodiments, the mechanism 680 may be part of the cover 600 structure. The mechanism 680 may be located substantially to one or another side of the cover 600, such as substantially on the side facing the adjacent structure 601 as oriented in FIG. 6.

As shown, the mechanism 680 may include one or more fingers 682. The fingers 682 may retractably extend from the mechanism 680 and toward the adjacent structure 601. As shown, the fingers 682 may be located along the boundary of the interface 670 between the cover 600 and the adjacent structure 601. The fingers 682 may be of varying length. The fingers 682 may extend from the mechanism 680 for a variable length to match the contour of the adjacent structure 601. The fingers 682 may extend and thereby form or define spaces in between. The extended fingers 682 may act as an extension of one or more various parts of the drain over the gap in between the adjacent structure 601 and the cover 600. As shown, the fingers 682 may provide an extended dome of the cover 600. In some embodiments, the finger 682 may provide an extended skirt of the cover 600. The fingers 682 may be formed from a variety of materials. The fingers 682 may be relatively rigid members formed from plastics or polymers. In some embodiments, the fingers 682 may be formed from metals, metal alloys, composites, other suitable materials, or combinations thereof. The fingers 682 may be relatively flexible members formed from a variety of materials, such as flexible plastics or polymers. In some embodiments, the fingers 682 may be formed from mesh material, flexible porous materials, other suitable flexible materials, or combinations thereof. Further details of the adjustment mechanism are discussed herein, for example with respect to FIGS. 8A-8B.

Figure 7A:
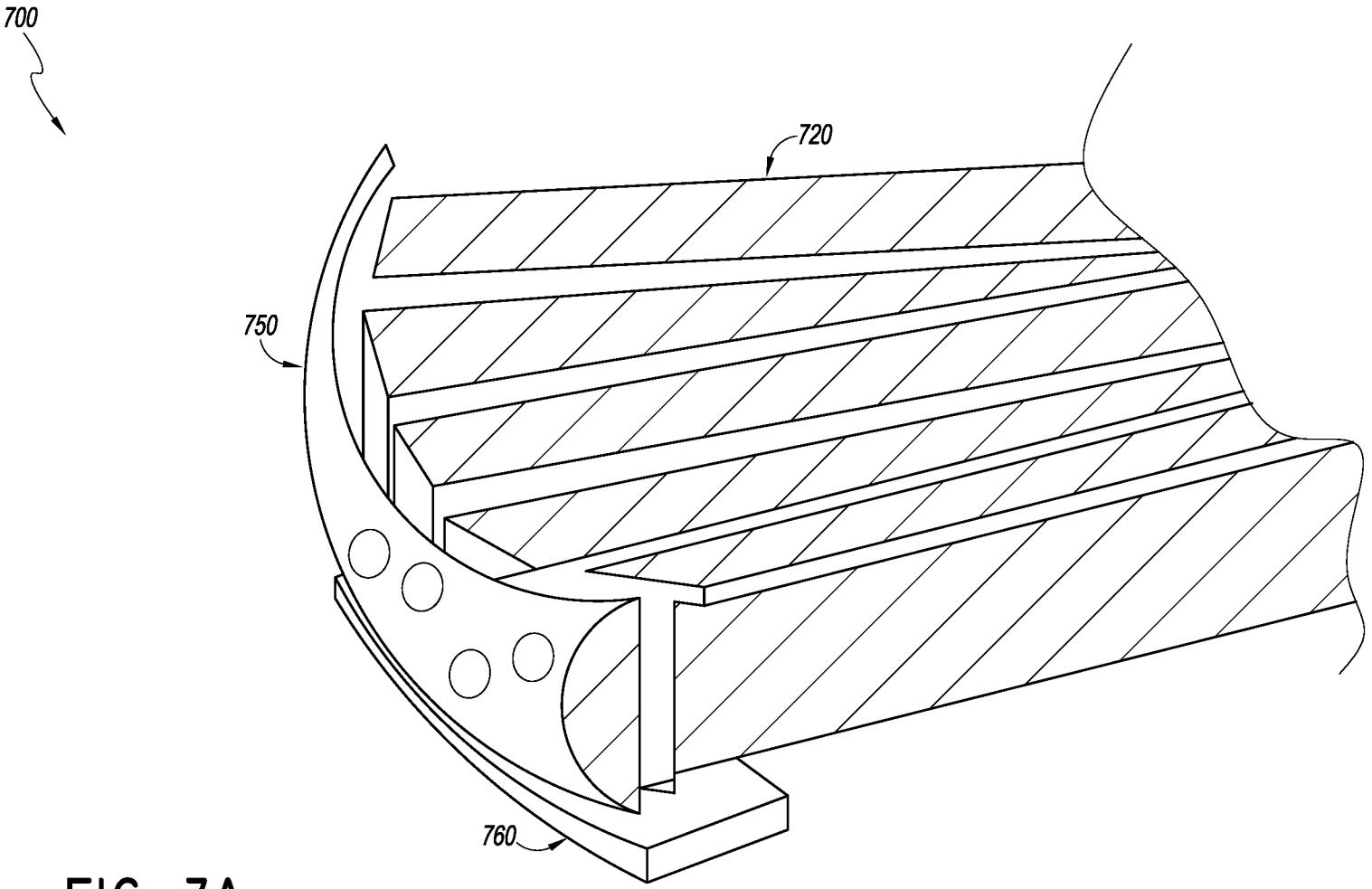
FIG. 7A is a partial perspective view of an embodiment of a cover for a roof drain including a lower portion, an outer ring and a mount.
Figure 7B:
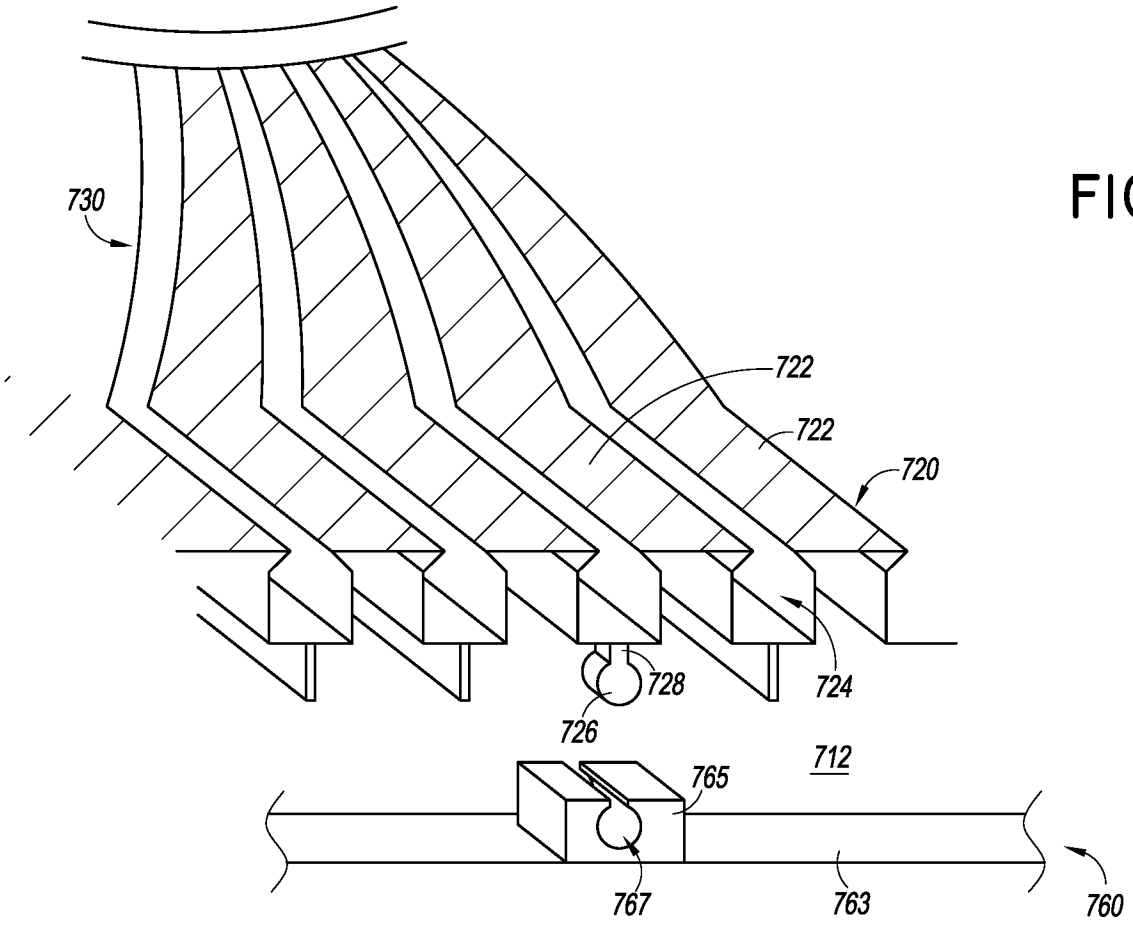
FIG. 7B is a partial exploded view of the lower portion and mount of FIG. 7A.
Figure 7C:
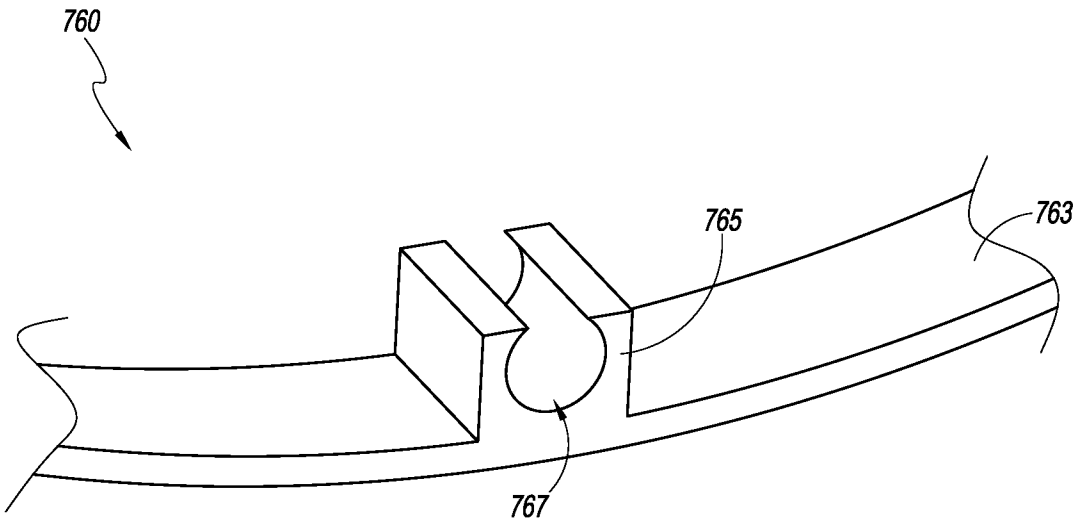
FIG. 7C is a partial detail perspective view of the mount of FIG. 7A.
Figure 7D:
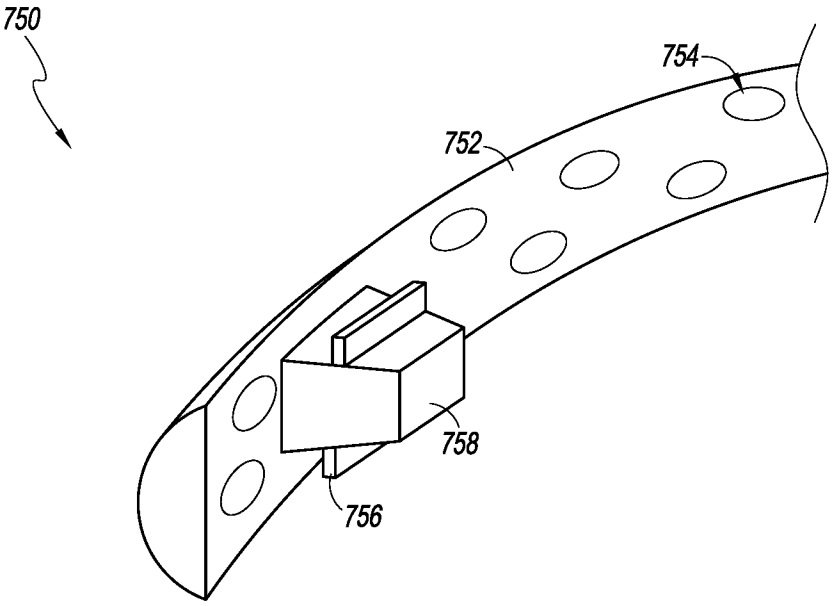
FIG. 7D is a partial detail perspective view of an interior of the outer ring of FIG. 7A.
Figure 7E:
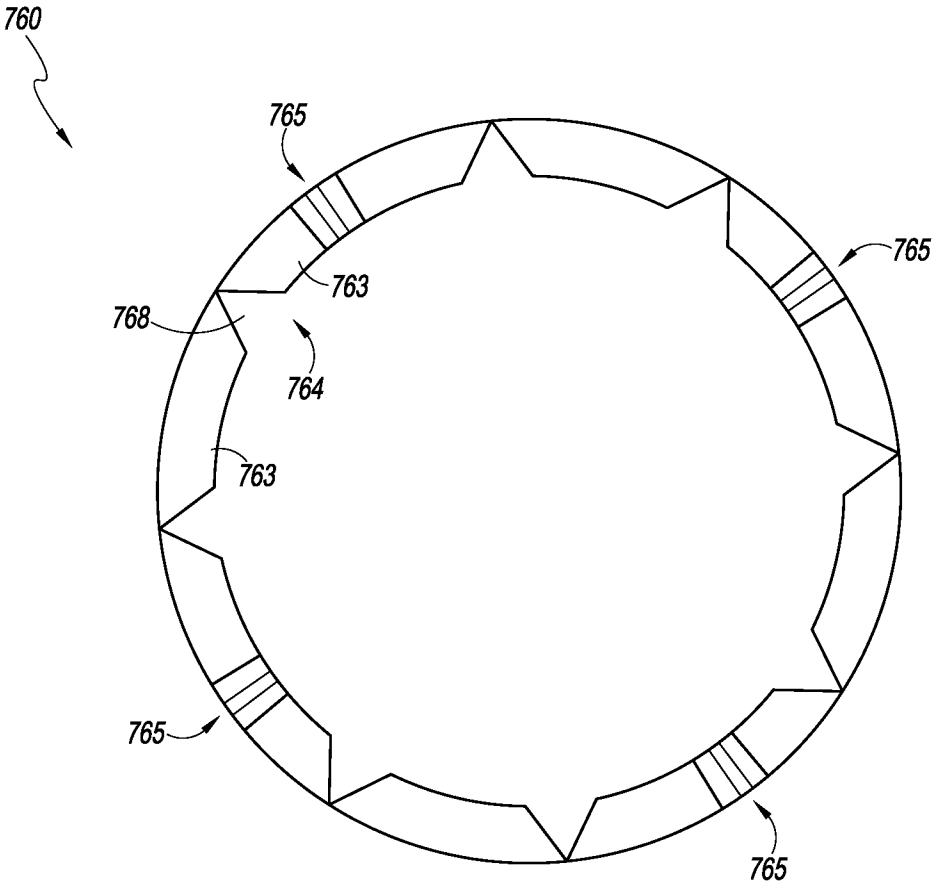
FIG. 7E is a top view of the mount of FIG. 7A.

FIGS. 7A-7E are various views of an embodiment of a cover 700. FIG. 7A is a partial perspective view of the cover 700, showing a lower portion 720, an outer ring 750 and a mount 760 thereof. FIG. 7B is an exploded view of the lower portion 720 and the mount 760 of the cover 700. FIG. 7C is a detail perspective view of part of the mount 760, and FIG. 7D is a detail perspective view of an interior of part of the outer ring 750. FIG. 7E is a top view of the mount of FIG. 7A. The cover 700 may have the same or similar features and functionalities as the cover 100, the cover 300, the cover 400, the cover 500, and the cover 600.

As shown in FIG. 7B, the cover 700 may include an upper portion 730 coupled with a lower portion 720, which may have the same or similar features as the various upper and lower portions described herein. The lower portion 720 and/or upper portion 730 may include one or more lower ribs 722, which may have the same or similar features or functionalities as the various lower ribs described herein. The lower ribs 722 may partially or fully define one or more lower spaces 724 therebetween, which may have the same or similar features as the various lower spaces described herein. The lower spaces 724 may define channels that extend along the same direction as the ribs 722. Any fluids collected within the lower spaces 724 may flow down the lower spaces 724 as oriented and into a cavity 712 formed by the cover 700. The cavity 712 may have the same or similar features or functionalities as the cavity 112 of the cover 100. The lower spaces 724 may therefore be channels in fluid communication with the cavity 712 and thus in fluid communication with the drain over which the cover 700 may be positioned.

The cover 700 may include an insert 726 coupled with the lower portion 720. As shown, the insert 726 may be coupled with the underside of the lower space 724 as oriented. The insert 726 may couple with other features of the cover 700. The insert 726 may be a protrusion of the cover 700 configured to couple with a complementary receiving structure of the mount 760 and thereby secure the body of the cover 700 to the mount 760. The insert 726 may be coupled to the lower portion 720 or other features of the cover 700 by a neck 728. The neck 728 may be a thinner or skinnier portion of the insert 726 that facilitates securing the insert 726 with various features of the mount 760, such as a catch 765.

As shown in FIGS. 7B and 7C, the mount 760 may have a catch 765. The catch 765 may be a structure of the mount 760 configured to couple with or otherwise attach to the insert 726 and/or the neck 728. The catch 765 may form an opening 767 extending through the catch 765 and having a narrower slit for access to the opening 767. The insert 726 may be inserted into the opening 767 such that the neck 728 comes to rest within the slit of the catch 765 and the insert 726 is inside the larger opening 767. The catch 765 may be formed of flexible or otherwise resilient material such that it can flex to receive the insert 728 therein. The insert 728 may also be slid into the opening 767 from the side. The catch 765 and/or insert 726 and/or neck 728 may be plastic, polymer, composite, metal, other materials, or combinations thereof. In some embodiments, the insert 726 and/or neck 728 may be located on the mount 760 with the catch 765 located on the lower portion 720 of the cover 700. Therefore, the configuration shown is merely one example and many other suitable configurations may be implemented.

The mount 760 may include a foundation 763. The foundation 763 may be a generally arcuate structure that extends generally along the boundary of the cover 700. The foundation 763 may have a top side as oriented configured to couple with the body of the cover 700, and a bottom side opposite the top side configured to mount, secure, attach or otherwise couple with a mounting structure, such as the mounting structure 502 and 603 described herein. The bottom side of the foundation 763 may couple with a mounting structure in a variety of ways. In some embodiments, the foundation 763 may include one or more tabs, such as the tab 166 described with respect to FIG. 2. In some embodiments, the foundation 763 may be adhered or bonded to the mounting structure. In some embodiments, the foundation 763 may be mechanically fastened, such as with fasteners, nails, rivets, brackets, etc., to the mounting structure.

As shown in FIG. 7D, the outer ring 750 may include a ring body 752, which may have the same or similar features and functionalities as the other ring bodies described herein, such as the ring body 152. The ring body 752 may have one or more holes 754 extending through the ring body 752 that allow the flow of fluid therethrough.

The outer ring 750 may include a plug 758. The plug 758 may be coupled with an interior surface of the ring body 752 and extend away from the ring body 752 toward the center of the outer ring 750. The plug 758 may be a generally rectangular or trapezoidal projection. As shown, the plug 758 may have a wider base near the ring body 752 and then get progressively narrower therefrom. The plug 758 may be configured to couple with corresponding features of the cover body, such as the lower ribs 722 and/or the lower spaces 724. The plug 758 may be received by these or other structures to secure the outer ring 750 to various features of the ring body such as the lower portion 720, including the lower ribs 722 and/or the lower spaces 724. The plug 758 can include one or more stops 756. The stops 756 may be generally planar protrusions that extend away from the various surfaces of the plug 758 to which the respective stops 756 are coupled. As shown, there may be two stops 756, with one stop 756 located on a top surface of the plug 758 as oriented in the figure and the other stop 756 located on a bottom surface of the plug 758 as oriented. The plug 758 with the stops 756 may be inserted into or otherwise received by a corresponding receiving structure of the ring body. The stops 756 may prevent the plug 758 from backing out of the receiving structure. The stops 758 may flex such that they may bend when the outer ring 750 is secured with a receiving structure, and they may straighten out in an unrestrained state for instance when not secured with the receiving structure.

As shown in FIG. 7E, the mount 760 may have a generally arcuate planform as viewed from above. The mount 760 may be circular as shown or other arcuate shapes. Further, the mount 760 may extend angularly for the full 360° as shown, or it may extend angularly for less than 360°. The mount 760 may include the foundation 763 extending arcuately and forming flex joints 764 therein. The flex joints 764 may be formed by one or more gaps 768 formed in or by the foundation 763. In some embodiments, there may be multiple segments of the foundation 763 that are coupled together. The segments may refer to different portions of the foundation 763. In some embodiments, the segments may be separate parts of the foundation 763 that are coupled together. The gaps 768 may be triangular as shown. In some embodiments, the gaps 768 may be other shapes, such as rectangular, square, polygonal, rounded, other shapes, or combinations thereof. There may be eight gaps 764 as shown. In some embodiments, there may be fewer or more gaps 764, such as one, two, three, four, five, six, seven, nine, ten or more gaps 764. The gaps 764 may provide flexibility to the mount 760 such that it can flex or otherwise contort to mount with curved or other non-planar mounting structures. The mount 760 may also have openings extending through the mount 760 to allow for the flow of fluid therethrough.

The mount 760 may include multiple catches 765. As shown, there may be four catches 765. There may be fewer or more catches 765, such as one, two, three, five, six, seven, eight, nine, ten or more catches 765. The catches 765 may be located symmetrically about the mount 760. The catches 765 may be located asymmetrically about the mount 760. As shown, there may be segments of the foundation 765 having the catch 765 and adjacent segments of the foundation 765 not having the catch 765.

Figure 8A:
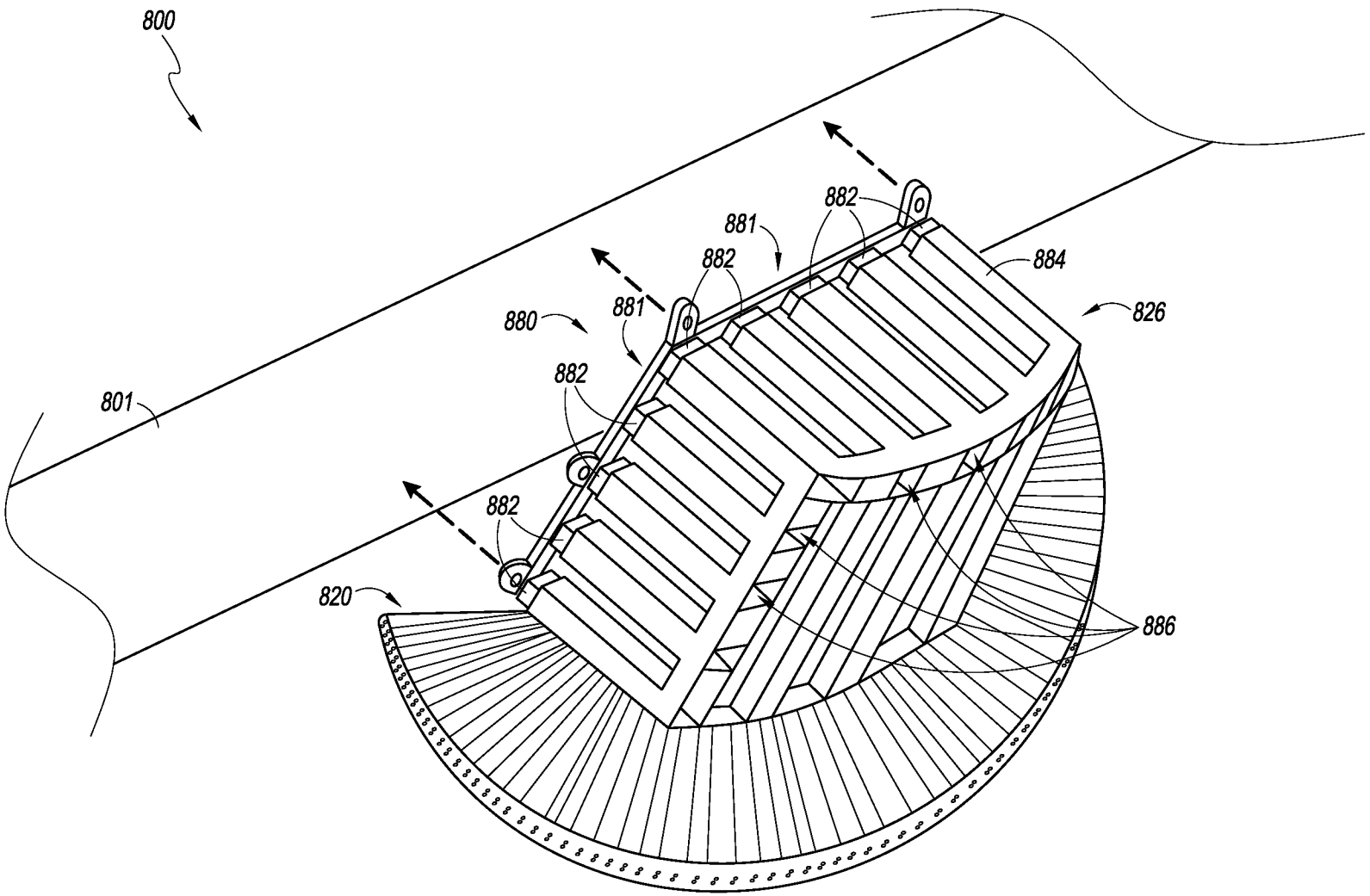
FIG. 8A is a perspective view of an embodiment of a cover with an adjustment mechanism.

FIG. 8A is a perspective view of an embodiment of a cover 800 with an adjustment mechanism 880. The cover 800 may have any of the same or similar features and/or functionalities as any of the covers disclosed herein, such as the cover 100, 300, 400, 500, 600, or 700. The adjustment mechanism 880 may have any of the same or similar features and/or functionalities as any of the adjustment mechanisms disclosed herein, such as the adjustment mechanism 680. The adjustment mechanism 880 may be coupled with, such as integrally formed with or attached to, the cover 800 having a skirt 820 and dome 826 as shown. The mechanism 880 may be snapped into place on the cover 800. In some embodiments, the mechanism 880 may form the dome 826 of the cover 800.

The adjustment mechanism 880 may include features for conforming or otherwise adjusting the cover 800 or parts thereof, such that it forms a portion of the cover between the cover 800 and an adjacent structure 801, such as a wall. The mechanism 880 may have a rack 881 coupled with the cover 800. As shown, the rack 881 may be coupled with the dome 826. The rack 881 may provide a frame or other supporting structure for the mechanism 880. The rack 881 may be formed from a variety of materials. The rack 881 may be include one or more relatively rigid members formed from plastics or polymers. In some embodiments, the rack 881 may be formed from metals, metal alloys, composites, other suitable materials, or combinations thereof. The rack 881 may be relatively flexible formed from a variety of materials, such as flexible plastics or polymers. In some embodiments, the rack 881 may be formed from mesh material, flexible porous materials, other suitable flexible materials, or combinations thereof.

The rack 881 may include one or more fingers 882. The fingers 882 may have any or all of the same or similar features and/or functionalities as the fingers 682 described herein with respect to the cover 600. The rack 881 and/or fingers 882 fingers 882 may extend outward away from the cover 800 to cover any gap in between the cover 800 and the adjacent structure 601. As shown, the rack 881 and fingers 882 are in a retracted configuration. They may extend outwardly therefrom as described. The rack 881 and fingers 882 may be configured in a substantially square shape as shown. In some embodiments, the rack 881 and fingers 882 may be configured in other shapes, such as rectangular, rounded, segmented, other suitable shapes, or combinations thereof. The rack 881 may have three sides with fingers 882 attached thereto such that the rack 881 can extend from the cover 800 and thereby extend the fingers 882 therefrom as well. The rack 881 and fingers 882 may extend to contact or otherwise be near the adjacent structure 601. With the rack 881 and fingers 882 extended, the mechanism 880 may provide an extended cover portion, such as an extended portion of the dome 826, over the gap or space between the cover 800 and the structure 801. In some embodiments, the mechanism 880 may provide an extended portion of the dome 826 and/or the skirt 820, and/or any other portions of the cover 800. The extension of the one or more fingers 882 and/or the rack 881 may define a plurality of spaces or openings between the extend fingers 882 to provide extra coverage in between the cover 800 and the adjacent structure 801. In some embodiments, the fingers 882 may not be attached to the rack 881. The fingers 882 may be formed from a variety of materials. The fingers 882 may be relatively rigid members formed from plastics or polymers. In some embodiments, the fingers 882 may be formed from metals, metal alloys, composites, other suitable materials, or combinations thereof. The fingers 882 may be relatively flexible members formed from a variety of materials, such as flexible plastics or polymers. In some embodiments, the fingers 882 may be formed from mesh material, flexible porous materials, other suitable flexible materials, or combinations thereof. In some embodiments, the fingers 882 may form a porous surface, such as a mesh, over the gap in between the adjacent structure 801 and the cover 800. Therefore, the fingers 882 (as well as the fingers 682 described above) may not be elongated members but instead may be a surface or surfaces that extend from the cover 800 (or the cover 600).

The adjustment mechanism 880 may include one or more slots 884 forming openings 886 therethrough. The slots 884 may receive the fingers 882 into the openings 886. The fingers 882 may retract into and/or expend out from the openings 886 of the slots 884. The openings 886 may extend from one end of the slot 884 to the other, such that the fingers 882 may extend from one end of the slot 884 to the other. In some embodiments, the fingers 882 may protrude from either end of the slots 884 in either the installed or the uninstalled state. By "installed" it is meant that the cover 800 is in use with a drain and that the adjustment mechanism 880 is at least partially covering a space or gap between the cover 800 and the adjacent structure 801. The side of the mechanism 880 that is opposite the rack 881 as oriented may be a removable side that snaps into place. Thus, one or more sides or other portions of the mechanism 880 may be removed from and re-assembled with the mechanism 880. In some embodiments, the aforementioned side or other sides or portions may be removed for installation or coupling of the mechanism 880 with the cover 800.

Figure 8B:
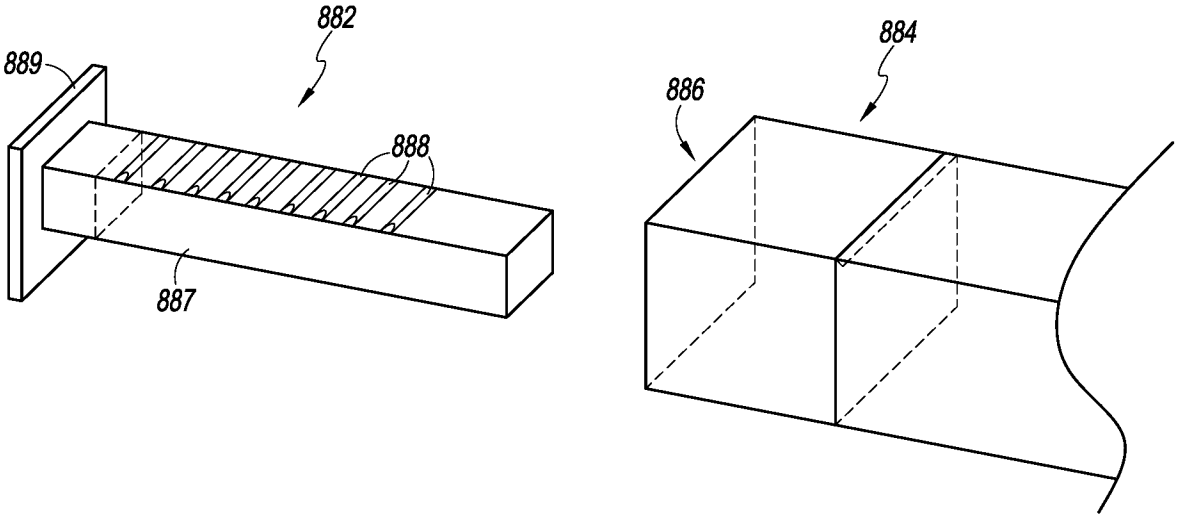
FIG. 8B is an exploded view of a part of the adjustment mechanism of the cover of FIG. 8A.

FIG. 8B is an exploded view of a finger 882 and corresponding slot 884 of the adjustment mechanism 880. As shown, the finger 882 may include an elongated body 887 with a cap 889 attached to an end of the body 887. The body 887 and/or cap 889 may have the respective substantially square cross-sections as shown, or they may have other suitable cross-sectional shapes. The cap 889 may be attached or integral with the body 887. The cap 889 may provide a larger area in order to control the movement of the finger 882. The cap 889 may prevent the finger 882 from extending beyond a specified limit within the slot 884. In some embodiments, the cap 889 is larger than the opening 886 of the slot 884 and is thus prevented from entering the slot 884. The body 887 may have one or more notches 888. As shown, the notches 888 may be oriented substantially transversely along the length of the body 887 on a side thereof. The notches 888 may assist with locating and/or securing the fingers 882 at a particular location within the slots 884. For instance, complementary protrusions on the inside of the slots 884 may be received by the notches 888 of the finger 882 as the notches 888 slide or otherwise move in or out of the opening 886 of the slot 884. The notches 888 may be locked into place by such protrusions such that the finger 882 is prevented from further movement into or out of the opening 886 of the slot 884. In some embodiments, the notches 888 may engage with various parts of the mechanism 880 to lock the finger 882 into place but allow the finger 882 to be moved from the locked position by providing enough force to the finger 882 such that the notch 888 disengages from the part to which it is locked. In some embodiments, the notches 888 may be on other parts of the mechanism 820 besides the fingers while the complementary engagement feature for the notches 888 maybe located on the finger 882. Further, the notches 888 or other engagement features of the finger 882 may be located along one side of the body 887 as shown, and/or along other sides. For example, the notches 88 may, in addition or alternatively, be located on an underside or lateral side of the body 887 as oriented. Thus, the embodiments shown and described are merely some examples, and other suitable variations may be implemented.

Figure 9B:
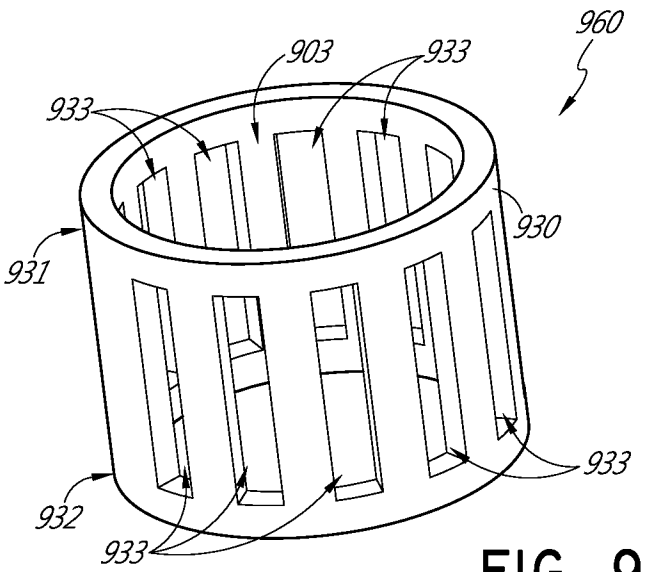
FIG. 9B is a perspective view of the pipe stem of FIG. 9A.
Figure 9A:
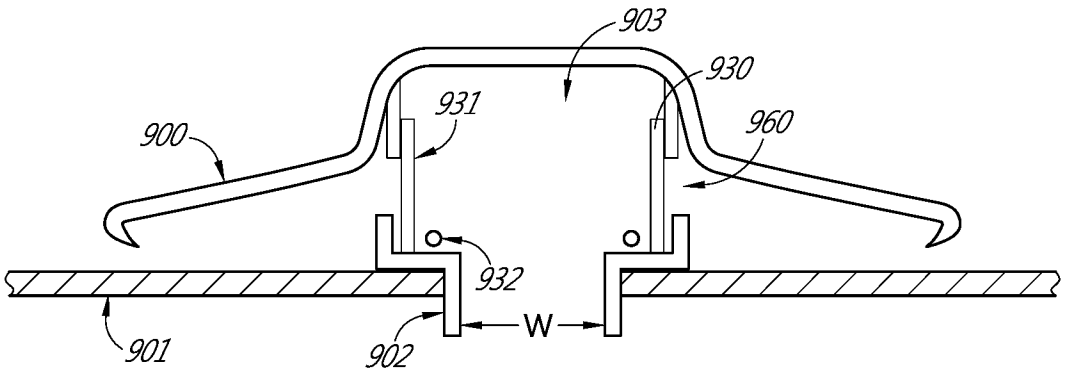
FIG. 9A is a front cross-section view of an embodiment of a pipe stem that connects a cover with a drain body.

FIG. 9A is a front cross-section view of an embodiment of a pipe stem 960 that connects a cover 900 with a drain body 902. FIG. 9B is a perspective view of the pipe stem 960. The cover 900 may be any of the covers described herein. The drain body 902 is adjacent to a mounting surface 901, such as a roof. The pipe stem 960 may have a sidewall 930, which may be arcuate. The sidewall 930 may define a channel 903. The channel 903 maybe an opening or otherwise open space or spaces in between and at least partially enclosed or otherwise defined by the sidewall 930. The sidewall 930 may have the same or similar features as other sidewalls described herein, for example the sidewall 130 of cover 100. The sidewall 930 may be circular in shape. The shape of the sidewall 930 may be configured to connect with the drain body 902 and/or the cover 900. The shape of the sidewall at a first end 931, which may be a top end, of the pipe stem 960 may differ from the shape of the sidewall 930 at a second end 932 of the pipe stem 960, which may be a bottom end of the pipe stem 960. In some embodiments, the shape of the ends 931, 932 may be the same. The sidewall 930 may have one or more openings 933 therethorugh (more clearly seen in FIG. 9B). The openings 933 may extend longitudinally between the ends 931,932 of the pipe stem 960. In some embodiments, the openings 933 may extend laterally. In some embodiments, the openings 933 may be formed by a grid of longitudinal and lateral elements of the sidewall 930. Therefore, a variety of configurations may be implemented for the openings 933. The openings 933 in the sidewall 930 allow fluid to pass through the sidewall 930 and into the channel 903. The pipe stem 960 may be formed from a variety of suitable materials, including plastics, polymers, composites, metals, other suitable materials, or combinations thereof. The pipe stem 960 may be formed from the same, monolithic piece of material. In some embodiments, there may be multiple segments that form the pipe stem 960.

As further described below, the pipe stem 960 may be formed of several moveable parts.

The pipe stem 960 may be configured to couple with, for example by snap fit to, the drain body 902 and/or cover 900. In some embodiments, one or both ends 931, 932 of the pipe stem 960 may have threads and be configured to screw into the drain body 902 and/or cover 900. In some embodiments, the pipe stem 960 may have one or more clips, which may be configured to couple one or both ends 931, 932 of the pipe stem 960 with the drain body 902 and/or cover 900. The pipe stem 960 may attach to the drain body 902 and/or cover 900 by other known methods, such as with fasteners, adhesive, friction fit, interference fit, etc. Further, combinations of the various attachment techniques may be implemented. For instance, the first end 931 may have threads and the second end 932 may snap fit, etc. In some embodiments, the pipe stem 960 may be used in combination with a mounting collar, such as those described herein, to attach the cover 900 to the mounting surface 901. The pipe stem may be one, two, three, four, or five inches tall. In some embodiments, the pipe stem may be any lesser, intermediate or greater height. The pipe stem 960 may be adjustable lengthwise, for instance so that the cover 900 may contact the mounting surface 901. In some embodiments, the pipe stem 960 is segmented and can increase or decrease the distance between the first and second ends 931, 932. For example, the pipe stem 960 may have two or more telescoping pieces that can move relative to each other to increase or decrease the distance between the first end 931 and the second end 932. Thus, the pipe stem 960 may expand or contract to accommodate various sizes and shapes of covers, mounting surfaces, drain bodies, etc.

The various drain covers disclosed herein, such as the covers 100, 1200 or others, may have widths that are larger than the drain opening. As shown in FIG. 9A, the drain opening may have a width W. The width W may be the maximum width of the drain and/or drain opening. The width W may be the width of the drain body 902. The width W may be other dimensions of various drains. The cover may have a width that is larger than W. For instance, the cover dimensions R1, R2, D1, D2, R3, D3, as described herein, may be larger than W. In some embodiments, these or other cover dimensions may be much larger than W. For example, the dimensions R1, R2, D1, D2, R3, D3, or other dimensions of the covers described herein, may be greater than or equal to W, greater than or equal to one and a half times W (i.e., 1.5×W), greater than or equal to twice W (i.e., 2×W), greater than or equal to three times W (i.e., 3×W), greater than or equal to four times W (i.e., 4×W), greater than or equal to five times W (i.e., 5×W), or any smaller, intermediate or larger multiples of W.

Figure 10:
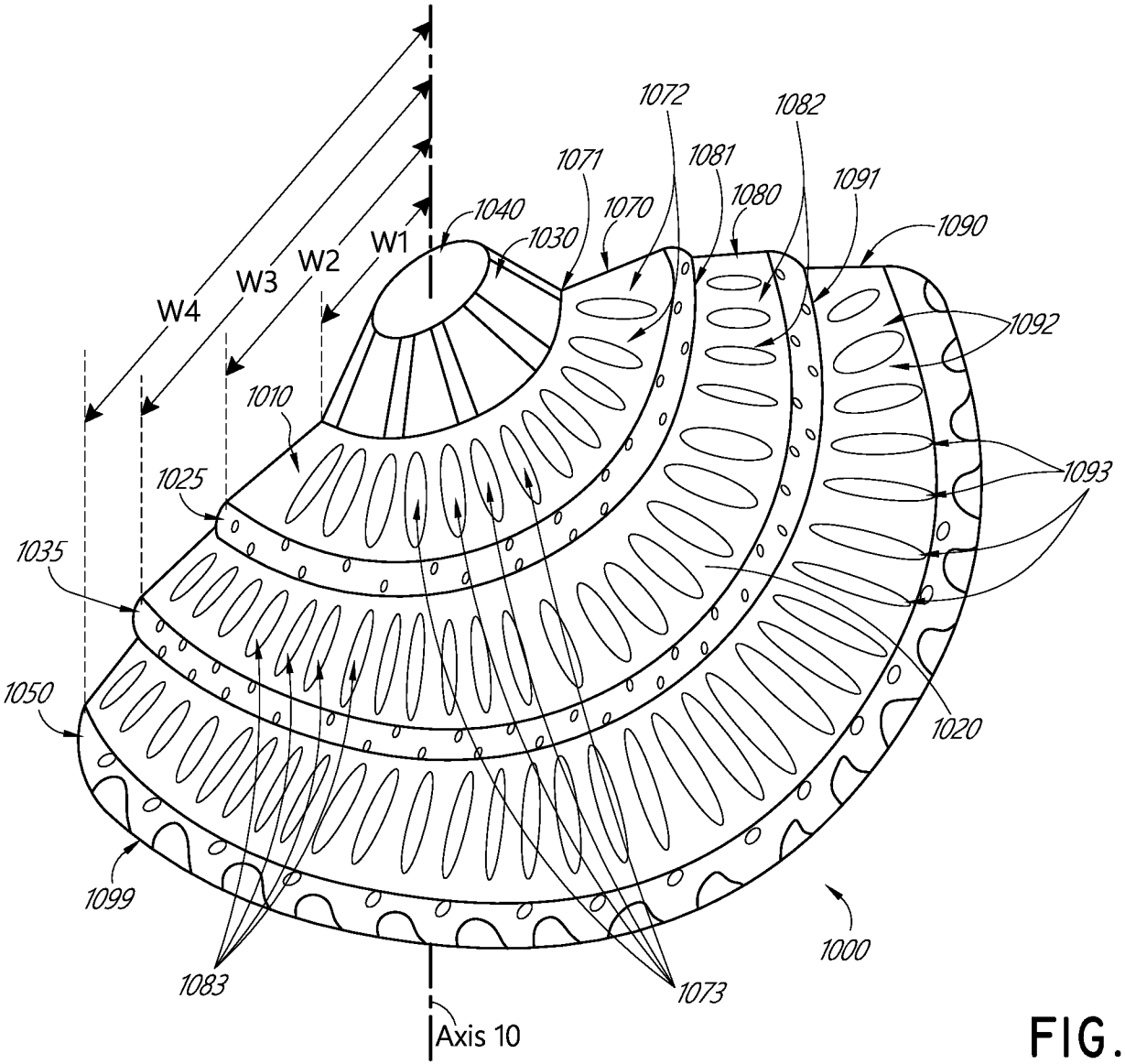
FIG. 10 is a perspective view of another embodiment of a cover for a drain including an embodiment of a skirt with multiple levels.

FIG. 10 is a perspective view of an embodiment of a cover 1000 having multiple levels. The cover 1000 may have the same or similar features and/or functionalities as other covers described herein, for example the cover 100, 300, 400, 500, 600, 700, 800, and/or 900. As shown in FIG. 10, the cover 1000 may have a body 1010 with various portions. As shown, the body 1010 may include a skirt 1020 coupled with a dome 1030, which may be coupled with a top 1040. These portions may have the same or similar features and/or functionalities as other covers described herein, for example the cover 100, 300, 400, 500, 600, 700, 800, and/or 900. As shown in FIG. 10, the skirt 1020 may include an upper level 1070, intermediate level 1080, and a lower level 1090. In other embodiments, the skirt 1020 may have fewer or more than three levels. For example, there may be one, two, four, five, six, seven, eight, nine, or greater amounts of levels. These are merely some examples and are not meant to be self-limiting.

Each level 1070, 1080, 1090 of the skirt 1020 may include one or more ribs 1072, 1082, 1092, respectively. Each level 1070, 1080, 1090 may include the portions 1071, 1081, and 1091, respectively. The ribs 1072, 1082, 1092 may form parts of the upper portion 1071, intermediate portion 1081, and lower portion 1091, respectively. The ribs 1072, 1082, 1092 may be elongated members coupled with the portions 1071, 1081, and 1091, respectively, and extending outward therefrom. The ribs 1072, 1082, 1092 may couple with the portions 1071, 1081, and 1091, respectively, and extend radially outward therefrom. There may be multiple ribs 1072, 1082, 1092. There may be twenty-eight ribs 1072 in the upper level 1070, forty-eight ribs 1082 in the intermediate level 1080, and sixty-eight ribs 1092 in the lower level 1090 (only some are visible in FIG. 10). In some embodiments, there may be fewer or more ribs 1072, 1082, 1092. For example, there may be ten, twenty, thirty, forty, fifty, sixty, seventy, eighty, ninety, one hundred, one hundred fifty, two hundred, five hundred, or other intermediate, lower or greater amounts of ribs 1072, 1082, 1092. These are merely some examples and are not meant to be self-limiting. The number of ribs 1072, 1082, and 1092 may be different from or may be the same or similar to each other. The ribs of one level may connect or couple with the ribs of another level.

The ribs 1072, 1082, 1092 may have a generally U-shaped cross-section. In some embodiments, the ribs 1072, 1082, 1092 may have other shaped cross-sections, such as C-section, shallow U- or C-section, rectangular, square, rounded shapes such as circular, elliptical, arcuate, or other shapes, polygonal shapes, segmented shapes, hollow cross-section, solid cross-section, partially hollow and partially solid cross-section, and/or combinations thereof. The shape of the ribs 1072, 1082, 1092 may be different from or may be the same or similar to each other.

The ribs or other features of the skirt 1020 may define one or more spaces 1073, 1083, 1093. The spaces 1073, 1083, 1093 may have the same or similar features and/or functionalities as other spaces described herein, for example the lower spaces 124, upper spaces 134, etc. As shown in FIG. 10, the spaces 1073, 1083, 1093 may be formed in the upper level 1070, intermediate level 1080, and the lower level 1090, respectively. For clarity, only some of the spaces 1073, 1083, 1093 are labelled in the figure. The spaces 1073, 1083, 1093 may be openings allowing fluid to pass through the respective level. The spaces 1073, 1083, 1093 may have a variety of shapes and sizes, and they need not all be the same or similar shapes and sizes as each other.

The cover 1000 may include one or more transition segments 1025 and 1035 and an outer ring 1050. The upper transition segment 1025 may couple the intermediate level 1080 with the upper level 1070. The lower transition segment 1035 may couple the lower level 1090 with the intermediate level 1080. The transition segments 1025 and 1035 may have a generally curved contour. In some embodiments, the transitions segments 1025 and 1035 may have a sharper contour, may be segmented, may be partially round and partially straight, may be other shapes, or may be combinations thereof. The shapes of the transition segments 1025 and 1035 may be different or the same or similar. The top 1040 may also have a curvature when viewed from the side. The top 1040 may be coupled with the dome 1030 and/or other structures.

Transition segments 1025 and 1035 may have the same or similar features and functionalities as the sidewall 130 of cover 100. The transition segments 1025 and 1035 may include one or more transition ribs. The transition ribs may be elongated members extending along the transition segment from an upper level to a lower level. The transition ribs may be elongated with a generally rectangular or square cross-section. However, the transition ribs may have a variety of other shaped cross-sections such as described with the ribs 1072, 1082, and 1092.

Transition segments 1025 and 1035 and/or the outer ring 1050 may have the same or similar features and/or functionalities as the outer ring 150 of cover 100. The transition segments 1025 and 1035 and the outer ring 1050 may include a variety of slots, holes, and/or openings that have the same or similar features and functionalities as the slots 153, holes 154, and/or openings 155 of cover 100. The slots may be elongated spaces within the transition segment and/or outer ring and extending therethrough. The holes may be generally circular spaces extending through the transition segment and/or outer ring. The openings may be partially circular spaces extending through the transition segment and/or outer ring.

Transition segment 1025 may include the intermediate portion 1081. Transition segment 1035 may include the lower portion 1091. In some embodiments, the transition segments 1025 and 1035 may be formed from the same monolithic piece of material as the portions 1081 and 1091. In some embodiments, the transition segments 1025 and 1035 and the skirt levels 1070, 1080, and 1090 are formed from the same monolithic piece of material. However, the transition segments 1025 and 1035 may also be coupled with the portions 1081 and 1091 and/or skirt levels 1070, 1080, and 1090 in a variety of ways, such as with mechanical attachments, adhering, fastening, bonding, or other suitable means.

The skirt 1020 may flare outward and downward from the upper portion 1071 to an outer perimeter 1099 in a first direction that is generally away from the central axis 10 and generally away from the dome 1030. As shown in FIG. 10, the skirt levels 1070, 1080, and 1090 may extend in generally parallel directions. In some embodiments, the skirt levels 1070, 1080, and 1090 may extend in generally non-parallel directions. The lower level 1090 may flare outward and downward more steeply or more gradual than the other levels 1070, 1080, or vice versa.

The levels 1070, 1080, and 1090 of the skirt 1020 may have a variety of different cross-sections that are extruded in a generally arcuate manner about the axis 10. These shapes may be square, rectangular, circular, rounded, polygonal, other shapes, or combinations thereof. The levels 1070, 1080, and 1090 may have different shapes from each other. In some embodiments, the levels 1070, 1080, and 1090 may have the same or similar shapes as each other.

The upper portion 1071, intermediate portion 1081, lower portion 1091 and outer edge 1099 may be located approximately a perpendicular distance W1, W2, W3 and W4, respectively, from the axis 10. W1, W2, W3 and W4 may each be a dimension equal to roughly half of the total width of the upper portion 1071, intermediate portion 1081, lower portion 1091 and outer edge 1099, respectively. The distances W1, W2, W3 and W4 may be a radius. However, the upper portion 1071, intermediate portion 1081, lower portion 1091 and outer edge 1099 need not be circular, and thus in some embodiments the distances W1, W2, W3 and/or W4 may not be a radius. W1, W2, W3 and W4 may be measured perpendicularly from the axis 10 to any region of the respective portion or edge, including to regions of the portions or edge that are relatively closer or farther from the axis 10 than other regions of the portions or edge. Further, the dimensions W1, W2, W3 and W4 of the cover 1000 need not be constant as measured at different angular locations about the axis 10. For example, the portions 1071, 1081, and 1091 or outer edge 1099 may be arcuate but with straight outer edges such that the cover 1000 appears square, rectangular, other polygonal shapes, etc. as viewed from the top. For such a shape, W1, W2, W3 and W4 would vary depending on which angular location the dimension is measured. Thus, W1, W2, W3 and W4 may vary as measured at different angular locations about the axis 10.

Figure 11A:
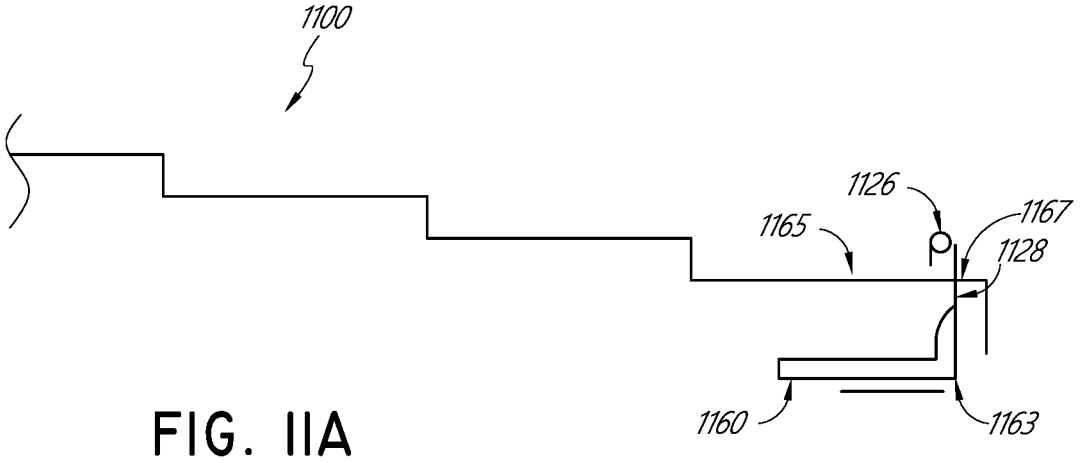
Figure 11B:
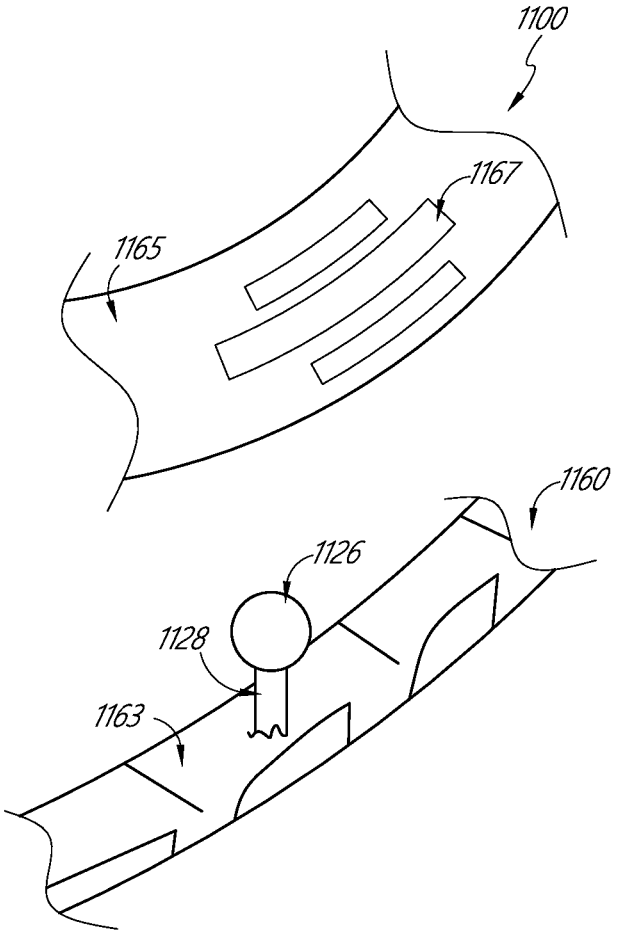

FIGS. 11A and 11B depict various views of a mount 1160 that may be used with the various covers described herein, such as the cover 1100 as shown. The mount 1160 may have the same or similar features and/or functionalities as other mounts described herein, for example the mounts described with respect to covers 100, 300, 400, 500, 600, 700, 800, and/or 900. The mount 1160 may secure the cover 1100 to a mounting surface, such as a roof or floor. The mount 1160 may include an insert 1126 coupled with the mounting collar 1163. The insert 1126 may be a protrusion of the mounting collar 1163 configured to couple with a housing structure 1165 of the cover 1100 and thereby secure the body of the cover 1100 to the mount 1160. As shown in FIG. 11B, the insert 1126 may have a ball shape. In some embodiments, the insert may have a generally spherical shape, elliptical, or other three dimensional shape. The insert 1126 may be coupled to the mounting collar 1163 or other features of the mount 1160 by a neck 1128. The neck 1128 may be a thinner or skinnier portion of the insert 1126 that facilitates securing the insert 1126 with various features of the cover 1100, such as a housing structure 1165.

As shown in FIGS. 11A and 11B, the cover 1100 may have a housing structure 1165. The housing structure 1165 may be a structure of the cover 1100 configured to couple with or otherwise attach to the insert 1126 and/or neck 1128. The housing structure 1165 may form one or more openings 1167 extending through the housing structure 1165. The housing structure 1165 and opening 1167 are configured to allow the insert 1126 to pass through and then close about the insert 1126 or portions thereof. The insert 1126 may pass partially or completely through the opening 1167. As shown in FIG. 11A the insert 1126 may pass completely through the cover such that the insert 1126 is adjacent the cover 1100. The housing structure 1165 may be formed of flexible or otherwise resilient material such that it can flex to receive insert 1126 therein. The insert 1126 slides into the opening 1167 from below. The housing structure 1165 and/or insert 1126 and/or neck 1128 may be plastic, polymer, composite, metal, other materials, or combinations thereof. The configuration shown is merely one example and many other suitable configurations may be implemented.

Figure 12A:
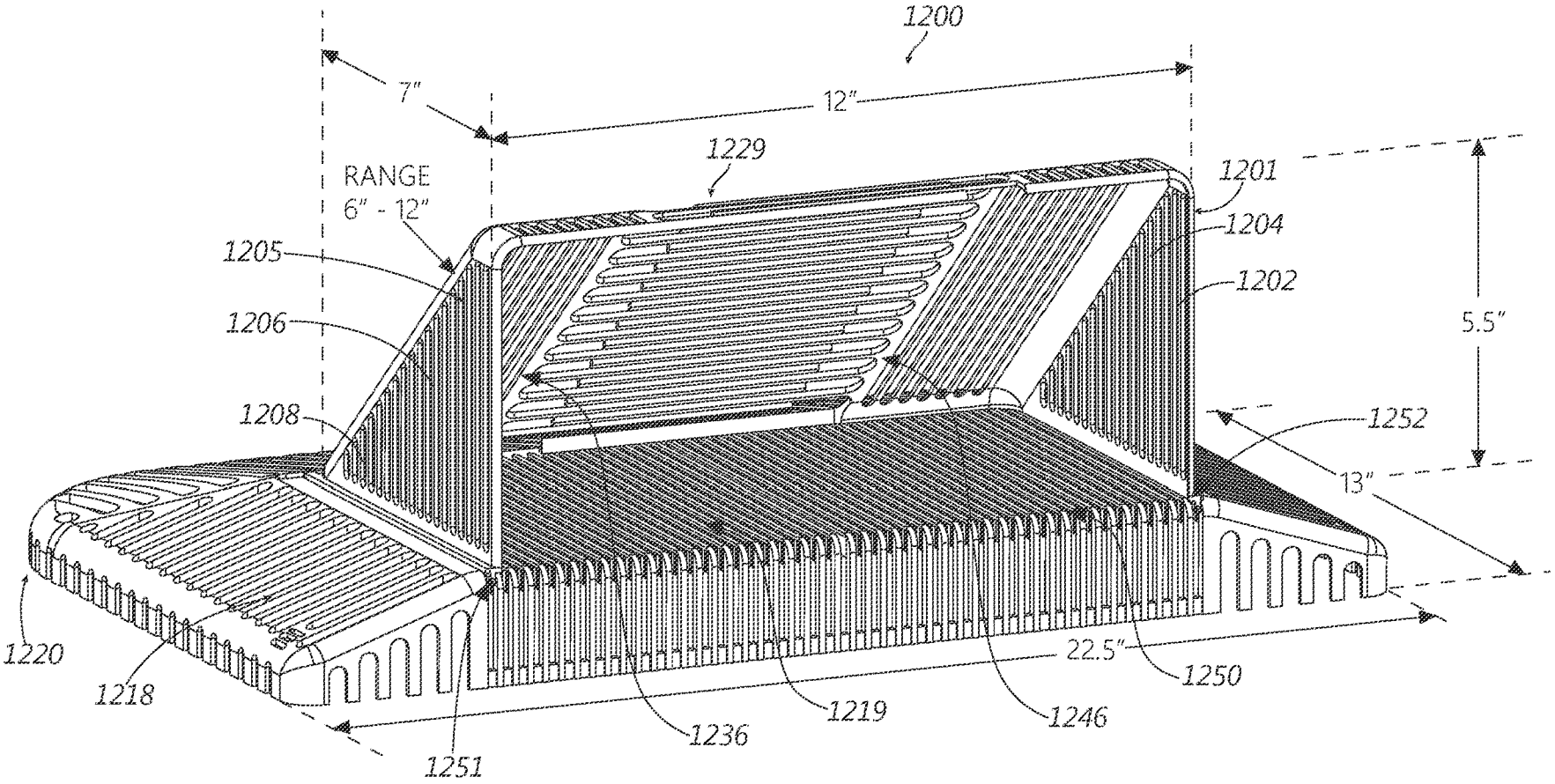
FIG. 12A is a front perspective view of an embodiment of an adjustable cover for a drain including embodiments of a skirt and moveable first and second dome portions.
Figure 12B:
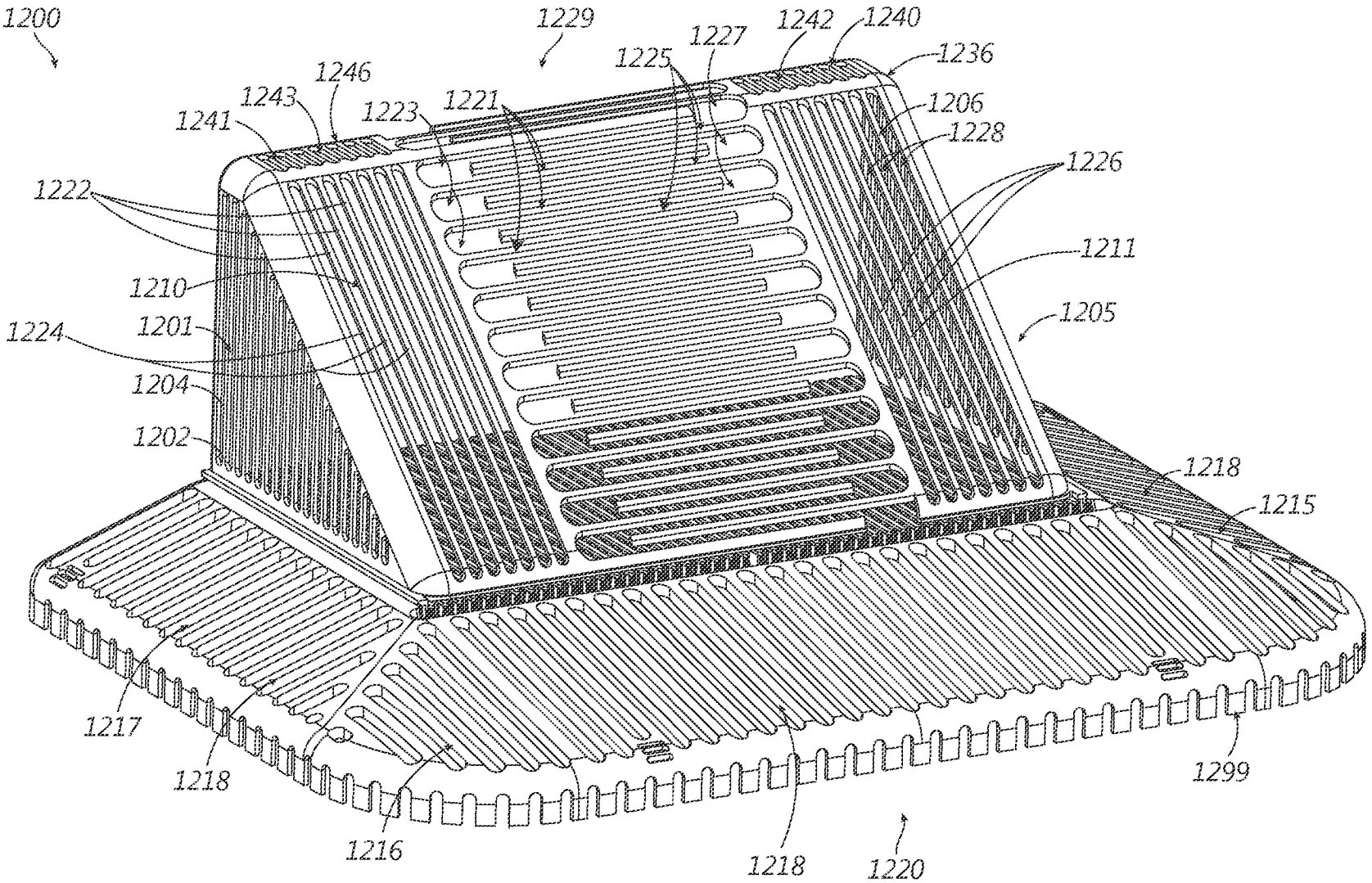
FIG. 12B is a rear perspective view of the skirt of FIG. 12A.

FIGS. 12A-12J are various views of a cover 1200 and/or portions thereof. FIG. 12A is a front perspective view of the cover 1200. FIG. 12B is a rear perspective view of the cover 1200. The cover 1200 may include a skirt 1220 and a dome 1229. The dome 1229 may include one or more dome portions. As shown, the dome 1229 may include a first dome portion 1236 and a second dome portion 1246. The cover 1200 may have the same or similar features and/or functionalities as any of the covers disclosed herein, such as the cover 100, 300, 400, 500, 600, 700, 800, 900, 1000, and/or 1100. The first and second dome portions 1236 and 1246 may have the same or similar features and/or functionalities as the domes of covers 100, 300, 400, 500, 600, 700, 800, 900, 1000, and/or 1100. The skirt 1220 may have the same or similar features and/or functionalities as the skirts of covers 100, 300, 400, 500, 600, 700, 800, 900, 1000, and/or 1100.

Each dome portion 1236 and 1246 may have a top 1240 and 1241, side 1205 and 1201, and back 1211 and 1210, respectively. The top 1240 and 1241 may have openings 1242 and 1243. The shape of the sides 1201 and 1205 may be polygonal, trapezoidal, rectangular, square, triangular, circular, and/or a combination thereof. The sides 1201 and 1205 may have side ribs 1202 and 1206 and side spaces 1204 and 1208. The shape of the backs 1210 and 1211 may be polygonal, trapezoidal, rectangular, square, triangular, circular, and/or a combination thereof. The backs 1210 and 1211 may have back ribs 1222 and 1226 and back spaces 1224 and 1228.

Figure 12C:
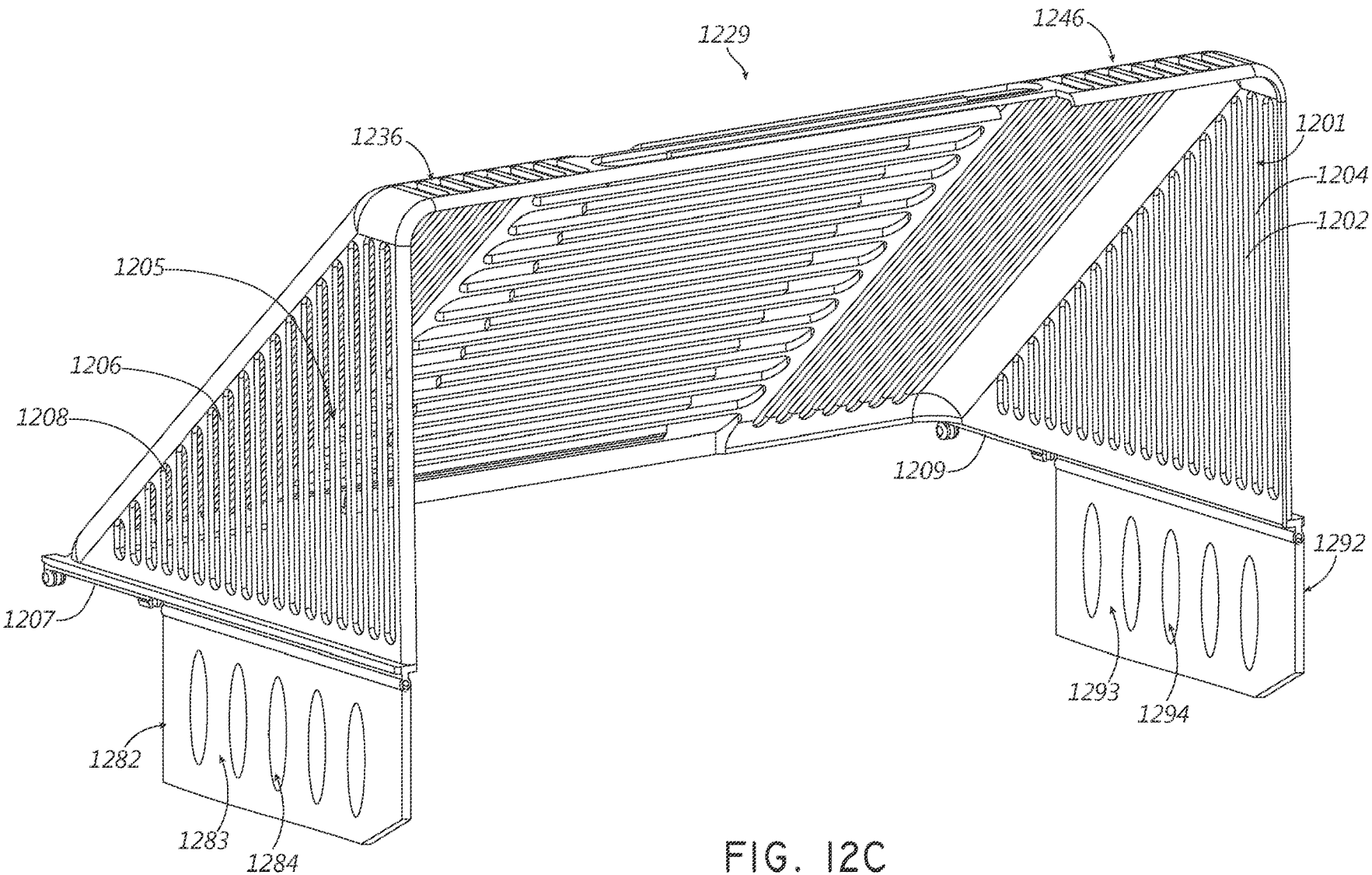
FIG. 12C is a perspective view of the first and second dome portions of FIG. 12A.
Figure 12D:
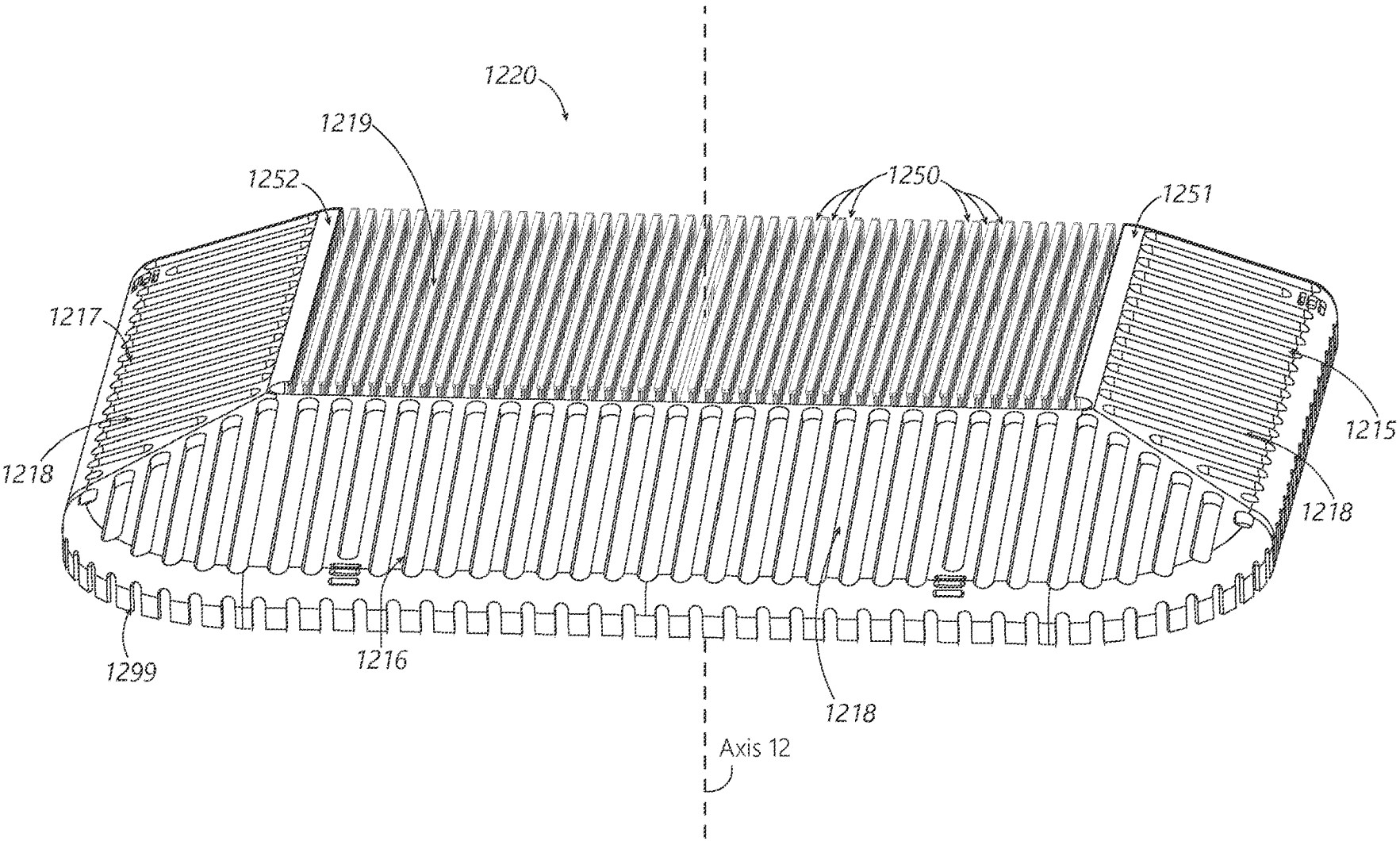
FIG. 12D is a rear perspective view of an embodiment of the skirt of 12A.
Figure 12E:
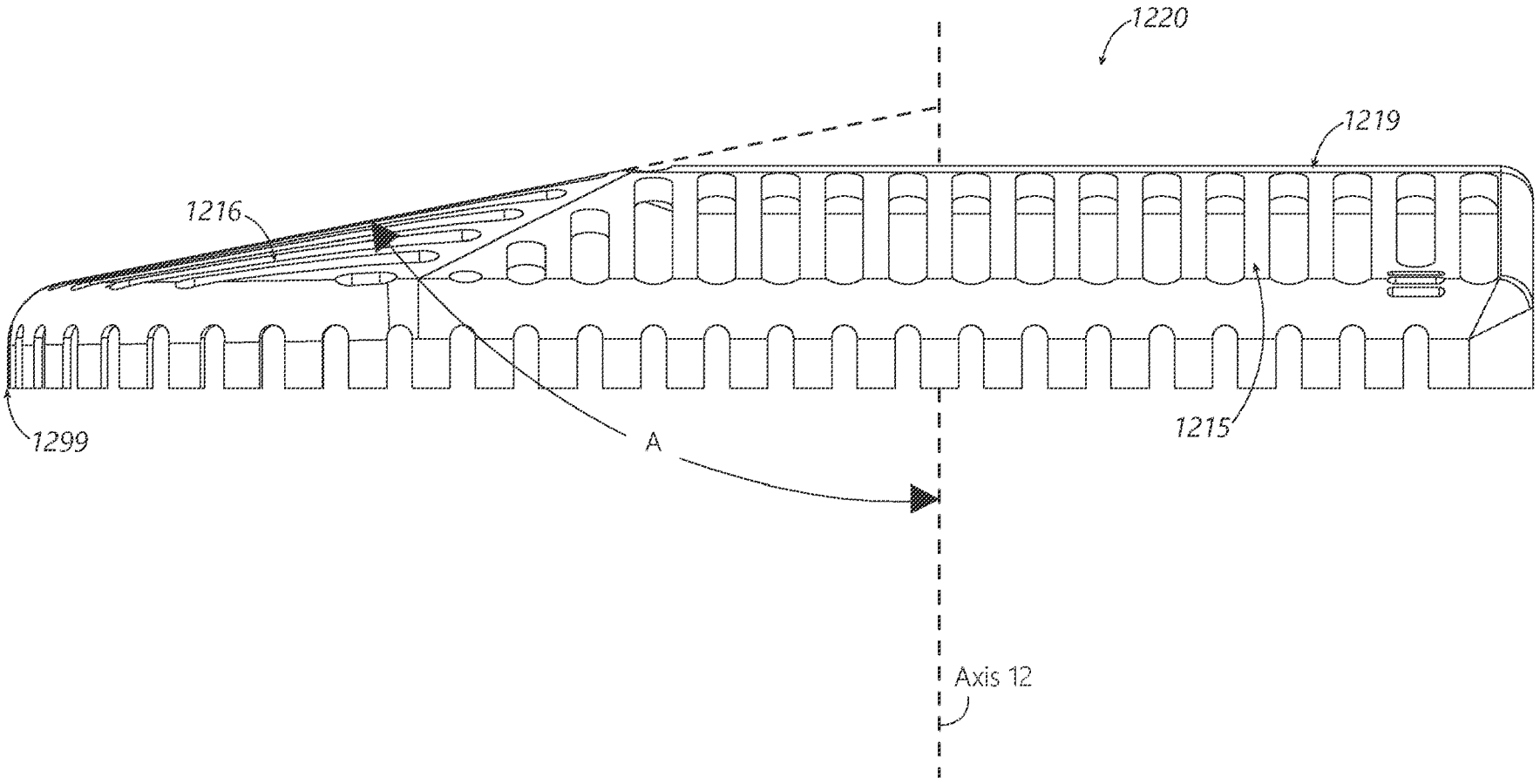
FIG. 12E is a side view of the skirt of 12D.
Figure 12F:
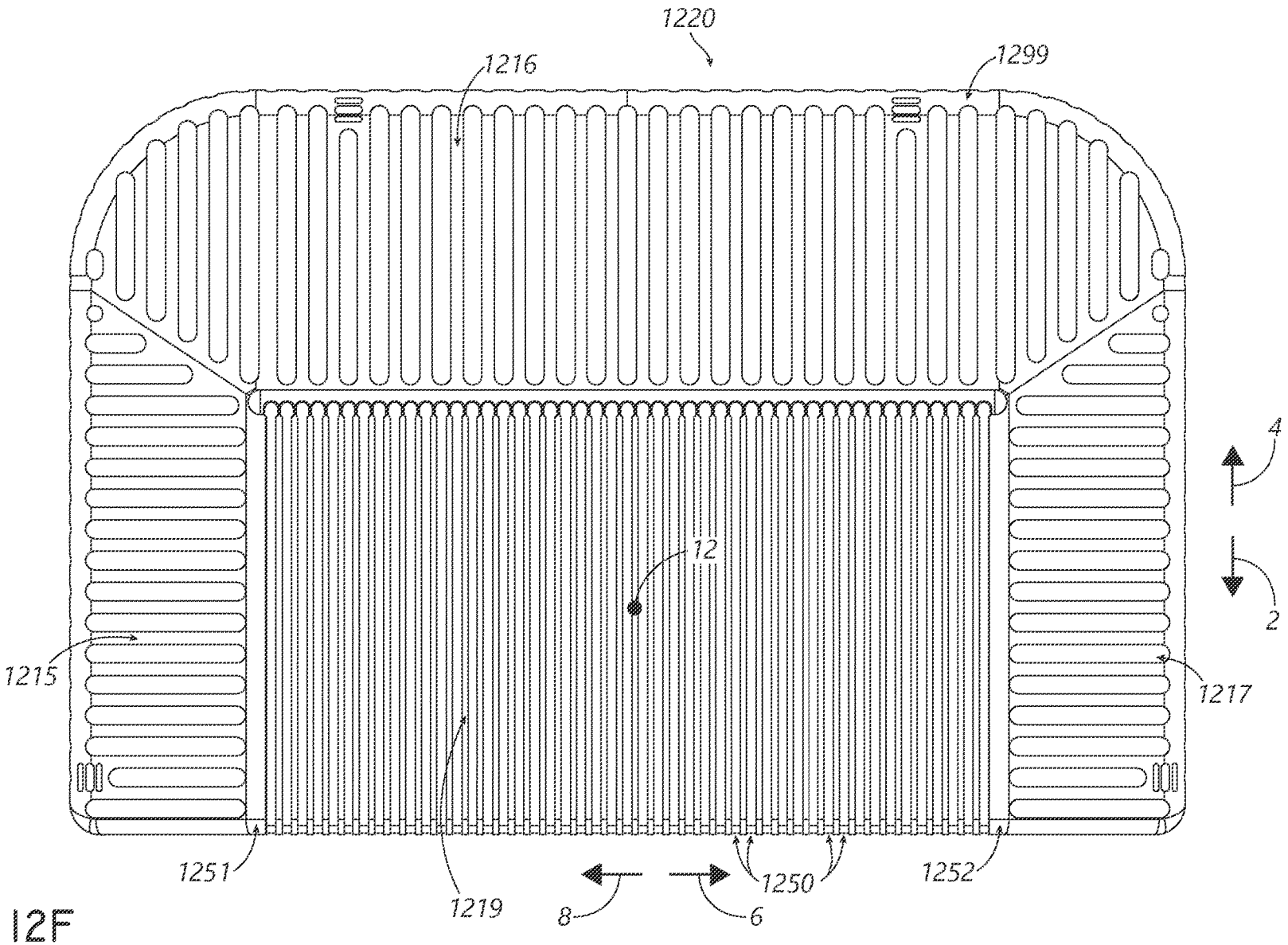
FIG. 12F is a top view of the skirt of 12D.
Figure 12G:
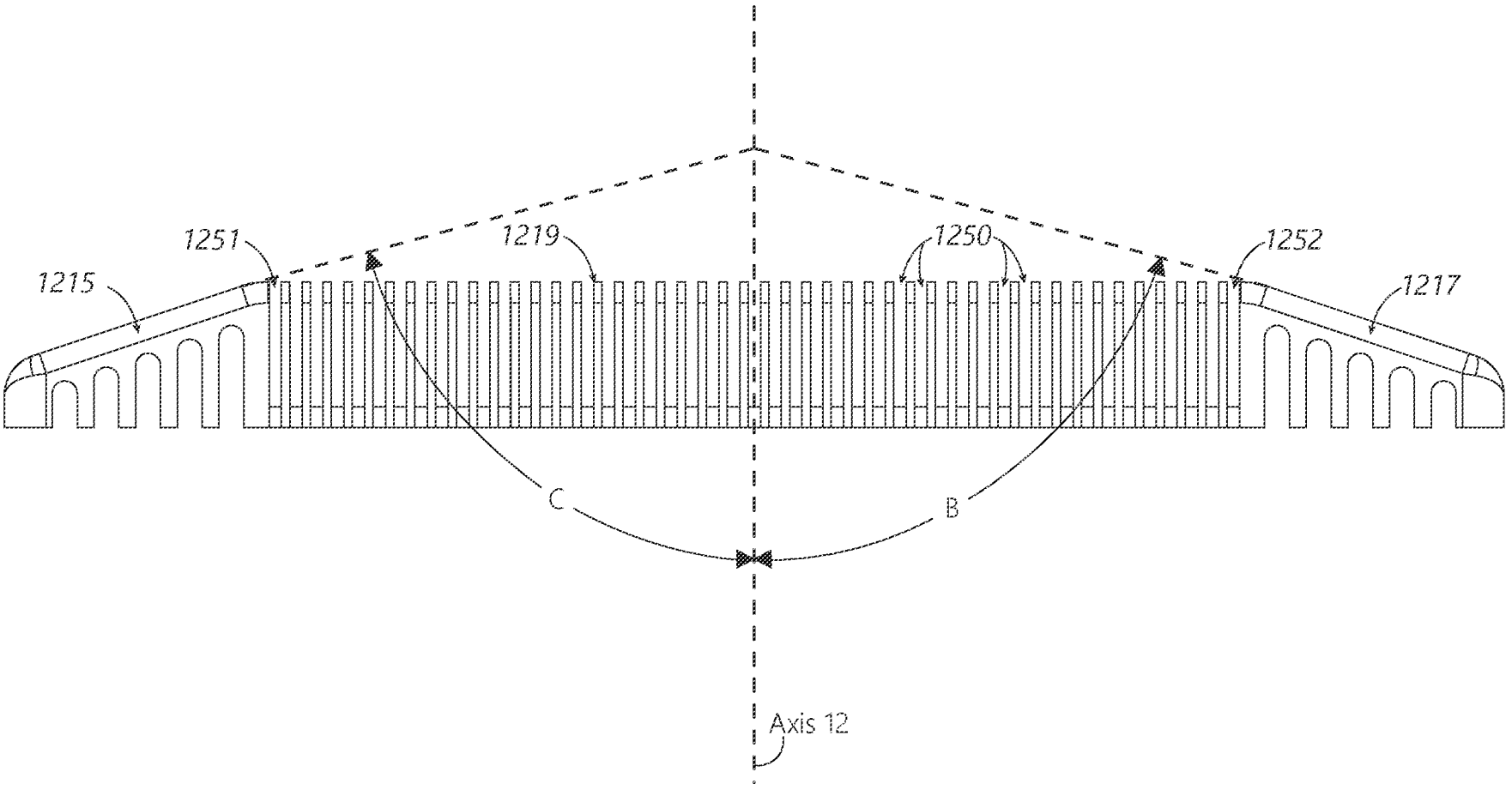
FIG. 12G is a front view of the skirt of FIG. 12D, with a rear portion of the skirt removed for clarity.
Figure 12H:
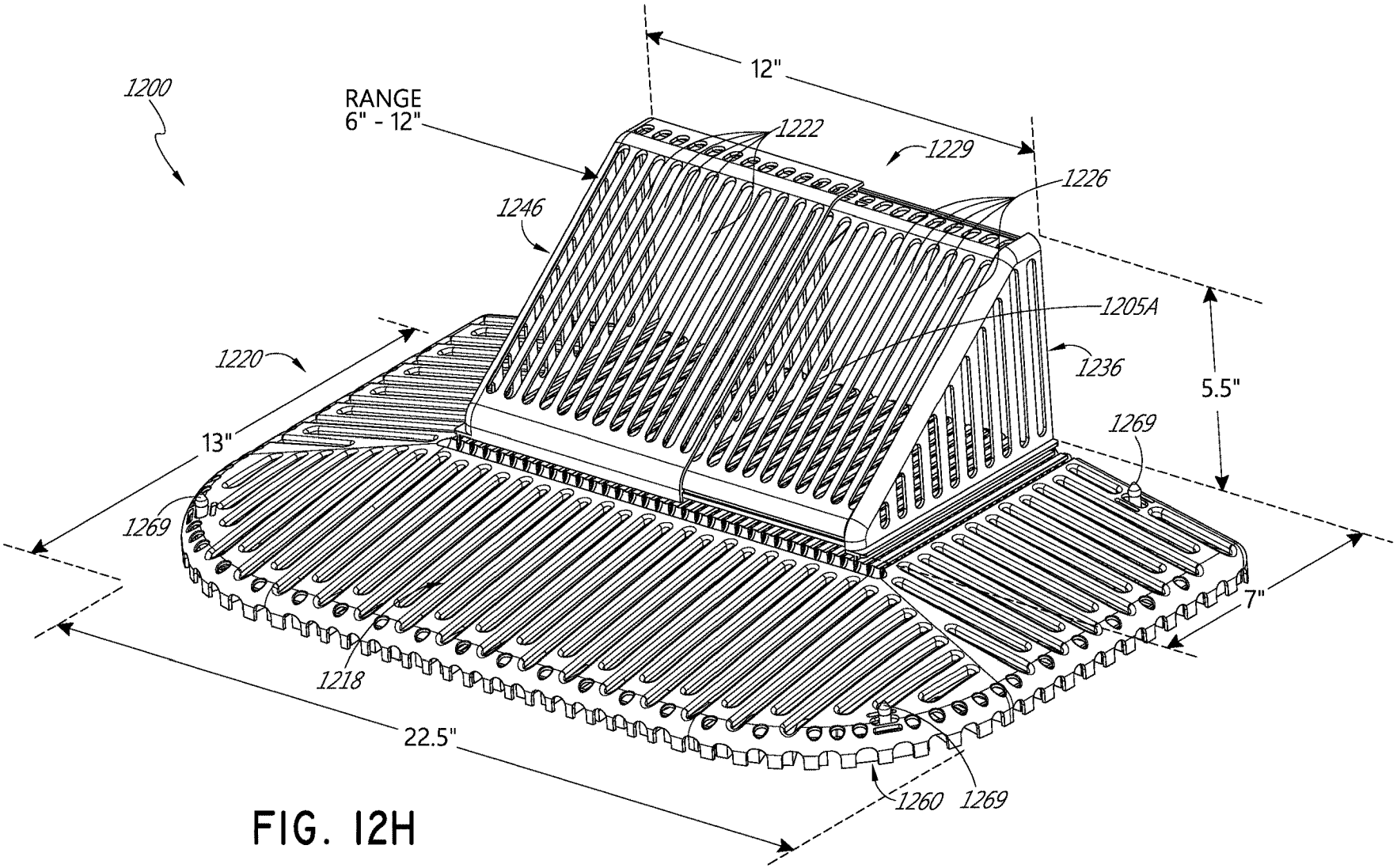
FIG. 12H is a front perspective view of another embodiment of an adjustable cover for a drain including embodiments of a skirt, a mount, and moveable first and second dome portions.
Figure 12I:
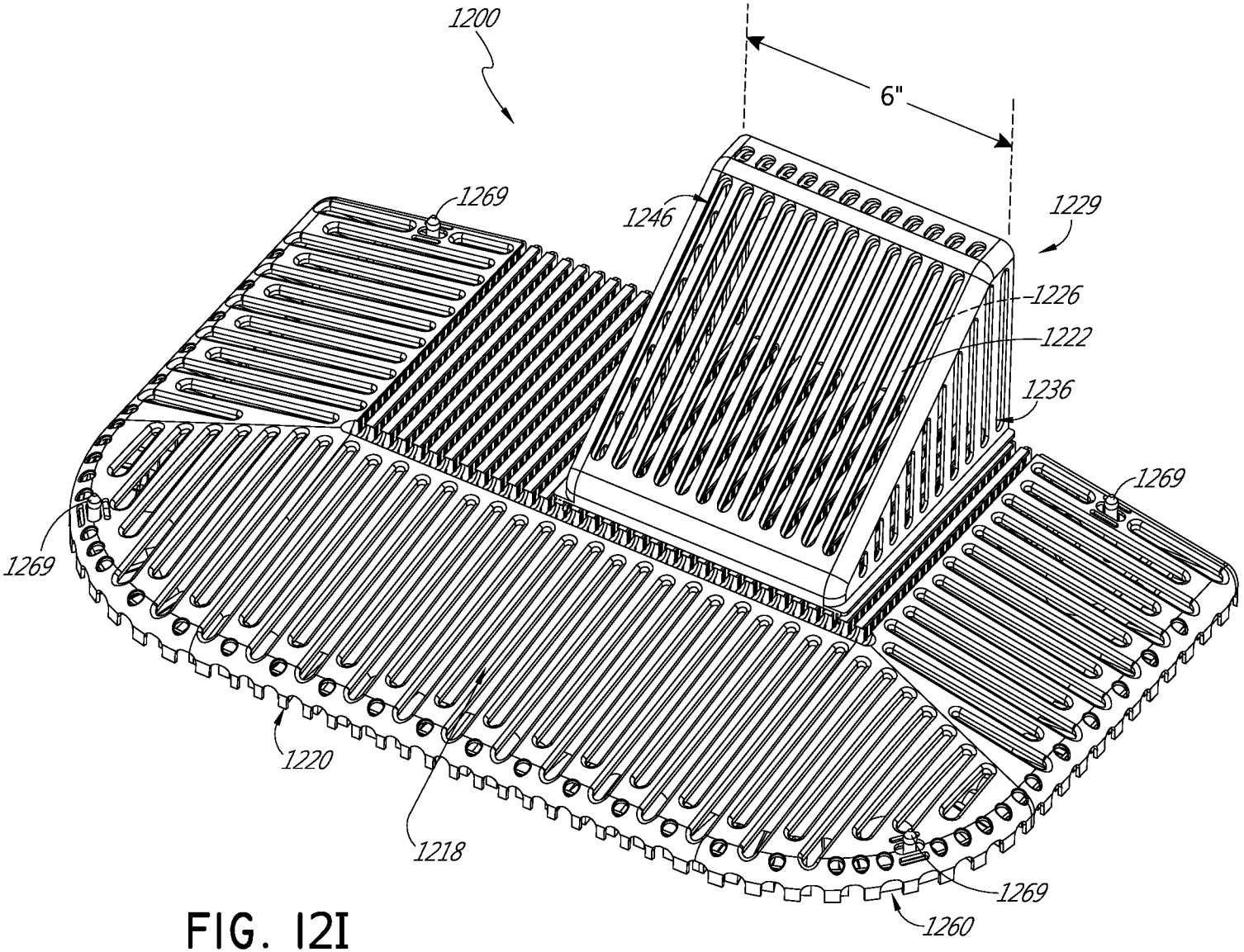
FIG. 12I is a front perspective view of the cover of FIG. 12H with the dome in a contracted configuration.

FIGS. 12B, 12H and 12I show examples of dimensions for various embodiments of the cover 1200. The cover 1200 may have various dimensions based on its application and its configuration. For instance, larger covers 1200 may be used for applications requiring larger drains or drain openings. Smaller covers 1200 may be used for applications that only require smaller drains or drain openings. The covers 1200 shown in FIGS. 12B, 12H and 12I are embodiments that may be used for some drains and drain openings.

As shown, the cover 1200 may have a skirt 1220 having an overall width of about 22.5" and/or an overall depth of about 13." In some embodiments, the cover 1200 may have a skirt 1220 having an overall width from about 8" to about 35" and/or an overall depth from about 5" to about 25".

The flat portion 1219 of the skirt 1220, described below, may have a depth of about 7" and/or a height of about 2". In some embodiments, the flat portion 1219 of the skirt 1220 may have a depth from about 3" to about 20" and a height from about 0.5" to 5".

The dome 1229, for example the dome portions 1236, 1246, may have a depth of about 7". The depth of the dome 1229 may be the same or similar as the depth of the flat portion 1219 of the skirt 1220. The dome 1229, for example the dome portions 1236, 1246, may have a height of about 5.5". In some embodiments, the dome 1229 may have a height from about 3" to about 10".

The dome 1229 from one side of the first dome portion 1236 to the opposite side of the second dome portion 1246 may be adjustable, from about 6" (shown in FIG. 12I) to about 12", depending on the configuration. Thus, the distance between the sides 1201 and 1205, described herein, may be adjustable, for example from about 6" to about 12". In some embodiments, the dome 1229 may have a width from about 3" (shown in FIG. 12I) to about 24".

Each dome portion 1236, 1246 may be about half the width of the overall width of the dome 1229. The dome portions 1236, 1246 may be less, for example slightly less, than half the width of the overall width of the dome 1229. The dome portions 1236, 1246 may be greater, for example slightly greater, than half the width of the overall width of the dome 1229. For instance, the dome portions 1236, 1246 may slightly overlap in most or all configurations. In some embodiments, each dome portion 1236, 1246 may have a width of about 3", 4", 5", 6", 6.25", 7", 8", 9", 10", 11" 12", or any smaller, intermediate or greater value.

FIG. 12C is a perspective view of the first and second dome portions 1236, 1246. The back of each dome portion 1236, 1246 may include ribs 1222, 1226 and/or fingers 1221, 1225, such as those discussed above. In some embodiments, these and other ribs and/or fingers may extend in different directions. For example, the ribs 1222, 1226 may extend vertically, as discussed in further detail with respect to FIGS. 12H-12J. As shown in FIGS. 12A-C, the ribs 1222, 1226 and fingers 1221, 1225 may extend in perpendicular directions. In other embodiments, these and other ribs and/or fingers may extend in generally parallel directions. The fingers 1221 of the second dome portion 1246 may extend towards and fit into the spaces 1227 defined by the first dome portion 1236. The fingers 1225 of the first dome portion 1236 may extend towards and fit into the spaces 1225 of the second dome portion 1246. Together, the fingers 1221 and 1225 of the dome portions 1236 and 1246, are configured to allow fluid to flow through but prevent debris from passing through. The dome portions 1236, 1246 may move relative to each other. For example, the fingers 1221 may be received in the spaces 1227, and the fingers 1225 may be received in the spaces 1223, as the two dome portions 1236, 1246 move relative to each other. Thus the dome portions 1236, 1246 may move closer or farther from each other to change the size of the dome 1229. Further, as discussed below, the dome portions 1236, 1246 may move together in a forward direction 2 or rearward direction 4 (see FIG. 12F), for example to accommodate a scupper drain on a roof.

The dome portions 1236, 1246 may also include one or more tracks to facilitate movement of the dome portions 1236, 1246. As shown, the first dome portion 1236 may include a first track 1207 along an outer, lower perimeter of the first dome portion 1236. Similarly. The second dome portion 1246 may include a second track 1209 along an outer, lower perimeter of the second dome portion 1246. The tracks 1207, 1209 may extend along the outer lower perimeter of the respective dome portions 1236, 1246. The tracks 1207, 1209 may be integral parts of the respective dome portions 1236, 1246. In some embodiments, the tracks 1207, 1209 may be separate components coupled with the respective dome portions 1236, 1246. The tracks 1207, 1209 may be received by various portions of the skirt 1220. The tracks 1207, 1209 may be received by the outer slots 1251, 1252. The tracks 1207, 1209 may be received by the grooves 1250. Receipt of the tracks 1207, 1209 in the various portions of the skirt 1220 may allow the tracks 1207, 1209 to move in a forward direction 2 and rearward direction 4 (see FIG. 12F). For instance, the cover 1200 may be placed next to a parapet wall having a scupper drain and a cant strip protruding from the wall, wherein the skirt 1220 may be placed adjacent the cant strip and the dome 1229 may be moved in the forward direction 2 to move closer to and/or cover the scupper drain.

In some embodiments the cover 1200 further comprises an attachment 1282 and/or 1292. The attachments 1282, 1292 may couple with the first and/or second dome portions 1236 and 1246, respectively. The attachments 1282 and 1292 may define spaces 1284 and 1294 that allow fluid to pass through the attachments 1282, 1292. In some embodiments, the attachments 1282 and 1292 may include ribs 1283 and 1293 that define the spaces 1284, 1294 therebetween. In some embodiments, the attachments 1282, 1292 may provide an extended portion of the dome portions 1236 and 1246 and/or the skirt 1220, and/or any other portions of the cover 1200. The attachments 1282, 1292 may provide further skirt- or dome-like structure (i.e. filtering structure) in between the cover 1200 and an adjacent structure, such as a scupper or parapet wall. The shape of the attachment 1282 is configured to fill a gap that may be created between the cover and an adjacent structure (such as a scupper), for example when the dome portions 1236, 1246 are moved in a forward direction 2 (shown in FIG. 12F). The shape of the attachments 1282, 1292 may be polygonal, trapezoidal, rectangular, square, triangular, circular, and/or a combination thereof. In some embodiments, the shape of the attachment is configured to accommodate a cant strip.

The attachments 1282 and 1292 may be formed from a variety of materials. The attachments 1282, 1292 may be formed from the same or similar materials as the other parts of the cover, such as the dome or skirt 1220. The attachments 1282 and 1292 may be a relatively rigid member formed from plastics or polymers. In some embodiments, the attachments 1282 and 1292 may be formed from metals, metal alloys, composites, other suitable materials, or combinations thereof. The attachments 1282 and 1292 may be a relatively flexible member formed from a variety of materials, such as flexible plastics or polymers. In some embodiments, the attachments 1282 and 1292 may be formed from mesh material, flexible porous materials, other suitable flexible materials, or combinations thereof. In some embodiments, the attachments 1282 and 1292 may form a porous surface, such as a mesh, over the gap in between the adjacent structure and the cover 1200. Therefore, the attachments 1282 and 1292 may not be an elongated member but instead may be a surface or surfaces that extend from the cover 1200. The attachments 1282 and 1292 may snap or slide into place. The attachments 1282 and 1292 may connect or couple to a dome portion by any known method, such as adhesive, interference, friction fit, etc.

FIGS. 12D-12F are various views of the skirt 1220. FIG. 12D is a rear perspective view of the skirt 1220, FIG. 12E is a side view of the skirt 1220, and FIG. 12F is a top view of the skirt 1220. The skirt 1220 may include a flat portion 1219 and angled portion 1218. The angled portion 1218 may comprise one or more sub-portions. As shown, angled portion 1218 may include a first angled sub-portion 1217, a second angled sub-portion 1216, and a third angled sub-portion 1215. In some embodiments, the angled portion 1218 may have more or fewer than three sub-portions. As shown, the first angled sub-portion 1217 may be oriented angularly 90° about the axis 12 with respect to the second angled sub-portion 1216. The second angled sub-portion 1216 may be oriented angularly 90° about the axis 12 with respect to the third angled sub-portion 1215. This is merely an example and the sub-portions may be positioned in a variety of suitable locations relative to each other.

The skirt 1220 may include one or more grooves 1250 and/or outer slots 1251 and 1252. The flat portion 1219 may include multiple grooves 1250, for example about twenty-eight grooves 1250. In some embodiments, the flat portion 1219 may include from about ten grooves 1250 to about sixty grooves. In some embodiments, there may be fewer than ten or more than sixty grooves 1250. The grooves 1250 may extend along the flat portion 1219 from a rear region to a front region of the flat portion 1219. In some embodiments, the grooves 1250 may extend in different directions. For example, the grooves may extend along the flat portion 1219 from the angled sub-portion 1217 to the angled sub-portion 1215, in a diagonal direction, etc. In some embodiments, the grooves 1250 may extend partially or completely along the flat portion 1219. In some embodiments, the grooves 1250 may comprise discrete sub-portions or extend continuously.

The dome portions 1236, 1246 may move in various directions. The dome portions 1236, 1246 may move in a forward direction 2 or rearward direction 4, as indicated in FIG. 12F. The dome portions 1236, 1246 may be snapped in place in particular grooves 1250 and then move in a forward direction 2 or rearward direction 4. In some embodiments, the dome portions 1236, 1246 may move in the forward direction 2 or rearward direction 4 by sliding along the grooves 1250 or outer slots 1251, 1252. For instance, the tracks 1207, 1209 may slide along the outer tracks 1251, 1252. The dome portions 1236, 1246 may also be placed closer or farther together by moving along the first lateral direction 6 or the second lateral direction 8, as indicated in FIG. 12F. For instance, the dome portions 1236, 1246 may be placed in various lateral positions along the first lateral direction 6 and/or the second lateral direction 8, and once a lateral position ("lateral" here defined as along the first lateral direction 6 or the second lateral direction 8) is selected for the dome portions 1236, 1246, the dome portions 1236, 1246 may then be moved in the forward or rear direction 2, 4. In some embodiments, the dome portions 1236, 1246 are located laterally along the first or second lateral direction 6, 8 such that lateral positions of the dome portions 1236, 1246 align with an adjacent drain, such as a scupper drain. In some embodiments, the dome portions 1236, 1246 may be located laterally along the first or second lateral direction 6, 8 and then snapped into place into particular grooves 1250. Then, the dome portions 1236, 1246 may be moved along those particular grooves 1250, for example in the forward direction 2 to move the dome portions 1236, 1246 closer to and/or abutting the drain. This may facilitate, for example, covering a scupper drain in a parapet wall that has a cant strip or other protrusion below the drain (see FIG. 12J, for example), such that the skirt 1220 is located adjacent the cant strip or protrusion and the dome 1229 may then be moved in the forward direction 2 over the cant strip or protrusion to cover the drain. Thus, a portion of the dome 1229 may overhang off the skirt 1220, and the attachments 1282, 1292 may attach to this overhanging portion of the dome 1229, as described herein.

FIG. 12G is a front view of the skirt 1220. For clarity, in FIG. 12G a rear portion of the skirt 1220 has been removed. As shown in FIG. 12G, the grooves 1250 may have a cross-section that is generally rectangular shaped, and the grooves 1250 may be generally evenly spaced. In some embodiments, the grooves 1250 may have other shaped cross-sections, such as C-section, shallow U- or C-section, rectangular, square, rounded shapes such as circular, elliptical, arcuate, or other shapes, polygonal shapes, segmented shapes, hollow cross-section, solid cross-section, partially hollow and partially solid cross-section, and/or combinations thereof. In some embodiments, the grooves 1250 may have different widths and not be evenly spaced.

The first and second dome portions 1236 and 1246 may connect or couple with the skirt 1220 by sliding into and/or through the grooves 1250 and/or outer slots 1251 and 1252 located on the skirt 1220. The dome portions 1236 and 1246 may slide partially or completely into the grooves 1250 and/or outer slots 1251 and 1252. The entire first and second dome portions 1236 and 1246 may be located over the skirt 1220, as shown in FIGS. 12A and B. The dome portions 1236 and 1246 may also be moved such they are located partially over the skirt 1220. The dome portions 1236 and 1246 may also be moved laterally into different grooves 1250 so that the dome portions 1236 and 1246 are either closer together or farther apart in a lateral direction. The dome created by the dome portions 1236 and 1246 may be located near the center of the skirt 1220 or off-center.

The cover 1200 may be installed in the orientation shown in FIG. 12A with a scupper located in front of the cover 1200 as oriented in FIG. 12A. By "front" it is understood that this description is relative to the orientation shown in FIG. 12A, i.e. the forward direction 2 indicated in FIG. 12F. The width of the dome 1229 created by positioning the dome portions 1236 and 1246 on the skirt 1220 may be less than, equal to, or greater than the width of the opening of the scupper or other drain. The maximum width of the dome 1229 may occur when the dome portions 1236, 1246 are attached to the outer slots 1251 and 1252. The width of the skirt 1220 may be greater than the width of the opening of the scupper or other drain. In some embodiments, the width of the skirt 1220 may be twice as large as the maximum width of the drain opening. In some embodiments, the width of the skirt 1220 may be more than twice as large as the maximum width of the drain opening.

As mentioned, the dome portions 1236 and 1246 may slide along the grooves and extend towards the front to contact or otherwise be near an adjacent structure, such as a scupper or parapet wall. The adjacent structure may have an interfering structure, such as a cant strip, rounded edge, or other obstruction or dimension that would prevent the cover from being flush with the wall surface. When the dome portions are extended in front of the skirt 1220, such that part of the dome portions are overhanging the skirt 1220, there may be a gap between the adjacent structure and the skirt 1220.

As shown in FIG. 12D, the skirt 1220 comprises a flat portion 1219 and an angled portion 1218. As shown in FIG. 12F, the skirt 1220 may have a generally arcuate shape, which may be planform. The skirt may have other arcuate shapes, such as elliptical, oval, circumferential, other rounded shapes, or combinations thereof. As shown in FIGS. 12D and 12F, the outer edge 1299 of the skirt 1220 as well as the flat portion 1219 may be generally rectangular. The skirt 1220 may define the geometric center axis 12 that is perpendicular to the flat portion 1219. The angled portion 1218 may flare outward and downward from the flat portion 1219 to an outer perimeter 1299 in a first direction that is generally away from the central axis 12 and generally away from the flat portion 1219.

As shown in FIG. 12E, the angled portion 1216, when viewed from the side may be oriented at an acute angle A with respect to a portion of the axis 12 that is located underneath the skirt 1220. Thus, the angle A may be acute when measured from a portion of the axis 12 that is under or below the cover 1200, as oriented in FIG. 12E. As shown in FIG. 12G, the angled portions 1215 and 1217, when viewed from the side may be oriented at acute angles B and C with respect to a portion of the axis 12 12 that is located underneath the skirt 1220. Thus, the angles B and C may be acute when measured from a portion of the axis 12 that is under or below the cover 1200, as oriented in FIG. 12G. The acute angles A, B, and C of the angled sub-portions 1217, 1216, and 1215 with respect to the axis 12 may be different from each other or may be the same or similar to each other.

FIG. 12H is a front perspective view of another embodiment of the cover 1200. As shown, the cover 1200 includes embodiments of the skirt 1220 and the dome 1229. In addition, an embodiment of a mount 1260 is shown. The mount 1260 may be used with the various covers described herein, for example the cover 1200 described with respect to FIGS. 12A-12G. The embodiment of the cover 1200 shown in FIG. 12H may have the same or similar features and/or functionalities as other covers described herein, for example the cover 1200 described with respect to FIGS. 12A-12G, and vice versa.

As shown in FIG. 12H, the dome 1229 may include an embodiment of the first dome portion 1236 and the second dome portion 1246. The dome portions 1236, 1246 may include, respectively, embodiments of the ribs 1222, 1226. The ribs 1222, 1226 may be oriented generally vertically, as oriented in the figure. The ribs 1222, 1226 may extend longitudinally along the length of the angled portion of the respective dome portions 1236, 1246. Thus, the ribs 1222, 1226 may have a variety of configurations. In some embodiments, the ribs 1222, 1226 may extend in an angled direction, horizontal direction, other suitable directions, or combinations thereof. In some embodiments, the ribs 1222 of the first dome portion 1236 may extend in a different direction relative to the ribs 1226 of the second dome portion 1246. These are merely some examples, and a variety of other configurations may be implemented.

The dome 1229 may include an inner side 1205A. The inner side 1205A may be a structural support coupled with the dome portion. The inner side 1205A may be in addition to other sides of the dome portion. The inner side 1205A may have the same or similar features and/or functionalities as the side 1205, described herein. Thus, the inner side 1205A may have ribs, spaces, etc. The inner side 1205A may be located on a dome portion toward the inner part of the dome portion. As shown, the inner side 1205 may be coupled with the dome portion 1236. The inner side 1205A may be coupled with the dome portion 1236 on the opposite side as the side 1205. Thus, the inner side 1205A may be located generally in between the dome portions 1236, 1246 as oriented in FIG. 12H.

The cover 1200 may include the mount 1260. The mount 1260 may be coupled with the cover 120, for example with the skirt 1220, as shown. The mount 1260 may snap fit with the cover 1200, for example with the skirt 1220. The mount 1260 may also couple with a receiving structure, such as a roof or floor structure. The mount 1260 may couple with a receiving structure in a variety of ways, as further described herein, for example with respect to FIGS. 12K and 12L. Thus, the mount 1260 may provide a means for coupling the remaining parts of the cover 1200 with a roof, floor, etc.

FIG. 12I is a front perspective view of the cover 1200 of FIG. 12H with the dome 1229 configured in a contracted configuration. As shown, the dome 1229 is contracted and moved to one side of the cover 1200. The dome portions 1246 and 1236 may move relative to each other, as mentioned. As shown, the dome portion 1246 has been moved over the dome portion 1236. Thus, both the first and second dome portions 1236, 1246 are located on one side of the cover 1200 as oriented in the figure. Such configurations may be used for example with varying size drains and drain openings. For example, the configuration of the cover 1200 shown in FIG. 12H may be used for relatively larger drain openings while the configuration of the cover 1200 shown in FIG. 12I may be used for relatively smaller drain openings. The configuration shown in FIG. 12I is merely an example of how the cover 1200 can be configured. Due to the ability to move the dome portions 1236, 1246 both relative to each other and relative to the skirt 1220, many other configurations of the cover 1200 may be implemented. For instance, another configuration is shown and discussed with respect to FIG. 12J.

As further shown in FIG. 12I, the ribs 1222, 1226 may coordinate with each other such that openings are still provided through the overlapping dome portions 1236, 1246 in the various configurations. For instance, in the configuration shown in FIG. 12I, the ribs 1222 of the second dome portion 1246 may be located over the ribs 1226 of the first dome portion 1236. The ribs 1226 are identified with a dashed line because they are behind the ribs 1222. Thus, with the second dome portion 1246 positioned as shown relative to the first dome portion 1236, the ribs 1222, 1226 may align or otherwise provide for openings through that side of the dome 1229. This is merely one example of how the ribs 1222, 1226 may coordinate with each other in various overlapping configurations, and other suitable coordinations may be implemented.

Figure 12J:
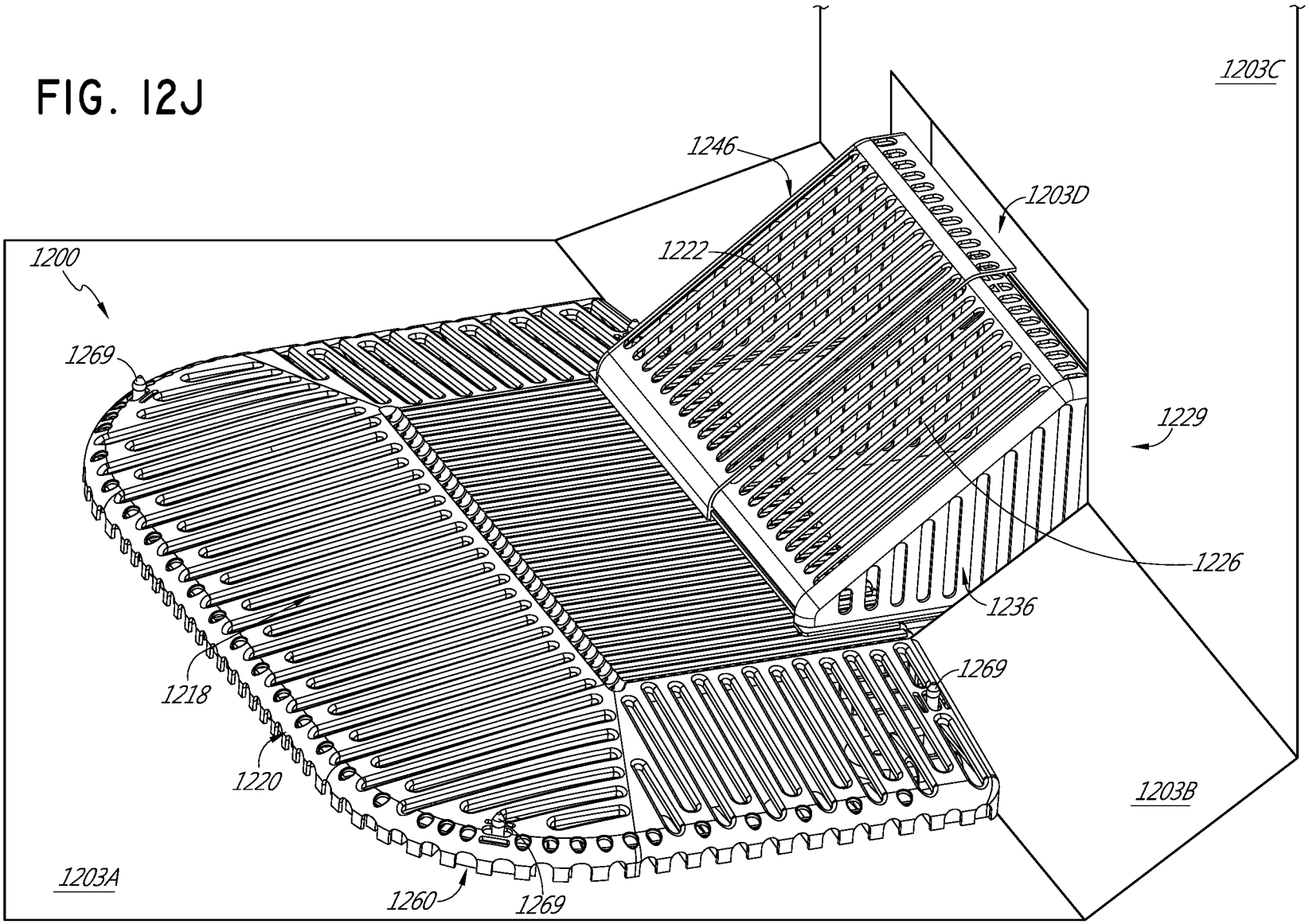
FIG. 12J is a front perspective view of the cover of FIG. 12H installed next to a scupper drain with the dome in an extended configuration.

FIG. 12J is a front perspective view of the cover 1200 of FIGS. 12H and 12I installed next to a scupper drain opening 1203D and with the dome 1229 in an extended configuration. The cover 1200 is shown located on top of a receiving structure 1203A, such as a roof or structure thereof, and next to an angled wall section 1203B and straight wall section 1203C. The drain opening 1203D intersects both the straight and angled wall sections 1203C, 1203B. This creates difficulty with sufficiently covering the drain opening 1203D using typical drain covers. The cover 1200 can be adjusted to sufficiently cover the drain opening 1203D. As shown, the dome portion 1236 has been moved slightly towards the dome portion 1246 to fit within the width of the opening 1203D, and both dome portions 1236, 1246 have been moved toward the drain opening 1203D. Thus, the dome 1229 extends partially into the drain opening 1203D. The skirt 1220 may also abut the angled wall section 1203B. In this manner, the cover 1200 may allow for sufficient coverage of the drain opening 1203D. This is merely an example of how the cover 1200 can be adjusted to accommodate atypical drain openings and/or atypical structures surrounding drain openings. A variety of other types of drain openings 1203D and structures may be accommodated and sufficiently covered with the cover 1200.

Figure 12K:
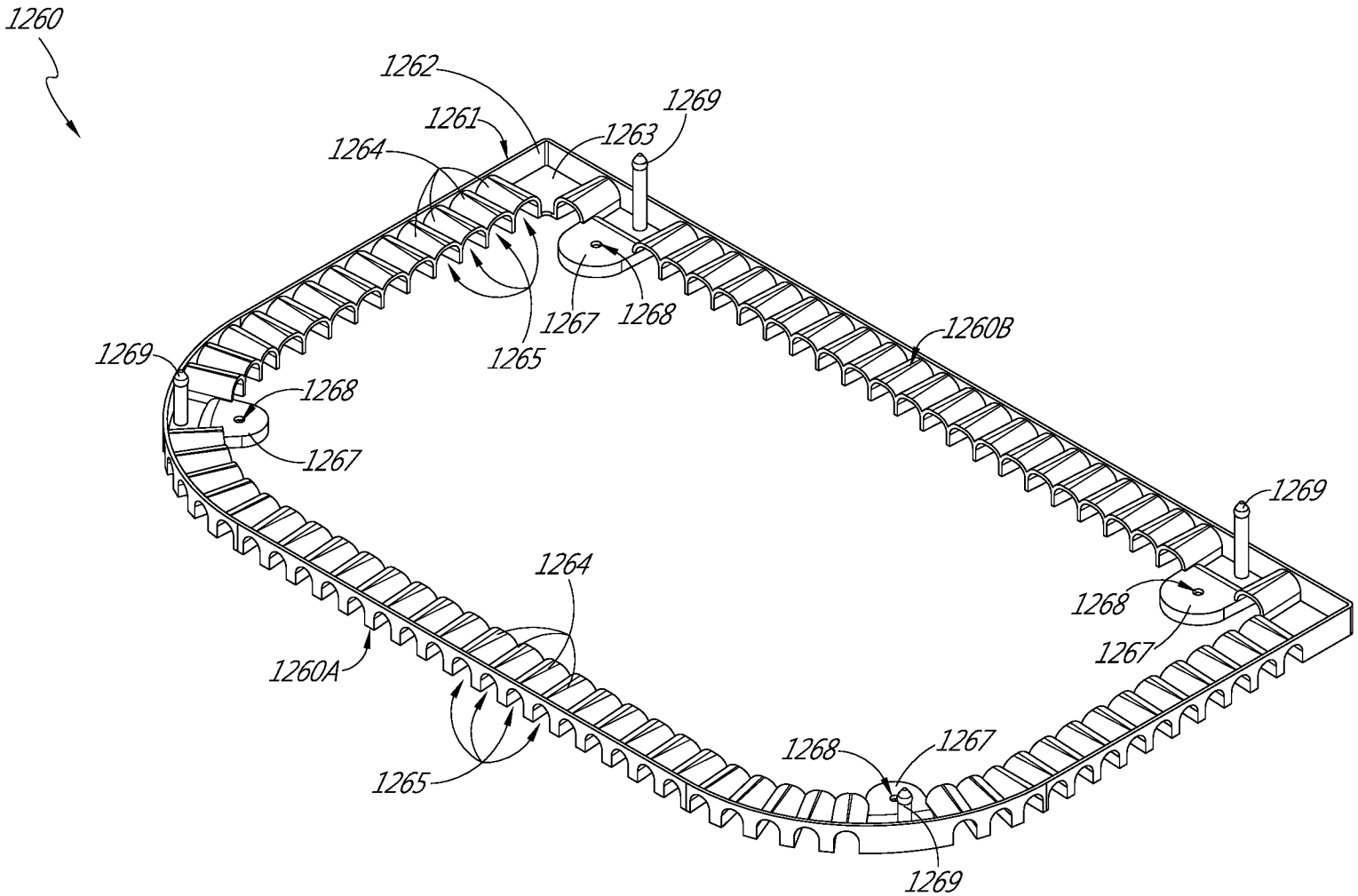
FIGS. 12K and 12L are top and bottom perspective views, respectively, of the mount of FIG. 12H.
Figure 12L:
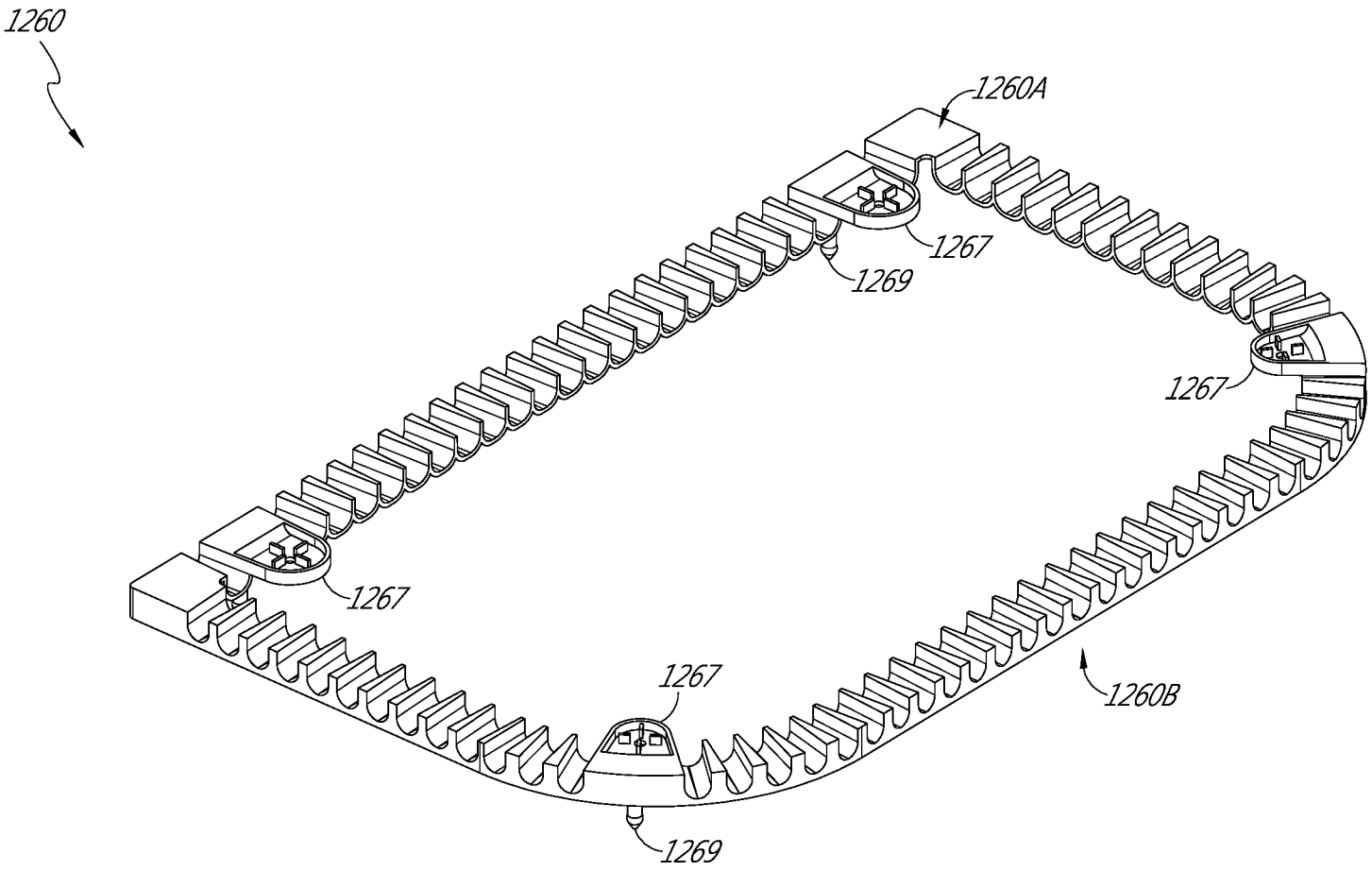

FIGS. 12K and 12L are top and bottom perspective views, respectively, of the mount 1260. The mount 1260 may include a bottom side 1260A and a top side 1260B that is opposite the bottom side 1260A. The top and bottom sides 1260A, 1260B may include the various features of the mount 1260 as described herein that are located on the respective sides of the mount 1260. The mount 1260 may couple the cover 1200, for example the skirt 1200, to a receiving structure, such as a floor, roof, etc. The mount 1260 may have the same or similar features and/or functionalities as other mounts described herein, for example the mount 160, and vice versa. The mount 1260 may be formed from a variety of materials, including rubber, plastic, polymer, metal, wood, other suitable materials, or combinations thereof. The mount 1260 may be formed from flexible materials. For example, the mount 1260 may flex in order to accommodate uneven receiving structures or protrusions thereof.

The mount 1260 may include a body 1261. The body 1261 may be a structural member that forms portions of the mount 1260. The body 1261 may have the generally rectangular shape shown. Other shapes and configurations may be implemented to suit the particular shape of the corresponding cover 1200. The body 1261 may extend generally along the perimeter shown. The body 1261 may include a wall 1262. The wall 1261 may extend along the perimeter of the mount 1260. The wall 1261 may be flat in some portions and rounded in other portions. The wall 1261 may provide stiffness and/or stability to the mount 1260. The body 1261 may include a floor 1263. The floor 1263 may be coupled with the wall 1262. The floor 1263 may be flat in some portions and may be rounded in other portions. The floor 1263 may extend along the perimeter of the cover 1200.

The cover 1200 may include one or more tunnels 1264 defining one or more passages 1265. The body 1261 may include the tunnels 1264 and passages 1265, such as with the wall 1262 and/or floor 1263. The tunnels 1264 and passages 1265 may provide spaces for fluid to pass through the mount 1260 when the mount 1260 is installed on a receiving structure, such as the receiving structure 1203A. The mount 1260 may include a plurality of the tunnels 1264 and passages 1265 along one or more sides of the mount 1260. As shown, the tunnels 1264 and passages 1265 may be includes along four sides of the mount 1260, for example along four sides of the body 1261. For clarity, only some of the tunnels 1264 and passages 1265 are labelled in FIG. 12K. There may be five, ten, twenty, fifty, seventy-five, one hundred, two hundred, or any smaller, intermediate or greater number of tunnels 1264 and/or passages 1265. There may be more tunnels 1264 than passages 1265, or vice versa. For instance, some of the tunnels 1264 maybe solid such that they do not define a corresponding passage 1265 therethrough. In some embodiments, some passages 1265 may be defined by features of the cover 1200 other than the tunnels 1264. The tunnels 1264 and/or passages 1265 may have the generally rounded "U" shape as shown. In some embodiments, the tunnels 1264 and/or passages 1265 may have other suitable shapes, for example rounded, non-rounded, combinations thereof, etc.

The cover 1200 may include one or more mounting tabs 1267. The body 1261 may include the tabs 1267. The tabs 1267 may be extensions of the floor 1263. The tabs 1267 may be elongated, flat structures that provide surface area with which to facilitate mounting of the mount 1260 on a receiving structure. The tabs 1267 may include openings 1268 that extend through the thickness of the tabs 1267. Each tab 1267 may include the opening 1268. The opening s1268 may also be included in other parts of the cover 1200, such as in the floor 1263 or other parts. There may be the same number of openings 1268 as tabs 1267. There may be fewer or more openings 1268 than tabs 1267. The openings 1268 may provide a space through which a fastener, such as bolt, etc., may be received in order to fasten the mount 1260 to a receiving structure. However, the mount 1260 may be coupled with a receiving structure in a variety of manners, as described herein. There may be four tabs 1267, as shown. The tabs 1267 may be located generally in corners of the cover 1200. In some embodiments, there may be fewer or more than four tabs 1267 located in a variety of locations of the cover 1200. For instance, in addition or alternatively, there may be one or more tabs 1267 located along the straight portions of the body 1261.

The cover 1200 may include one or more connection rods 1269. The rods 1269 may be extensions from the cover 1200 to facilitate coupling the mount 1260 with other portions of the cover 1200, such as with the skirt 1200. The rods 1269 may extend from the mount 1260 generally perpendicular to the floor 1263 and tabs 1267, as shown. In some embodiments, the rods 1269 may extend at an angle relative to the floor 1263 and/or tabs 1267. The rods 1269 may be straight as shown. In some embodiments, the rods 1269 may be straight, bent, or combinations thereof. There may be four rods 1269. In some embodiments, there may be fewer or more than four rods 1269. There may be the same number of rods 1269 as tabs 1267. In some embodiments, there may be more or fewer rods 1269 than tabs 1267. The rods 1269 may be varying lengths. The rods 1269 may be 0.25", 0.5", 0.75", 1" 1.5", 2", 3", or any shorter, intermediate or longer length. The rods 1269 may not all have the same length. Some of the rods 1269 may be longer or shorter than the other rods 1269.

The mount 1260 may be used to couple the other parts of the cover 1200 to a receiving structure in a variety of manners. The mount 1260 may first be coupled with a receiving structure, and the remaining portions of the cover 1200 may then be coupled with the mount 1260.

The mount 1260 may be coupled with a receiving structure in a variety of manners. The mount 1260 may be fastened, bonded, clipped, coupled to a receiving structure with other suitable techniques, or combinations thereof. In some embodiments, fasteners may be inserted through the openings 1268 and then fastened with the receiving structure, such as the receiving structure 1203A. Fasteners may include screws, bolts, coil anchors, inserts, other suitable fastening type parts, or combinations thereof. In some embodiments, fasteners may be inserted through portions of the cover 1200, such as through the floor 1263 or other portions. In addition or alternatively to fastening, the mount 1260 may be bonded or otherwise adhered to a receiving structure. For instance, the mount 1260 may be adhered, such as with the use of glue or other bonding agent, to a receiving structure. Portions of the cover 1200 on the bottom surface 1260, such as surfaces of the body 1261 on that side of the cover 1200, may be bonded to the receiving structure. For instance, surfaces of the floor 1263 on the bottom side 1260A of the cover 1200 may be bonded to the receiving structure. As another example, the portion of the tabs 1267 on the bottom side 1260A of the cover 1200 may be bonded to the receiving structure.

Figure 12M:
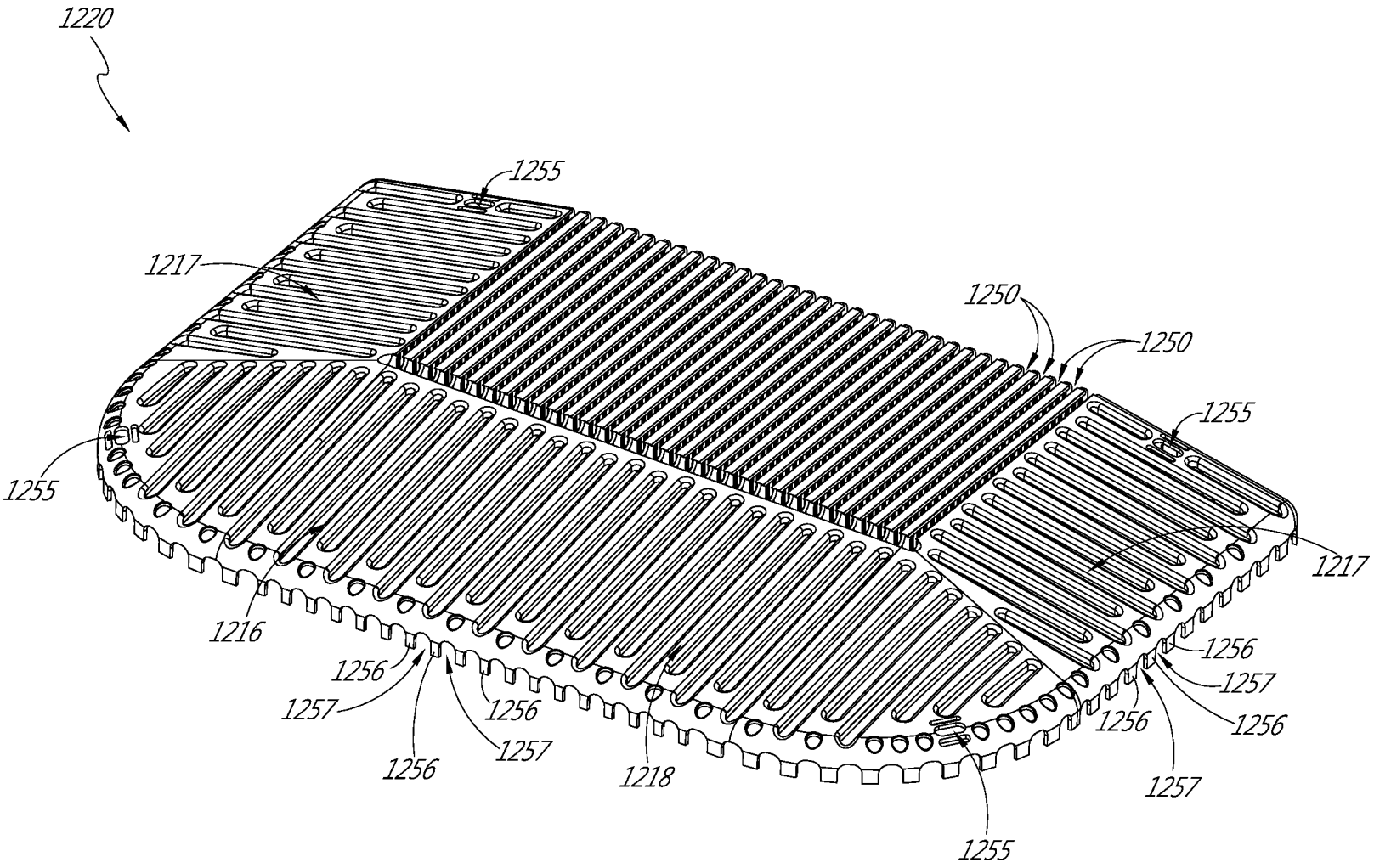
FIG. 12M is a perspective view of the skirt of FIG. 12H.

The mount 1260 may be coupled with the remaining portions of the cover 1200 in a variety of manners. FIG. 12M is a perspective view of the skirt 1220. As shown, the skirt 1220 may include openings 1255. The openings 1255 may each receive one of the rods 1269 therethrough, for example as shown in FIGS. 12H-12J. Inserting the rods 1269 through respective openings 1255 may align the skirt 1220 with the mount 1260. The openings 1255 may be located in the skirt 1220 to complement the locations of the rods 1269 on the mount 1260. Thus, there may be the same number of openings 1255 as rods 1269. In some embodiments, there may be fewer or more openings 1255 than rods 1269. The openings 1255 may extend through the skirt 120 in various locations. As shown, the openings 1255 may extend through the angled portion 1218. The openings 1255 may extend through the angled sub-portions 1215, 1216 and/or 1217.

As shown in FIG. 12M, the skirt 1220 may include one or more teeth 1256. The teeth 1256 may be short, flat extensions along the perimeter of the underside of the skirt 1220. The teeth 1256 may define gaps 1257 therebetween. The skirt 1220 may couple with the mount 1260 by coupling the teeth 1256 and/or other features with the mount 1260. The mount 1260 may couple with the skirt 1220 by snapping or otherwise fitting complementary respective portions together. For example, the body 1261 of the mount 1260 may fit together with the skirt 1220. In some embodiments, the wall 1261 of the mount 1260 may snap onto or into the teeth 1256 of the skirt 1220. In some embodiments, the teeth 1256 and/or gaps 1257 of the skirt 1220 may align with the tunnels 1264 and/or passages 1265 of the mount 1260.

These are just some examples of how the mount 1260 and skirt 1220 may be coupled together. In addition or alternatively to the other techniques described herein, the skirt 1220 may be coupled with the mount 1260 by being fastened, bonded, other suitable techniques, or combinations thereof.

Further shown in FIG. 12M are the grooves 1250 of the skirt 1220. The embodiment of the grooves 1250 shown in FIG. 12M may have the same or similar features and/or functionalities as the grooves 1250 described with respect to FIGS. 12A-12G, and vice versa. The grooves 1250 may all have the same spacing, such that they are essentially all the same width. In some embodiments, there may be variable widths among the various grooves 1250. For example, some grooves 1250 may be relatively wider than other grooves 1250. The variable width grooves 1250 may facilitate with assembly of the cover 1200, for example by preventing incorrect assembly of the dome portions 1236, 1246 on the skirt 1200. In some embodiments, half of the grooves 1250 may have a first width and the other half of the grooves 1250 may have a second width that is larger than the first width. Each respective size of grooves may be configured to receive particular corresponding dome 1229 features.

In alternative embodiments, in addition or alternatively to the grooves 1250, the skirt 1220 may include multiple openings or holes in the flat portion 1219. Such openings or holes may engage corresponding pegs or posts on the dome portions 1236, 1246, for example pegs or posts extending from or forming portions of one or more of the tracks 1205B, 1207, 1209.

Figure 12N:
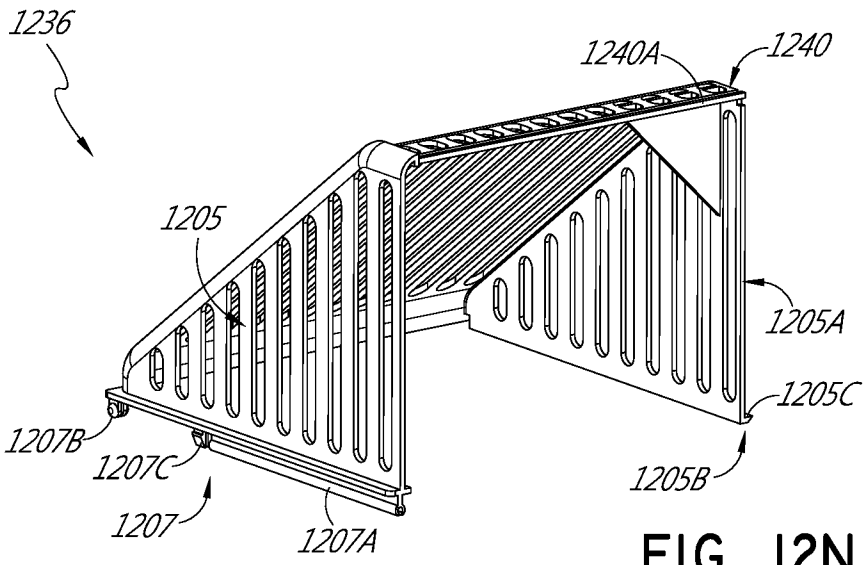
FIG. 12N is a perspective view of the first dome portion of FIG. 12H.
Figure 12O:
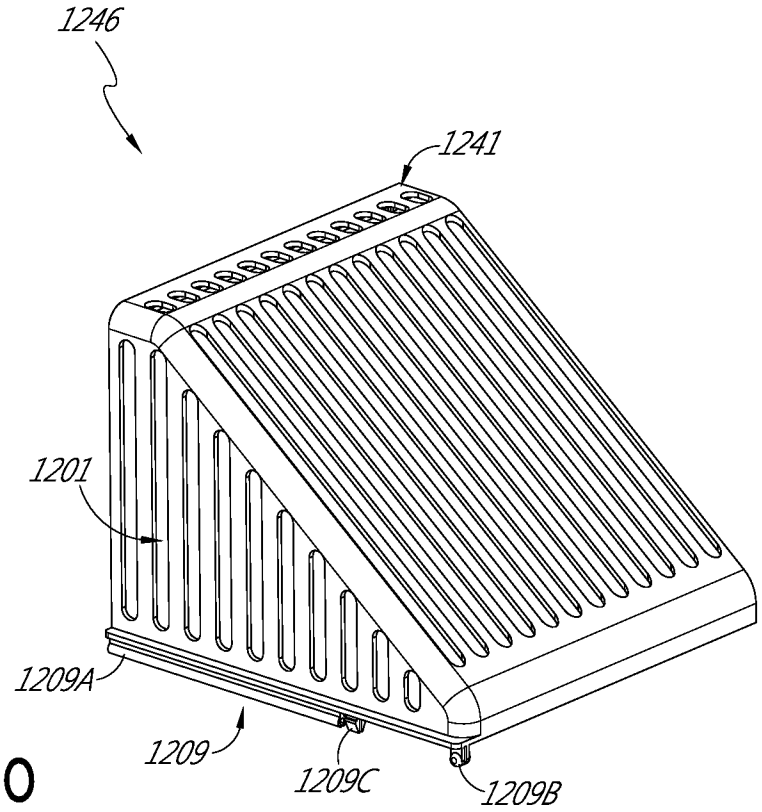
FIGS. 12O and 12P are top and bottom perspective views, respectively, of the second dome portion of FIG. 12H.
Figure 12P:
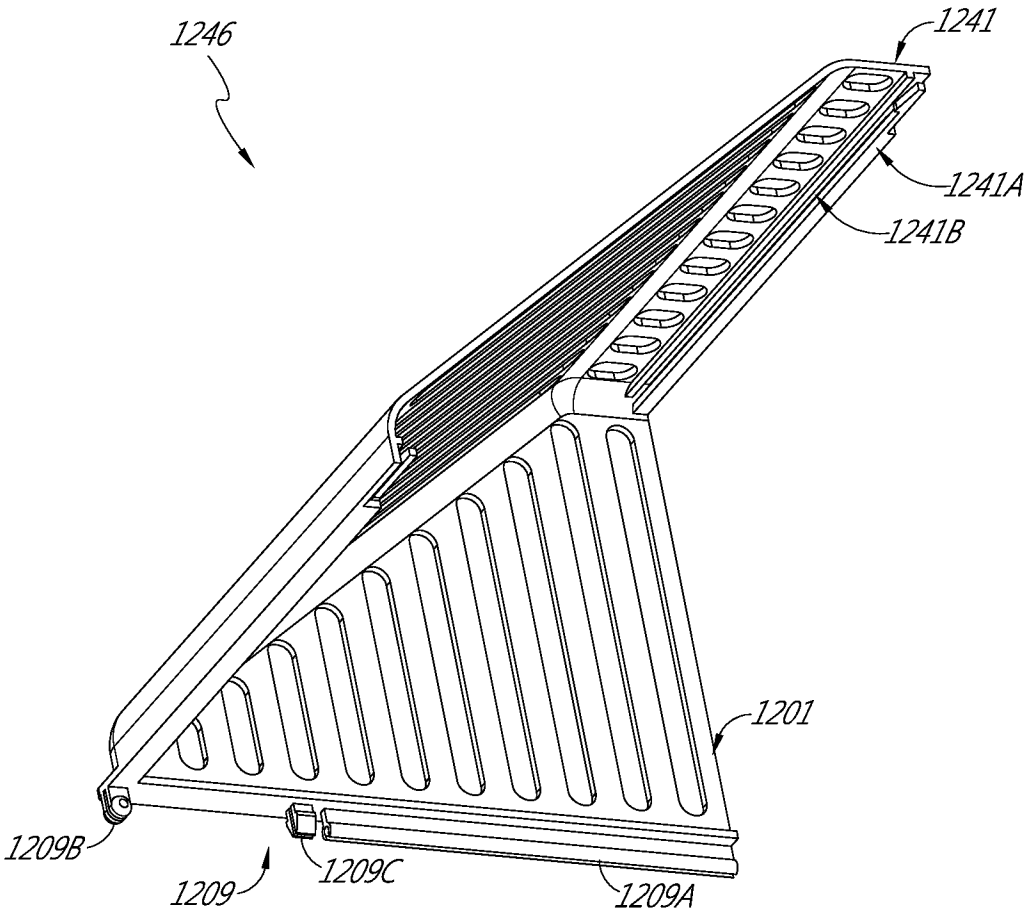

FIGS. 12N, 12O and 12P are various views of portions of the dome 1229. FIG. 12N is a perspective view of the first dome portion 1236. FIGS. 12O and 12P are top and bottom perspective views, respectively, of the second dome portion 1246.

As shown in FIG. 12N, the first dome portion 1236 may include the track 1207. The track 1207 may be located along a lower portion of the side 1205. The track 1207 may include a guide 1207A, a positioner 1207B, and/or a stop 1207C. The guide 1207A may be an elongated structure along the track 1207. The positioner 1207B may be an extension on the track 1207 located opposite the guide 1207A for positioning and stability. The positioner 1207B may be a rotatable feature, such as a wheel. The stop 1208C may be located between the positioner 1207B and the guide 1207A. The stop 1208C may be a stationary structure that prevents the dome 1229 from extending beyond a certain point, for example when the dome 1229 overhangs the skirt 1229, as described herein. The guide 1207A, positioner 1207B, and/or stop 1207C may couple with the skirt, for example with the grooves 1250, and/or with other features of the flat portion 1219 described herein. In some embodiments, the track 1207 may snap into one of the grooves 1250. The track 1207 may slide along the groove 1250 for adjustment. The track 1207 may provide friction when coupled with the groove 1250 so as to require a force to slide the track 1207 along the groove 1250, for example to prevent unwanted relative movement when the track 1207 is coupled with the groove 1250.

The first dome portion 1236 may include the inner side 1205A. The inner side 1205A may be located opposite the side of the first dome portion 1236 having the track 1207. The inner side 1205A may include a track 1205B. The track 1205B may have the same or similar features as the track 1207. As shown, the track 1205B may include fewer features than the track 1207. The track 1205B may include a lip 1205C extending along the length of the track 1205B. The track 1205B, for example the lip 1205C, may couple with a corresponding groove 1250 and slide therein. The track 1205B, for example the lip 1205C, may slide freely in the corresponding groove 1250. In some embodiments, there may be friction so that a force must be overcome to move the track 1205B, for example the lip 1205C, along the corresponding groove 1250.

The first dome portion 1236 may include the top 1240. The top 1240 may be located along an upper portion of the first dome portion 1236. The top 1240 may include a lip 1240A extending along the length of the top 1240. The top 1240, such as the lip 1240A, may couple with the second dome portion 1246, as described herein.

As shown in FIGS. 12O and 12P, the second dome portion 1246 may include the track 1209 and the top 1241. The track 1209 may be analogous to the track 1207. The track 1209 may be located along a lower portion of the side 1201. The track 1209 may include a guide 1209A, a positioner 1209B, and/or a stop 1209C. The guide 1209A may be an elongated structure along the track 1209. The positioner 1209B may be an extension on the track 1209 located opposite the guide 1209A for positioning and stability. The positioner 1209B may be a rotatable feature, such as a wheel. The stop 1209C may be located between the positioner 1209B and the guide 1209A. The stop 1209C may be a stationary structure that prevents the dome 1229 from extending beyond a certain point, for example when the dome 1229 overhangs the skirt 1229, as described herein. The guide 1209A, positioner 1209B, and/or stop 1209C may couple with the skirt, for example with the grooves 1250, and/or with other features of the flat portion 1219 described herein. In some embodiments, the track 1209 may snap into one of the grooves 1250. The track 1209 may slide along the groove 1250 for adjustment. The track 1209 may provide friction when coupled with the groove 1250 so as to require a force to slide the track 1209 along the groove 1250, for example to prevent unwanted relative movement when the track 1209 is coupled with the groove 1250.

As shown in FIG. 12P, the second dome portion 1246 may include a guide member 1241A defining a slot 1241B. The top 1241 may include the guide member 1241A defining the slot 1241B. The guide member 1241A and/or the slot 1241B may extend along all or some of the length of the top 1241. The guide member 1241 and/or slot 1241B may couple with corresponding portions of the first dome portion 1236. In some embodiments, the slot 1241B may receive the lip 1240A of the first dome portion 1236 therein. Thus, the second dome portion 1246 may overlap the first dome portion 1236.

The dome 1229 may be coupled with the skirt 1220 in a variety of manners. In some embodiments the dome 1229 may be coupled with the grooves 1250 of the skirt 1220. The dome 1229 may be coupled with the skirt 1220 before or after the skirt is coupled with the mount 1260. In some embodiments, the first dome portion 1236 may be coupled with the skirt 1220. Then, the second dome portion 1246 may be coupled with the skirt 1220. The second dome portion 1246 may be assembled over the first dome portion 1236, for example as shown and described with respect to FIGS. 12H-12J.

In some embodiments, the dome portions 1236, 1246 may first be located laterally, corresponding to the directions 6 and 8 shown in FIG. 12F. Lateral movement of the dome portion 1236, 1246 may entail for example sliding of the lip 1240A of the first dome portion 1236 along the guide member 1241A and/or slot 1241B of the second dome portion 1246, as described above. Once this relative lateral position of each dome portion 1236, 1246 is selected, the dome portions 1236, 1246 may be coupled with the grooves 1250 in those locations that correspond to the lateral positions of the dome portions 1236, 1246. For instance, the tracks 1205B, 1207 and/or 1209, or features thereof, may be snapped into the corresponding grooves 1250 once the dome portions 1236, 1246 are in their desired lateral positions. The lateral positioning of the dome portions 1236, 1246 may be based on the location and/or size, for example lateral location or width, of a corresponding drain over which the cover 1200 is to be positioned.

After lateral placement as described above, the dome portions 1236, 1246 may then be located forward or rearward, corresponding respectively to the directions 2 and 4 shown in FIG. 12F. Forward or rearward movement of the dome portions 1236, 1246 may entail for example sliding of the tracks 1205B, 1207 and/or 1209, or features thereof, along the corresponding grooves 1250 once the dome portions 1236, 1246 are coupled with the corresponding grooves 1250, as described above. The final forward or rearward positioning of the dome portions 1236, 1246 may be based on the location and/or size of a corresponding drain, for example position over a cant strip or angular opening of the drain, over which the cover 1200 is to be positioned. In some embodiments, the dome portions 1236, 1246 may be moved rearward 4, for example into the extended configuration shown in FIG. 12J.

One arrangement can include method for covering a drain wherein a first dome portion and a second dome portion are coupled to a skirt that includes a portion forming a plurality of grooves extending in a first direction. The first and second dome portions can each comprise a sidewall with a lower portion that can engage at least one of the plurality of grooves. Each sidewall can form a plurality of drainage openings extending through the sidewall. The distance between first dome portion and the second dome portion can be adjusted with respect to each other on the skirt by positioning the lower portions of the first and second domes in one of the plurality of grooves. In some arrangements, adjusting the position of the first and second dome portions comprises increasing or reducing the overlap between the first and second dome portions. The position of the first and second dome portions on the skirt can be adjusted in the first direction by sliding the lower portions of the first and second dome portions along at least some of the grooves.

The following are numbered example embodiments (NEE):

NEE1. A cover for a drain, the cover comprising: a dome having an arcuate sidewall with a lower portion, wherein the sidewall defines a central axis and forms a plurality of first openings extending through the sidewall, and wherein at least a portion of the lower portion is located a perpendicular distance R1 from the central axis; and an arcuate skirt coupled with the lower portion of the sidewall and having an outer edge, wherein the skirt flares outward and downward from the lower portion to the outer edge in a first direction that is generally away from the central axis and generally away from the dome, wherein the first direction forms an acute angle A with a portion of the central axis that extends below the skirt, wherein the skirt forms a plurality of second openings extending through the skirt, and wherein at least a portion of the outer edge of the skirt is located a perpendicular distance R2 from the central axis, and wherein R2 is at least twice R1.

NEE 2. The cover of NEE 1, wherein R2≥2.25×R1.

NEE 3. The cover of NEE 2, wherein R2≥2.5×R1.

NEE 4. The cover of NEE 3, wherein R2≥2.75×R1.

NEE 5. The cover of NEE 4, wherein R2≥3×R1.

NEE 6. The cover of NEE 1, wherein the acute angle A is greater than or equal to sixty degrees.

NEE 7. The cover of NEE 6, wherein the acute angle A is greater than or equal to sixty-five degrees.

NEE 8. The cover of NEE 7, wherein the acute angle A is greater than or equal to seventy degrees.

NEE 9. The cover of NEE 8, wherein the acute angle A is greater than or equal to seventy-five degrees.

NEE 10. The cover of NEE 9, wherein the acute angle A is greater than or equal to eighty degrees.

NEE 11. The cover of NEE 10, wherein the acute angle A is greater than or equal to eighty-five degrees.

NEE 12. The cover of NEE 11, wherein R2≥2.25×R1.

NEE 13. The cover of NEE 12, wherein R2≥2.5×R1.

NEE 14. The cover of NEE 13, wherein R2≥2.75×R1.

NEE 15. The cover of NEE 14, wherein R2≥3×R1.

NEE 16. The cover of NEE 1, wherein the dome and skirt are swept out arcuately 360 degrees about the central axis.

NEE 17. The cover of NEE 16, wherein R1 and R2 are radii of the lower portion of the dome and of the outer edge of the skirt, respectively, and wherein the dome and skirt are swept out circularly 360 degrees about the central axis.

NEE 18. The cover of NEE 1, wherein the dome and skirt are swept out arcuately less than 360 degrees about the central axis.

NEE 19. The cover of NEE 18, wherein R1 and R2 are radii of the lower portion of the dome and of the outer edge of the skirt, respectively, and wherein the dome and skirt are swept out circularly less than 360 degrees about the central axis.

NEE 20. The cover of NEE 18, wherein the dome and skirt are swept out arcuately less than or equal to 180 degrees about the central axis.

NEE 21. The cover of NEE 20, wherein R1 and R2 are radii of the lower portion of the dome and of the outer edge of the skirt, respectively, and wherein the dome and skirt are swept out circularly less than or equal to 180 degrees about the central axis.

NEE 22. The cover of NEE 1, the skirt further comprising a plurality of elongated lower ribs, wherein the plurality of elongated lower ribs define the plurality of second openings extending through the skirt.

NEE 23. The cover of NEE 22, wherein each of the plurality of elongated lower ribs has a first end and a second end that is opposite the first end, wherein the first end is coupled with the lower portion of the dome and the second end is coupled with the outer edge of the skirt.

NEE 24. The cover of NEE 23, wherein the plurality of elongated lower ribs extend generally along the first direction.

NEE 25. The cover of NEE 24, wherein the plurality of elongated lower ribs are oriented generally radially with respect to the central axis.

NEE 26. The cover of NEE 25, wherein $R2 \geq 2.25 \times R1$.

NEE 27. The cover of NEE 26, wherein $R2 \geq 2.5 \times R1$.

NEE 28. The cover of NEE 27, wherein $R2 \geq 2.75 \times R1$.

NEE 29. The cover of NEE 28, wherein $R2 \geq 3 \times R1$.

NEE 30. The cover of NEE 25, wherein the dome and skirt are swept out arcuately 360 degrees about the central axis.

NEE 31. The cover of NEE 30, wherein R1 and R2 are radii of the lower portion of the dome and of the outer edge of the skirt, respectively, and wherein the dome and skirt are swept out circularly 360 degrees about the central axis.

NEE 32. The cover of NEE 25, wherein the dome and skirt are swept out arcuately less than 360 degrees about the central axis.

NEE 33. The cover of NEE 32, wherein R1 and R2 are radii of the lower portion of the dome and of the outer edge of the skirt, respectively, and wherein the dome and skirt are swept out circularly less than 360 degrees about the central axis.

NEE 34. The cover of NEE 25, wherein the dome and skirt are swept out arcuately less than or equal to 180 degrees about the central axis.

NEE 35. The cover of NEE 34, wherein R1 and R2 are radii of the lower portion of the dome and of the outer edge of the skirt, respectively, and wherein the dome and skirt are swept out circularly less than or equal to 180 degrees about the central axis.

NEE 36. The cover of NEE 25, wherein the acute angle A is greater than or equal to sixty degrees.

NEE 37. The cover of NEE 36, wherein the acute angle A is greater than or equal to sixty-five degrees.

NEE 38. The cover of NEE 37, wherein the acute angle A is greater than or equal to seventy degrees.

NEE 39. The cover of NEE 38, wherein the acute angle A is greater than or equal to seventy-five degrees.

NEE 40. The cover of NEE 39, wherein the acute angle A is greater than or equal to eighty degrees.

NEE 41. The cover of NEE 40, wherein the acute angle A is greater than or equal to eighty-five degrees.

NEE 42. The cover of NEE 1, wherein the dome extends upward from the lower portion to a top portion of the dome in a second direction that is generally away from the skirt.

NEE 43. The cover of NEE 42, wherein the second direction is parallel with the axis.

NEE 44. The cover of NEE 42, wherein the dome also extends inward from the lower portion to the top portion of the dome in the second direction, wherein the second direction is also generally toward the central axis.

NEE 45. The cover of NEE 44, wherein the second direction forms an acute angle B with a portion of the central axis that extends above the dome.

NEE 46. The cover of NEE 45, wherein $R2 \geq 2.25 \times R1$.

NEE 47. The cover of NEE 46, wherein $R2 \geq 2.5 \times R1$.

NEE 48. The cover of NEE 47, wherein $R2 \geq 2.75 \times R1$.

NEE 49. The cover of NEE 48, wherein $R2 \geq 3 \times R1$.

NEE 50. The cover of NEE 45, wherein the dome and skirt are swept out arcuately 360 degrees about the central axis.

NEE 51. The cover of NEE 50, wherein R1 and R2 are radii of the lower portion of the dome and of the outer edge of the skirt, respectively, and wherein the dome and skirt are swept out circularly 360 degrees about the central axis.

NEE 52. The cover of NEE 45, wherein the dome and skirt are swept out arcuately less than 360 degrees about the central axis.

NEE 53. The cover of NEE 52, wherein R1 and R2 are radii of the lower portion of the dome and of the outer edge of the skirt, respectively, and wherein the dome and skirt are swept out circularly less than 360 degrees about the central axis.

NEE 54. The cover of NEE 45, wherein the dome and skirt are swept out arcuately less than or equal to 180 degrees about the central axis.

NEE 55. The cover of NEE 54, wherein R1 and R2 are radii of the lower portion of the dome and of the outer edge of the skirt, respectively, and wherein the dome and skirt are swept out circularly less than or equal to 180 degrees about the central axis.

NEE 56. The cover of NEE 45, wherein the acute angle B is less than or equal to thirty degrees.

NEE 57. The cover of NEE 56, wherein the acute angle B is less than or equal to twenty-five degrees.

NEE 58. The cover of NEE 57, wherein the acute angle B is less than or equal to twenty degrees.

NEE 59. The cover of NEE 58, wherein the acute angle B is less than or equal to fifteen degrees.

NEE 60. The cover of NEE 59, wherein the acute angle B is less than or equal to ten degrees.

NEE 61. The cover of NEE 60, wherein the acute angle B is less than or equal to five degrees.

NEE 62. The cover of NEE 42, the dome further comprising a plurality of elongated upper ribs, wherein the plurality of elongated upper ribs define the plurality of first openings extending through the sidewall.

NEE 63. The cover of NEE 62, wherein each of the plurality of elongated upper ribs has a first end and a second end that is opposite the first end, wherein the first end is coupled with the lower portion of the dome and the second end is coupled with a top portion of the dome.

NEE 64. The cover of NEE 63, wherein the plurality of elongated upper ribs extend generally along the second direction.

NEE 65. The cover of NEE 64, wherein the second direction is parallel with the central axis.

NEE 66. The cover of NEE 64, wherein the dome also extends inward from the lower portion to the top portion of the dome in the second direction, wherein the second direction is also generally toward the central axis.

NEE 67. The cover of NEE 66, wherein the second direction forms an acute angle B with a portion of the central axis that extends above the dome.

NEE 68. The cover of NEE 67, wherein $R2 \geq 2.25 \times R1$.

NEE 69. The cover of NEE 68, wherein $R2 \geq 2.5 \times R1$.

NEE 70. The cover of NEE 69, wherein $R2 \geq 2.75 \times R1$.

NEE 71. The cover of NEE 70, wherein $R2 \geq 3 \times R1$.

NEE 72. The cover of NEE 67, wherein the dome and skirt are swept out arcuately 360 degrees about the central axis.

NEE 73. The cover of NEE 72, wherein R1 and R2 are radii of the lower portion of the dome and of the outer edge of the skirt, respectively, and wherein the dome and skirt are swept out circularly 360 degrees about the central axis.

NEE 74. The cover of NEE 67, wherein the dome and skirt are swept out arcuately less than 360 degrees about the central axis.

NEE 75. The cover of NEE 74, wherein R1 and R2 are radii of the lower portion of the dome and of the outer edge of the skirt, respectively, and wherein the dome and skirt are swept out circularly less than 360 degrees about the central axis.

NEE 76. The cover of NEE 74, wherein the dome and skirt are swept out arcuately less than or equal to 180 degrees about the central axis.

NEE 77. The cover of NEE 76, wherein R1 and R2 are radii of the lower portion of the dome and of the outer edge of the skirt, respectively, and wherein the dome and skirt are swept out circularly less than or equal to 180 degrees about the central axis.

NEE 78. The cover of NEE 67, wherein the acute angle B is less than or equal to thirty degrees.

NEE 79. The cover of NEE 78, wherein the acute angle B is less than or equal to twenty-five degrees.

NEE 80. The cover of NEE 79, wherein the acute angle B is less than or equal to twenty degrees.

NEE 81. The cover of NEE 80, wherein the acute angle B is less than or equal to fifteen degrees.

NEE 82. The cover of NEE 81, wherein the acute angle B is less than or equal to ten degrees.

NEE 83. The cover of NEE 82, wherein the acute angle B is less than or equal to five degrees.

NEE 84. The cover of NEE 67, the dome and skirt are swept out arcuately 360 degrees about the central axis and the cover is configured to couple with a mounting surface adjacent a drain of the mounting surface.

NEE 85. The cover of NEE 84, wherein the mounting surface comprises a roof.

NEE 86. The cover of NEE 67, wherein the dome and skirt are swept out arcuately less than 360 degrees about the central axis in respective sections defining first and second mating surfaces on first and second ends respectively of the swept out sections, the first and second mating surfaces shaped to complement an external structure adjacent the mounting surface.

NEE 87. The cover of NEE 86, wherein the external mounting structure is a wall intersecting the mounting surface and having a drain therein configured to be covered by the cover.

NEE 88. The cover of NEE 86, wherein the first mating surface forms a first contour that is substantially planar, and wherein the second mating surface forms a second contour that is substantially planar.

NEE 89. The cover of NEE 88, wherein the first and second contours are substantially coplanar.

NEE 90. The cover of NEE 88, wherein the first and second contours are substantially non coplanar.

NEE 91. The cover of NEE 86, wherein the first mating surface forms a first contour that is substantially non planar.

NEE 92. The cover of NEE 86, wherein the second mating surface forms a second contour that is substantially non planar.

NEE 93. The cover of NEE 1, further comprising an arcuate outer ring configured to couple with the outer edge of the skirt, and to at least partially cover the outer edge when coupled thereto.

NEE 94. The cover of NEE 93, the arcuate outer ring further comprising a plurality of openings extending through the arcuate outer ring and configured to allow fluid passage through the openings.

NEE 95. The cover of NEE 94, wherein at least one of the plurality of openings of the arcuate outer ring is further configured to be in fluid communication with at least one of the plurality of lower spaces of the skirt when the arcuate outer ring is coupled with the skirt.

NEE 96. The cover of NEE 95, wherein the arcuate outer ring is coupled with the outer edge of the skirt.

NEE 97. The cover of NEE 93, further comprising an arcuate mount configured to couple with the cover and with a mounting surface adjacent a drain.

NEE 98. The cover of NEE 97, the arcuate mount comprising an arcuate foundation having a top side and a bottom side opposite the top side, the top side configured to face the cover and having a catch configured to couple with at least one projecting insert of the cover, the bottom side configured to face the mounting surface.

NEE 99. The cover of NEE 98, wherein the at least one projecting insert is on the outer ring such that the mount couples with the outer ring.

NEE 100. The cover of NEE 98, wherein the at least one projecting insert is on the skirt such that the mount couples with the skirt.

NEE 101. The cover of NEE 99, wherein the at least one projecting insert is on the outer edge of the skirt.

NEE 102. The cover of NEE 98, wherein the catch of the arcuate mount is a nub and includes an opening therein, the opening configured to receive and releasably snap therein the projecting insert.

NEE 103. The cover of NEE 98, wherein the catch is an arcuate outer lip extending along an outer perimeter of the arcuate foundation and configured to couple with the outer edge of the skirt.

NEE 104. The cover of NEE 103, the arcuate outer lip further configured to couple with the outer edge of the skirt by expanding to receive the outer edge therein and then contracting to secure the outer edge therein.

NEE 105. The cover of NEE 97, the arcuate mount further comprising a plurality of arcuate tabs coupled with the arcuate foundation and extending inward toward the central axis when coupled with the cover.

NEE 106. The cover of NEE 105, wherein the plurality of arcuate tabs are interspersed in between adjacent segments of the foundation.

NEE 107. The cover of NEE 106, wherein the plurality of arcuate tabs are interspersed in between adjacent segments of the foundation and having a gap therebetween to form a plurality of flex joints.

NEE 108. The cover of NEE 107, the plurality of arcuate tabs having openings therethrough configured to receive a fastener therein to secure the arcuate mount to the mounting surface.

NEE 109. The cover of NEE 108, wherein the skirt, the dome, the outer ring and the mount are swept out arcuately 360 degrees about the central axis.

NEE 110. The cover of NEE 109, wherein R1 and R2 are radii of the lower portion of the dome and of the outer edge of the skirt, respectively, and wherein skirt, the dome, the outer ring and the mount are swept out circularly 360 degrees about the central axis.

NEE 111. The cover of NEE 108, wherein the skirt, the dome, the outer ring and the mount are swept out arcuately less than 360 degrees about the central axis.

NEE 112. The cover of NEE 111, wherein R1 and R2 are radii of the lower portion of the dome and of the outer edge of the skirt, respectively, and wherein the skirt, the dome, the outer ring and the mount are swept out circularly less than 360 degrees about the central axis.

NEE 113. The cover of NEE 111, wherein the dome and skirt are swept out arcuately less than or equal to 180 degrees about the central axis.

NEE 114. The cover of NEE 113, wherein R1 and R2 are radii of the lower portion of the dome and of the outer edge of the skirt, respectively, and wherein the skirt, the dome, the outer ring and the mount are swept out circularly less than or equal to 180 degrees about the central axis.

NEE 115. The cover of NEE 1, the dome having a top portion defining a plurality of top spaces extending therethrough and configured to allow fluid to pass therethrough.

NEE 116. The cover of NEE 22, the dome further comprising a plurality of elongated upper ribs, and wherein each of the plurality of elongated upper ribs is coupled directly with one of the plurality of elongated lower ribs forming a continuous rib from the outer edge of the skirt to a top portion of the dome.

NEE 117. The cover of NEE 116, wherein each of the plurality of lower spaces is in direct fluid communication with one of the plurality of upper spaces forming a continuous space.

NEE 118. The cover of NEE 1, wherein the plurality of first openings of the dome are wider than the plurality of second openings of the skirt.

NEE 119. The cover of NEE 22, each of the plurality of elongated lower ribs further comprising: a first end having a first width; and a second end that is opposite the first end and having a second width, wherein the first end is connected to the lower portion of the dome and the second end is connected to the outer edge of the skirt.

NEE 120. The cover of NEE 119, wherein the first width is approximately equal to the second width.

NEE 121. The cover of NEE 119, wherein the first width is less than the second width.

NEE 122. The cover of NEE 121, each of the plurality of elongated lower ribs further comprising: a first side extending from the first end to the second end and defining a first plane; and a second side that is opposite the first side, the second side extending from the first end to the second end and defining a second plane, wherein the first and second planes are not parallel to each other.

NEE 123. The cover of NEE 122, wherein an acute angle between the first and second planes is less than or equal to fifteen degrees.

NEE 124. The cover of NEE 123, wherein the acute angle between the planes is less than or equal to ten degrees.

NEE 125. The cover of NEE 119, wherein the first width is greater than the second width.

NEE 126. The cover of NEE 1, the dome further comprising a removable lid at a top portion of the dome.

NEE 127. The cover of NEE 126, the lid comprising a handle projecting therefrom and configured to be grasped by a user to remove the lid from the top.

NEE 128. A cover for a drain, the cover comprising an arcuate lower portion defining a central vertical axis and comprising an arcuate outer perimeter defining a horizontal plane substantially orthogonal to the central axis and having at least one insert coupled with and projecting away from the arcuate outer perimeter; a plurality of elongated lower ribs connected to the arcuate outer perimeter and extending toward the central vertical axis at an acute angle A with respect to the horizontal plane, wherein A is less than or equal to thirty degrees; and a plurality of lower spaces extending through the arcuate lower portion and configured to allow fluid flow therethrough; an arcuate outer ring coupled to the arcuate outer perimeter of the arcuate lower portion and to at least partially cover the arcuate outer perimeter when coupled thereto; an arcuate mount comprising: an arcuate foundation having a top side and a bottom side opposite the top side, the top side configured to face the arcuate lower portion and having a catch configured to couple with the at least one projecting insert of the arcuate outer perimeter of the arcuate lower portion, the bottom side configured to couple with an external mounting structure; an arcuate upper portion comprising: a plurality of elongated upper ribs each having a first end and a second end opposite the first end, the first end coupled with the plurality of elongated lower ribs of the arcuate lower portion, and extending away from the arcuate lower portion at an angle B with respect to the central vertical axis; and a plurality of upper spaces in between and defined at least partially by the plurality of elongated upper ribs; and a top coupled with the second ends of the plurality of elongated upper ribs of the arcuate upper portion.

NEE 129. A method of coupling a cover for a drain to a mounting surface, the method comprising: coupling the cover to the mounting surface such that the cover at least partially surrounds the drain, wherein the drain has a half-width of R1, wherein the cover includes an arcuate dome defining a central axis and an arcuate skirt coupled with the dome and having an outer edge, wherein the skirt flares outward and downward from the dome to the outer edge in a first direction that is generally away from the central axis and generally away from the dome, wherein the first direction forms an acute angle A with a portion of the central axis that extends below the skirt, wherein the skirt forms a plurality of openings extending through the skirt, and wherein the outer edge of the skirt is located a perpendicular distance R2 from the axis, and wherein R2 is at least twice R1.

NEE 130. A cover for a drain, the cover comprising: a dome having a sidewall with a lower portion, wherein the sidewall defines a central axis and forms a plurality of first openings extending through the sidewall, and wherein at least part of the lower portion is located a perpendicular distance R1 from the axis; and a skirt coupled with the lower portion of the sidewall and having an outer edge, wherein the skirt flares outward and downward from the lower portion to the outer edge in a first direction that is generally away from the central axis and generally away from the dome, wherein the first direction forms an acute angle A with a portion of the central axis that extends below the skirt, wherein the skirt forms a plurality of second openings extending through the skirt, and wherein at least part of the outer edge of the skirt is located a perpendicular distance R2 from the axis, and wherein R2 is at least twice R1.

NEE 131. The cover of NEE 130, wherein the lower portion is located a minimum perpendicular distance R1 from the axis, and wherein the outer edge of the skirt is located a minimum perpendicular distance R2 from the axis.

NEE 132. The cover of NEE 130, wherein the skirt has a generally square planform.

NEE 133. A cover for a drain, wherein the drain has a drain body opening having a maximum width W, the cover comprising: a skirt having an outer edge, wherein the skirt forms a plurality of openings extending through the skirt, and wherein at least part of the outer edge of the skirt is located a perpendicular distance R2 from a geometric center axis defined by the outer edge, and wherein R2 is greater than or equal to W.

NEE 134. The cover of NEE 133, wherein R2≥1.5×W.

NEE 135. The cover of NEE 134, wherein R2≥2×W.

NEE 136. The cover of NEE 135, wherein R2≥3×W or wherein R2≥4×W or wherein R2≥5×W.

NEE 137. The cover of NEE 133, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 138. The cover of NEE 133, wherein W is less than or equal to 1 inch.

NEE 139. The cover of NEE 138, wherein R2≥1.5×W.

NEE 140. The cover of NEE 139, wherein R2≥2×W.

NEE 141. The cover of NEE 140, wherein R2≥R2≥3×W or wherein R2≥4×W or wherein R2≥5×W.

NEE 142. The cover of NEE 138, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 143. The cover of NEE 133, wherein W is less than or equal to 1.5 inches.

NEE 144. The cover of NEE 143, wherein R2≥1.5×W.

NEE 145. The cover of NEE 144, wherein R2≥2×W.

NEE 146. The cover of NEE 145, wherein R2≥R2≥3×W or wherein R2≥4×W or wherein R2≥5×W.

NEE 147. The cover of NEE 143, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 148. The cover of NEE 133, wherein W is less than or equal to 2 inches.

NEE 149. The cover of NEE 148, wherein R2≥1.5×W.

NEE 150. The cover of NEE 149, wherein R2≥2×W.

NEE 151. The cover of NEE 150, wherein R2≥3×W or wherein R2≥4×W or wherein R2≥5×W.

NEE 152. The cover of NEE 148, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 153. The cover of NEE 133, wherein W is less than or equal to 3 inches.

NEE 154. The cover of NEE 153, wherein R2≥1.5×W.

NEE 155. The cover of NEE 154, wherein R2≥2×W.

NEE 156. The cover of NEE 155, wherein R2≥3×W or wherein R2≥4×W or wherein R2≥5×W.

NEE 157. The cover of NEE 153, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 158. The cover of NEE 133, wherein W is less than or equal to 4 inches.

NEE 159. The cover of NEE 148, wherein R2≥1.5×W.

NEE 160. The cover of NEE 149, wherein R2≥2×W.

NEE 161. The cover of NEE 150, wherein R2≥3×W or wherein R2≥4×W or wherein R2≥5×W.

NEE 162. The cover of NEE 158, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 163. The cover of NEE 133, wherein W is less than or equal to 5 inches.

NEE 164. The cover of NEE 163, wherein R2≥1.5×W.

NEE 165. The cover of NEE 164, wherein R2≥2×W.

NEE 166. The cover of NEE 165, wherein R2≥3×W or wherein R2≥4×W or wherein R2≥5×W.

NEE 167. The cover of NEE 163, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 168. The cover of NEE 133, wherein W is less than or equal to 6 inches.

NEE 169. The cover of NEE 168, wherein R2≥1.5×W.

NEE 170. The cover of NEE 169, wherein R2≥2×W.

NEE 171. The cover of NEE 170, wherein R2≥3×W or wherein R2≥4×W or wherein R2≥5×W.

NEE 172. The cover of NEE 168, further comprising a dome having a sidewall with a lower portion, wherein the lower portion is coupled with the skirt, wherein the sidewall forms a plurality of openings extending through the sidewall, and wherein at least part of the lower portion is located a perpendicular distance R1 from the axis, wherein the skirt flares outward and downward from the lower portion to the outer edge in a first direction that is generally away from the axis and generally away from the dome, wherein the first direction forms an acute angle A with a portion of the axis that extends below the skirt, and wherein R2 is at least twice R1.

NEE 173. The cover of NEE 133 further comprising a mount configured to couple with the cover and with a mounting surface adjacent the drain.

NEE 174. A mount for coupling a drain cover with a mounting surface adjacent a drain, the mount configured to couple with the cover and with the mounting surface adjacent the drain.

NEE 175. The mount of NEE 174, wherein the drain has a drain body opening having a maximum width W, wherein the mount has a width R3, and wherein R3 is at least twice W.

NEE 176. The mount of NEE 175, wherein R3≥3×W.

NEE 177. The mount of NEE 176, wherein R3≥4×W.

NEE 178. The mount of NEE 177, wherein R3≥5×W.

NEE 179. The mount of NEE 174, further comprising a foundation having a top side and a bottom side opposite the top side, the top side configured to face the cover and having a protrusion configured to be received through a flexible opening of the cover, the bottom side configured to face the mounting surface.

NEE 180. The mount of NEE 179, wherein the protrusion at least partially extends through the flexible opening when the mount is coupled with the cover.

NEE 181. The mount of NEE 179, wherein the protrusion comprises an extended section coupled with a ball catch on the end of the extended section.

NEE 182. The mount of NEE 181, wherein the extended section at least partially extends through the flexible opening when the mount is coupled with the cover, and wherein the ball catch is adjacent the top side of the foundation when the mount is coupled with the cover.

NEE 183. The mount of NEE 179, wherein the foundation is arcuate.

NEE 184. The mount of NEE 181, wherein the foundation is arcuate.

NEE 185. The mount of NEE 182, wherein the drain has a drain body opening having a maximum width W, wherein the mount has a width R3, and wherein R3 is at least twice W.

NEE 186. The mount of NEE 185, wherein R3≥3×W.

NEE 187. The mount of NEE 186, wherein R3≥4×W.

NEE 188. The mount of NEE 187, wherein R3≥5×W.

NEE 189. The mount of NEE 179, the arcuate mount further comprising a plurality of inwardly extending tabs coupled with the foundation.

NEE 190. The mount of NEE 189, wherein the plurality of tabs are interspersed in between adjacent segments of the foundation.

NEE 191. The mount of NEE 190, wherein the plurality of tabs are interspersed in between adjacent segments of the foundation and having a gap therebetween to form a plurality of flex joints.

NEE 192. The mount of NEE 189, the plurality of tabs having openings therethrough configured to receive a fastener therein to secure the mount to the mounting surface.

NEE 193. The mount of NEE 189, wherein the foundation is arcuate.

NEE 194. The mount of NEE 193, wherein the plurality of tabs are arcuate.

NEE 195. The mount of NEE 174, wherein the mount is configured to adhere to the mounting surface.

NEE 196. The mount of NEE 174, wherein the mount is configured to fasten to the mounting surface.

NEE 197. The mount of NEE 179, wherein the mount is configured to adhere to the mounting surface.

NEE 198. The mount of NEE 179, wherein the mount is configured to fasten to the mounting surface.

NEE 199. The mount of NEE 181, wherein the mount is configured to adhere to the mounting surface.

NEE 200. The mount of NEE 181, wherein the mount is configured to fasten to the mounting surface.

NEE 201. The mount of NEE 182, wherein the mount is configured to adhere to the mounting surface.

NEE 202. The mount of NEE 182, wherein the mount is configured to fasten to the mounting surface.

NEE 203. A pipe stem for connecting a drain cover with a drain body, the pipe stem comprising a sidewall defining a channel therethrough and having a first end and a bottom end; a plurality of openings formed in the sidewall configured to allow fluid to pass therethrough and into the channel, wherein the first end is configured to couple with the drain cover, and wherein the second end is configured to couple with the drain body.

NEE 204. The pipe stem of NEE 203, wherein the second end is configured to snap fit to the drain body.

NEE 205. The pipe stem of NEE 203, wherein the second end is configured to interference fit with the drain body.

NEE 206. The pipe stem of NEE 203, wherein the second end comprises threads and is configured to screw to the drain body.

NEE 207. The pipe stem of NEE 203, further comprising a clip configured to couple the second end of the pipe stem to the drain body.

NEE 208. The pipe stem of NEE 203, wherein the plurality of openings extend longitudinally between the first and second ends.

NEE 209. The pipe stem of NEE 203, wherein the sidewall is arcuate.

NEE 210. The pipe stem of NEE 209, wherein the sidewall is circular.

NEE 211. The pipe stem of NEE 203, wherein the sidewall is metallic.

NEE 212. The pipe stem of NEE 203, wherein the sidewall is plastic.

NEE 213. The pipe stem of NEE 203, wherein the sidewall is a polymer.

NEE 214. The pipe stem of NEE 203, wherein the sidewall is circular.

NEE 215. The cover of NEE 133, wherein the skirt comprises a plurality of levels including at least a top level and a bottom level located generally lower than the top level, and wherein adjacent levels are coupled to each other by a connecting sidewall having a plurality of openings therethough.

NEE 216. The cover of NEE 215, wherein the bottom level comprises the outer edge.

NEE 217. The cover of NEE 215, further comprising at least one intermediate level located in between the top and bottom levels, wherein a first connecting sidewall couples the bottom level with the intermediate level, and wherein a second connecting sidewall couples the intermediate level with the top level.

NEE 218. The cover of NEE 215, further comprising at least a first and second intermediate level located in between the top and bottom levels, wherein a first connecting sidewall couples the bottom level with the first intermediate level, wherein a second connecting sidewall couples the first intermediate level with the second intermediate level, and wherein a third connecting sidewall couples the second intermediate level with the top level.

NEE 219. The cover of NEE 215, wherein $R2 \geq 1.5 \times W$.

NEE 220. The cover of NEE 215, wherein $R2 \geq 2 \times W$.

NEE 221. The cover of NEE 215, wherein $R2 \geq 3 \times W$ or wherein $R2 \geq 4 \times W$ or wherein $R2 \geq 5 \times W$.

NEE 222. The cover of NEE 215, further comprising a dome having a sidewall with a lower portion, wherein the lower portion is coupled with the top level of the skirt, wherein the sidewall forms a plurality of openings extending through the sidewall, and wherein at least part of the lower portion is located a perpendicular distance R1 from the axis, wherein each level of the skirt flares outward and downward in generally parallel directions, each direction being generally away from the axis and generally away from the dome, wherein each direction forms an acute angle A with a portion of the axis that extends below the skirt, and wherein R2 is at least twice R1.

NEE 223. The cover of NEE 215, wherein W is less than or equal to 1 inch.

NEE 224. The cover of NEE 215, wherein W is less than or equal to 1.5 inches.

NEE 225. The cover of NEE 215, wherein W is less than or equal to 2 inches.

NEE 226. The cover of NEE 215, wherein W is less than or equal to 3 inches.

NEE 227. The cover of NEE 215, wherein W is less than or equal to 4 inches.

NEE 228. The cover of NEE 215, wherein W is less than or equal to 5 inches.

NEE 229. The cover of NEE 215, wherein W is less than or equal to 6 inches.

NEE 230. The cover of NEE 222, wherein W is less than or equal to 1 inches.

NEE 231. The cover of NEE 222, wherein W is less than or equal to 1.5 inches.

NEE 232. The cover of NEE 222, wherein W is less than or equal to 2 inches.

NEE 233. The cover of NEE 222, wherein W is less than or equal to 3 inches.

NEE 234. The cover of NEE 222, wherein W is less than or equal to 4 inches.

NEE 235. The cover of NEE 222, wherein W is less than or equal to 5 inches.

NEE 236. The cover of NEE 222, wherein W is less than or equal to 6 inches.

NEE 237. A cover for a drain, the cover comprising a skirt comprising a flat portion including a plurality of openings extending therethorugh, the flat portion forming a plurality of grooves extending in a first direction and having an outer slot surrounding the flat portion on one or more sides of an outer region of the flat portion; and an angled portion including a plurality of openings extending therethorugh, the angled portion coupled with at least part of the outer region of the flat portion and having an outer edge, wherein the angled portion flares outward and downward from the flat portion to the outer edge; and a dome configured to couple with the skirt, the dome comprising a first dome portion; and a second dome portion, wherein each dome portion comprises a sidewall with a lower portion, wherein each sidewall forms a plurality of openings extending through the sidewall, and wherein the first dome portion is configured to move relative to the second dome portion to position the dome on the skirt, and wherein the grooves and outer slot of the skirt are each configured to receive at least part of the lower portions of the first and second dome portions, such that the first and second dome portions can slide in the first direction.

NEE 238. The cover of NEE 237, wherein the grooves and outer slot of the skirt are each configured to receive at least part of the lower portions of the first and second dome portions, such that the first and second dome portions can slide in a second direction that is perpendicular to the first direction.

NEE 239. The cover of NEE 237, wherein each sidewall of the first and second dome portions includes complementary fingers extending towards each other and configured to slide past each other when the first and second dome portions are positioned on the skirt.

NEE 240. The cover of NEE 237, wherein the skirt has a generally rectangular planform.

NEE 241. The cover of NEE 237, wherein the outer edge of the skirt is generally rectangular.

NEE 242. The cover of NEE 237, wherein the flat portion of the skirt is generally rectangular.

NEE 243. The cover of NEE 237, wherein the skirt defines a geometric center axis that is perpendicular to the flat portion of the skirt, wherein at least part of the angled portion of the skirt flares outward and downward from the outer region of the flat portion to the outer edge in a first direction that is generally away from the axis and generally away from the flat portion, and wherein the first direction forms an acute angle A with a portion of the axis that extends below the flat portion.

NEE 244. The cover of NEE 243, wherein the angled portion includes a first, second and third angled sub-portion, wherein the first angled sub-portion is oriented angularly 90 degrees with respect to the second angled sub-portion, and wherein the second angled sub-portion is oriented angularly 90 degrees with respect to the third angled sub-portion.

NEE 245. The cover of NEE 243, wherein the drain is a scupper having an opening with a maximum width W, wherein the grooves and outer slot of the skirt are each configured to receive at least part of the lower portions of the first and second dome portions, wherein the first and second dome portions can slide in a second direction that is perpendicular to the first direction.

NEE 246. The cover of NEE 245, wherein the first and second dome portions can slide in the second direction so that a maximum distance between outermost parts of the first and second dome portions is less than or equal to W.

NEE 257. The cover of NEE 245, wherein the first and second dome portions can slide in the second direction so that a maximum distance between outermost parts of the first and second dome portions is greater than W.

While there has been illustrated and described what are presently considered to be example embodiments, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment may be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the invention is to cover all modifications, equivalents, and alternatives falling within the spirit and scope of the various embodiments described and the appended claims. Any methods disclosed herein need not be performed in the order recited.

The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", "up to about," and "substantially" as used herein include the recited numbers, and also represent an amount or characteristic close to the stated amount or characteristic that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount or characteristic. Features of embodiments disclosed herein preceded by a term such as "approximately", "about", and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. A cover for a drain, the cover comprising:

an upper portion having a wall with a lower end, wherein the wall defines a central axis and forms a plurality of first openings extending through the wall; and a lower portion coupled with the lower end of the wall and having an outer edge, wherein the lower portion comprises a portion that flares outward from the lower end to the outer edge in a first direction that is generally away from the central axis, wherein the first direction forms an angle A with a portion of the central axis that extends below the lower portion, wherein the lower portion forms a plurality of second openings extending through the lower portion, and wherein the angle A is greater than or equal to seventy-five degrees and is less than ninety degrees.

2. The cover of claim 1, wherein the upper portion and lower portion are swept out arcuately about the central axis.

3. The cover of claim 2, wherein the upper portion and lower portion are swept out arcuately 360 degrees about the central axis.

4. The cover of claim 1, wherein the lower portion has a generally circular planform.

5. The cover of claim 1, wherein the lower portion has a generally square planform.

6. The cover of claim 1, wherein the lower portion has a generally rectangular planform.

7. The cover of claim 1, wherein an outermost portion of the lower end is located a perpendicular distance R1 from the central axis, an outermost portion of the outer edge is located a perpendicular distance R2 from the central axis, and wherein R2 is at least twice R1.

8. The cover of claim 7, wherein R2≥3×R1.

9. The cover of claim 7, wherein the drain has a drain body opening having a maximum width of W, and wherein R2 is greater than or equal to W.

10. The cover of claim 1, wherein the angle A is greater than or equal to eighty degrees.

11. The cover of claim 1, wherein substantially the entire lower portion flares outward from the lower end to the outer edge in the first direction.

12. The cover of claim 1, wherein the upper portion extends upward from the lower end to a top portion of the upper portion in a second direction that is generally away from the lower portion and forms an angle B with a portion of the central axis that extends above the upper portion, wherein the angle B is less than or equal to thirty degrees.

13. A cover for a drain, the cover comprising:

an upper portion comprising a plurality of upper ribs, wherein the plurality of upper ribs define a plurality of first openings extending through the upper portion; and a lower portion comprising a plurality of lower ribs, wherein the plurality of lower ribs define a plurality of second openings extending through the lower portion, wherein at least one of the plurality of lower ribs extends in a first direction that forms an angle A with a portion of a vertical axis that extends below the lower portion, wherein the angle A is greater than or equal to seventy-five degrees and is less than ninety degrees.

14. The cover of claim 13, wherein an outermost portion of the upper portion is located a perpendicular distance R1 from the central axis, an outermost portion of the lower portion is located a perpendicular distance R2 from the central axis, and wherein R2 is at least twice R1.

15. The cover of claim 13, wherein the upper portion and lower portion are swept out arcuately about the central axis.

16. The cover of claim 13, wherein the lower portion has a generally rectangular planform.

17. The cover of claim 13, wherein the angle A is greater than or equal to eighty degrees.

18. A cover for a drain, the cover comprising:

an upper portion having a sidewall; and a lower portion positioned under the upper portion and that flares outward away from a central axis in a first direction that forms an angle A with a portion of the central axis that extends below the lower portion, wherein the angle A is greater than or equal to seventy-five degrees and is less than ninety degrees.

19. The cover of claim 18, wherein the sidewall extends in a second direction that forms an angle B with a portion of the central axis that extends above the upper portion, wherein the angle B is less than or equal to thirty degrees.

20. The cover of claim 18, wherein an outermost portion of the upper portion is located a perpendicular distance R1 from the central axis, an outermost portion of the lower portion is located a perpendicular distance R2 from the central axis, and wherein R2 is at least twice R1.

* * * * *